US008068083B2

(12) United States Patent
Shirai et al.

(10) Patent No.: US 8,068,083 B2
(45) Date of Patent: Nov. 29, 2011

(54) DISPLAY APPARATUS, DATA DRIVER AND METHOD OF DRIVING DISPLAY PANEL

(75) Inventors: Hiroaki Shirai, Kanagawa (JP); Yoshiharu Hashimoto, Kanagawa (JP)

(73) Assignee: Renesas Electronics Corporation, Kawasaki-shi, Kanagawa (JP)

( * ) Notice: Subject to any disclaimer, the term of this patent is extended or adjusted under 35 U.S.C. 154(b) by 992 days.

(21) Appl. No.: 11/976,573

(22) Filed: Oct. 25, 2007

(65) Prior Publication Data

US 2008/0100605 A1 May 1, 2008

(30) Foreign Application Priority Data

Oct. 26, 2006 (JP) ..... 2006-291709

(51) Int. Cl.
*G09G 3/36* (2006.01)

(52) U.S. Cl. ..... 345/99; 345/98; 345/204

(58) Field of Classification Search ..... 345/87–102, 345/204–215, 690–694
See application file for complete search history.

(56) References Cited

U.S. PATENT DOCUMENTS

| | | | | |
|---|---|---|---|---|
| 6,333,729 | B1 * | 12/2001 | Ha | 345/98 |
| 6,424,328 | B1 * | 7/2002 | Ino et al. | 345/87 |
| 6,597,349 | B1 * | 7/2003 | Koyama et al. | 345/204 |
| 6,756,962 | B1 * | 6/2004 | Akimoto et al. | 345/98 |
| 7,006,072 | B2 | 2/2006 | Ahn | |
| 7,239,300 | B2 * | 7/2007 | Shimizu | 345/100 |
| 7,375,705 | B2 * | 5/2008 | Morita | 345/76 |
| 7,652,651 | B2 * | 1/2010 | Yoon et al. | 345/98 |
| 7,746,310 | B2 | 6/2010 | Ahn | |
| 2003/0151584 | A1 * | 8/2003 | Song et al. | 345/100 |
| 2004/0179027 | A1 * | 9/2004 | Nakai et al. | 345/690 |
| 2004/0257328 | A1 * | 12/2004 | Lim | 345/100 |
| 2005/0207249 | A1 * | 9/2005 | Morita | 365/203 |
| 2006/0077164 | A1 * | 4/2006 | Ahn | 345/94 |
| 2006/0232541 | A1 * | 10/2006 | Kudo et al. | 345/98 |
| 2006/0274570 | A1 * | 12/2006 | Jeoung et al. | 365/154 |

FOREIGN PATENT DOCUMENTS

| | | |
|---|---|---|
| CN | 1417771 A | 5/2003 |
| CN | 1670801 A | 9/2005 |
| CN | 1825402 A | 8/2006 |
| JP | 5-173506 | 7/1993 |
| JP | 11-327518 | 11/1999 |

(Continued)

OTHER PUBLICATIONS

Chinese Office Action dated Dec. 14, 2010, with English translation.

(Continued)

*Primary Examiner* — Alexander Eisen
*Assistant Examiner* — Patrick F Marinelli
(74) *Attorney, Agent, or Firm* — McGinn Intellectual Property Law Group, PLLC

(57) ABSTRACT

A display apparatus includes a display panel; and a data driver configured to output drive voltages from a plurality of output nodes to drive the display panel. The data driver includes a plurality of output amplifiers, each of which is configured to receive a gradation voltage corresponding to a pixel data and to output the drive voltage in response to the gradation voltage; and a driver-side demultiplexer configured to connect the plurality of output amplifiers to selection output nodes selected from among the plurality of output nodes. The display panel includes a plurality of data lines; and a panel-side demultiplexer configured to connect selection data lines selected from among the plurality of data lines with the plurality of output nodes.

6 Claims, 23 Drawing Sheets

FOREIGN PATENT DOCUMENTS

| | | |
|---|---|---|
| JP | 2002-318566 | 10/2002 |
| JP | 2005-43418 | 2/2005 |
| JP | 2005-165102 | 6/2005 |
| JP | 2006-154808 | 6/2006 |

OTHER PUBLICATIONS

Chinese Office Action dated May 19, 2011, with English translation.

* cited by examiner

◆EVEN FRAME DRIVING

A:CONNECT TO OUTPUT AMPLIFIER
H:HIGH IMPEDANCE

DISPLAY APPARATUS, DATA DRIVER AND METHOD OF DRIVING DISPLAY PANEL

BACKGROUND OF THE INVENTION

1. Field of the Invention

The present invention relates to a display apparatus, and more particularly, to a display apparatus in which data lines of a display panel is driven in a time divisional manner.

2. Description of Related Art

Typically, output amplifiers are integrated in a data driver IC for driving data lines in a liquid crystal display panel and other display panels. This is because load of the data line such as parasitic capacitance, wiring resistance and on-resistance of TFT is large. The output amplifier is necessary to quickly drive the data line having the large load to a desirable voltage.

One problem lies in the point that when the number of data lines is increased, the number of output amplifiers is also required to be increased. In the display panel in recent years, the number of pixels is increased more and more. Thus, the number of data lines is also increased, so that the number of output amplifiers provided to drive the data lines tends to be increased. However, the increase in the number of output amplifiers causes the following problems. The first problem lies in the increase in the chip area of the data driver IC when the number of output amplifiers is increased. The increase in the chip area of the data driver IC is not preferable because this involves the increase in cost of the data driver IC. The second problem lies in the increase in the steady-state consumed power of the data driver IC. Since a steady-state current flows through the output amplifier according to a power supply voltage, the output amplifier consumes a certain power in a steady-state state. Thus, the increase in the number of output amplifiers causes the increase in the consumed power as the entire data driver IC, and this is not especially preferable in case that a display apparatus is used in a field which requests the small consumed power such as a mobile terminal.

One measure to cope with this problem is to employ a time divisional driving method. The time divisional driving method is a technique that sequentially selects the data line to be driven with the output amplifier by a demultiplexer. In the time divisional driving method, one output amplifier is used to drive data lines. Thus, the number of output amplifiers integrated in the data driver can be reduced.

A hardware configuration for attaining the time divisional driving method is mainly divided into two kinds. In one kind of hardware configuration, demultiplexers (switch) are integrated in the display panel to select the data line, as disclosed in Japanese Laid Open Patent Application (JP-A-Heisei 11-327518) and Japanese Laid Open Patent Application (JP-P2005-43418A). In the other kind of hardware configuration, switches are integrated in the data driver IC to select the data line, as disclosed in Japanese Laid Open Patent Application (JP-A-Heisei 5-173506), and Japanese Laid Open Patent Applications (JP-P2002-318566A and JP-P2006-154808A).

FIG. 1 is a conceptual diagram showing the configuration of a liquid crystal display apparatus in which a demultiplexer is integrated in a display panel to select data lines. In FIG. 1, a liquid crystal display apparatus 100 contains a liquid crystal display panel 101. Scanning lines G, data lines D and pixels 103 are integrated in an effective display region 102 of the liquid crystal display panel 101, i.e., a region that is actually used to display an image in the liquid crystal display panel 101. The scanning lines G extend in an x-axis direction, and the data lines D extend in a y-axis direction. The pixels 103 are provided at intersections of the scanning lines G and the data lines D.

A circuit group for driving the pixels 103 is provided around an effective display region 102. Specifically, a scanning line driver circuit 104 and a demultiplexer 105 are integrated in the liquid crystal display panel 101. Moreover, a data driver IC 106 is connected in a flip-flop manner to the liquid crystal display panel 101. Attention should be paid to the description of the liquid crystal display apparatus 100 in FIG. 1, in which a COG (Chip on Glass) technique is employed to mount the data driver IC 106. The demultiplexer 105 is configured by switches 105*a* provided between the data lines D and output nodes of the data driver IC 106. The liquid crystal display apparatus 100 in FIG. 1 is configured in such a manner that the 6 data lines D are selectively connected to the output node of one data driver IC 106. When the pixel 103 is driven, the 6 data lines D are sequentially selected by the demultiplexer 105, and a drive voltage is supplied from the output node of the data driver IC 106 through the selected data line D to the desirable pixel 103.

The chip width of the data driver IC 106 is smaller than the width of the effective display region 102. Thus, wirings 107 to connect the output node of the data driver IC 106 and the demultiplexer 105 are radially arranged. The region in which this wirings 107 are arranged is referred to as a throttling region 108. The existence of the throttling region 108 is not preferable because of the increase in the region that is not used to actually display the image in the liquid crystal display panel 101.

On the other hand, FIGS. 2 and 3 are conceptual diagrams showing the configuration in which the demultiplexer is integrated in the data driver IC to select the data line. In a liquid crystal display apparatus 100A of FIG. 2, the demultiplexer is integrated in a data driver IC 106A and not in a liquid crystal display panel 101A. The data line D is directly connected to the output node of the data driver IC 106A through the wiring 107 that is laid in the throttling region 108.

FIG. 3 is a block diagram showing a typical configuration of the output stage of the data driver IC 106A. The image data, i.e., a pixel data to specify the gradation of each pixel is sent to a digital-to-analog (D/A) converter (DAC) 111, and the D/A converter 111 supplies a gradation voltage corresponding to the pixel data to an output amplifier 112. The output of the output amplifier 112 is connected to a demultiplexer 113. The demultiplexer 113 sequentially selects data lines D and connects the selected data line D to the output of the output amplifier 112. A drive voltage is supplied from the output node of the data driver IC 106A through the selected data line D to the desirable pixel 103.

Japanese Laid Open Patent Application (JP-P2005-165102A) further discloses the improvement of the configuration in which a demultiplexer to select the data line is integrated in the data driver IC. In the data driver IC disclosed in this related art, the demultiplexer is integrated in the data driver IC to connect the output amplifiers to output nodes, and a signal line to connect the output node, which is not connected to the output amplifier, to the output of a D/A converter is provided.

One demand to the display apparatus in recent years is to increase the number of data lines that can be driven by one data driver IC. In order to cope with this demand, the number of data lines that are driven in a time divisional manner by one output amplifier is required to be increased. Specifically, in the liquid crystal display apparatus of a next generation, it is required to use one output amplifier and drive the six or more data lines.

Another demand is to reduce a region other than an effective display region in the display panel (hereinafter, a non-effective display region). Through reduction of the non-effective display region it is possible to reduce the size of the display apparatus when the display panel is mounted, and this is useful for decreasing cost of the display panel.

However, the above two kinds of hardware configuration have a problem that, when the number of data lines to be driven in a time divisional manner by one output amplifier is increased in association with the increase in the number of data lines to be driven by one data driver IC, the non-effective display region of the display panel is increased.

At first, in the configuration in which the demultiplexer is integrated in the display panel, the increase in the number of data lines to be driven in the time divisional manner by one output amplifier involves the increase in the area of the demultiplexer 105. This results in the increase in the area of the non-effective display region in the display panel. There are two reasons why the non-effective display region is increased. Firstly, the trial of the increase in the number of data lines to be driven in the time divisional manner by the output amplifier requires the increase in the gate width of TFT of the demultiplexer provided on the display panel. The increase in the number of data lines to be driven in the time divisional manner by the output amplifier decreases a drive period of one data line. In order to sufficiently drive the data line in a shorter drive period, the on-resistance of the TFT of the demultiplexer is required to be low. In order to decrease the on-resistance of the TFT, the gate width of the TFT must be increased. However, the increase in the gate width of the TFT of the demultiplexer leads to the increase in the non-effective display region. Secondly, the increase in data lines to be driven in the time divisional manner by the output amplifier requires the increase in the number of control signal lines that are used to send control signals to the switches. This increases the area of the non-effective display region. The control signal line to send the control signal to the switch is a long wiring that reaches from one end of the effective display region of the display panel to the other end, and the area occupied thereby is very large.

On the other hand, in the configuration in which the demultiplexer for selecting the data line is integrated in the data driver IC, the number of output nodes from the data driver IC is not reduced, and the number of data lines driven by the data driver IC is increased. This increases the height of the throttling region 108 (the dimension in the y-axis direction), and also increases the non-effective display region of the display panel. This reason is as follows. In order to prevent a short-circuit between the wirings 107 to connect the data line D and the output of the data driver IC, a certain interval is required to be reserved between the wirings 107. Thus, an angle θ between the wiring 107 and the line in which the outputs of the data driver are lined up has a predetermined lower limit. Thus, in order to connect the wiring 107 to the data line D of the end, the height of the throttling region 108 is required to be reserved to a certain degree. This leads to the increase in the non-effective display region. Also, in order to suppress the height of the throttling region 108, if the interval between the wirings 107 is narrowed to a degree at which the short-circuit is not generated, a parasitic capacitance between the wirings is increased. Therefore, with the influence of the voltage variation caused by the capacitance coupling, a voltage error becomes greater. In particular, the voltage errors of the pixels located at the left and right ends of the effective display region 102 in which the wiring 107 is long become large, which brings about the display irregularity.

SUMMARY

In a first embodiment of the present invention, a display apparatus includes a display panel; and a data driver configured to output drive voltages from a plurality of output nodes to drive the display panel. The data driver includes a plurality of output amplifiers, each of which is configured to receive a gradation voltage corresponding to a pixel data and to output the drive voltage in response to the gradation voltage; and a driver-side demultiplexer configured to connect the plurality of output amplifiers to selection output nodes selected from among the plurality of output nodes. The display panel includes a plurality of data lines; and a panel-side demultiplexer configured to connect selection data lines selected from among the plurality of data lines with the plurality of output nodes.

In a second embodiment of the present invention, a data driver drives a display panel comprises a plurality of data lines and a panel-side demultiplexer which selects the data line to be driven from among the plurality of data lines. The data driver includes a plurality of output nodes connected with inputs of the panel-side demultiplexer; a plurality of output amplifiers configured to receive gradation voltages corresponding to pixel data and to output drive voltages in response to the gradation voltages; a demultiplexer configured to connect the plurality of output amplifiers with selection output nodes selected from among the plurality of output nodes; and a control circuit configured to generate a control signal to control the panel-side demultiplexer.

In a third embodiment of the present invention, a display panel driving method of driving a display panel which comprises a plurality of data lines and a panel-side demultiplexer which selects the data line to be driven from among the plurality of data lines, is provided. The display panel driving method is achieved by connecting outputs of output amplifiers with selection output nodes selected from a plurality of output nodes by a driver-side demultiplexer provided in a data driver; by connecting selection data lines selected from among the plurality of data lines with the selection output nodes by a panel-side demultiplexer provided in the display panel; and by supplying drive voltages from the output amplifiers to the selection data lines through the selection output nodes to write the drive voltages into pixels connected with the selection data lines.

BRIEF DESCRIPTION OF THE DRAWINGS

The above and other objects, advantages and features of the present invention will be more apparent from the following description of certain embodiments taken in conjunction with the accompanying drawings, in which.

DETAILED DESCRIPTION OF PREFERRED EMBODIMENTS

Figure 1:
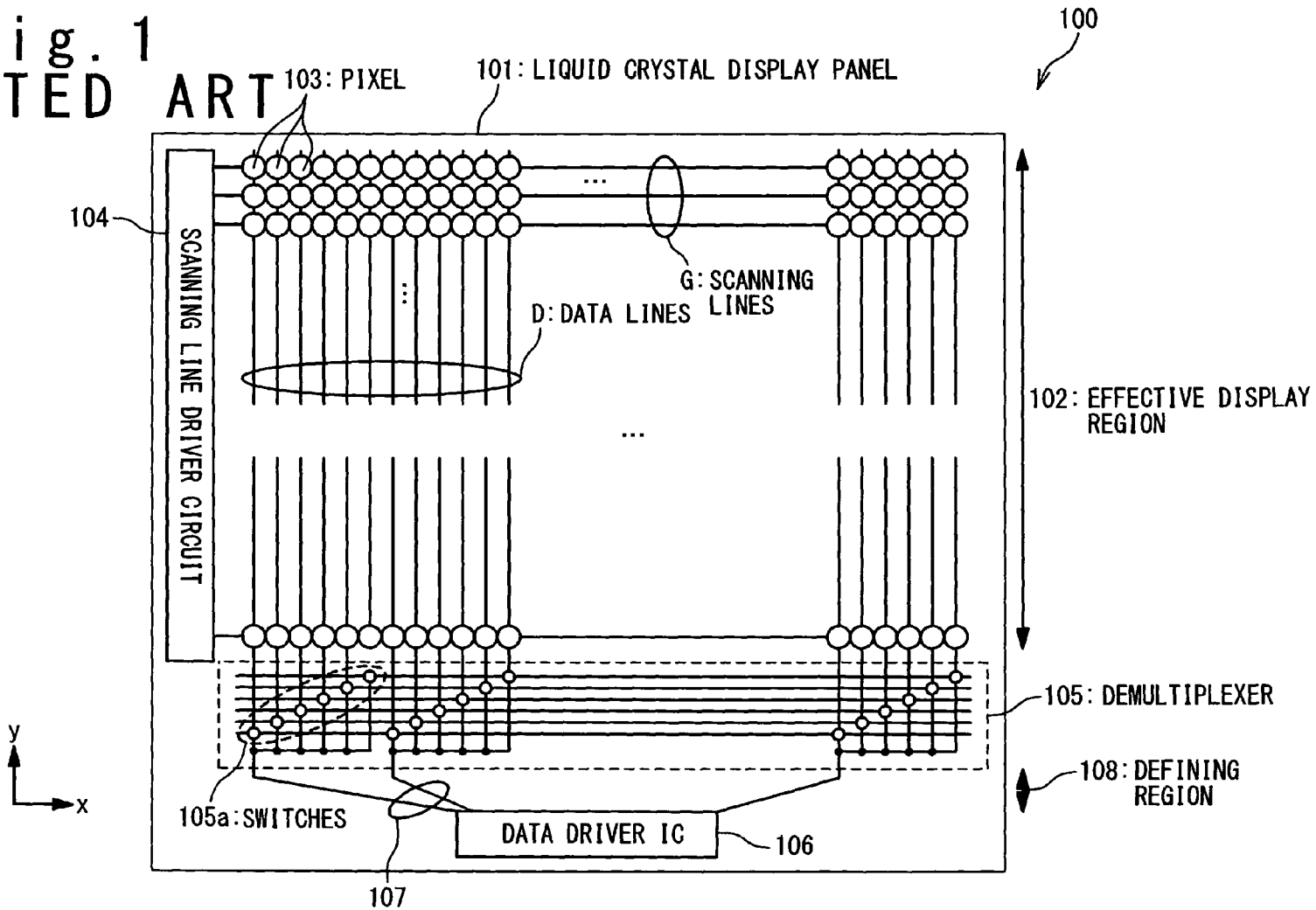
Fig. 1 RELATED ART
FIG. 1 is a diagram showing a configuration of a conventional liquid crystal display apparatus.
Figure 2:
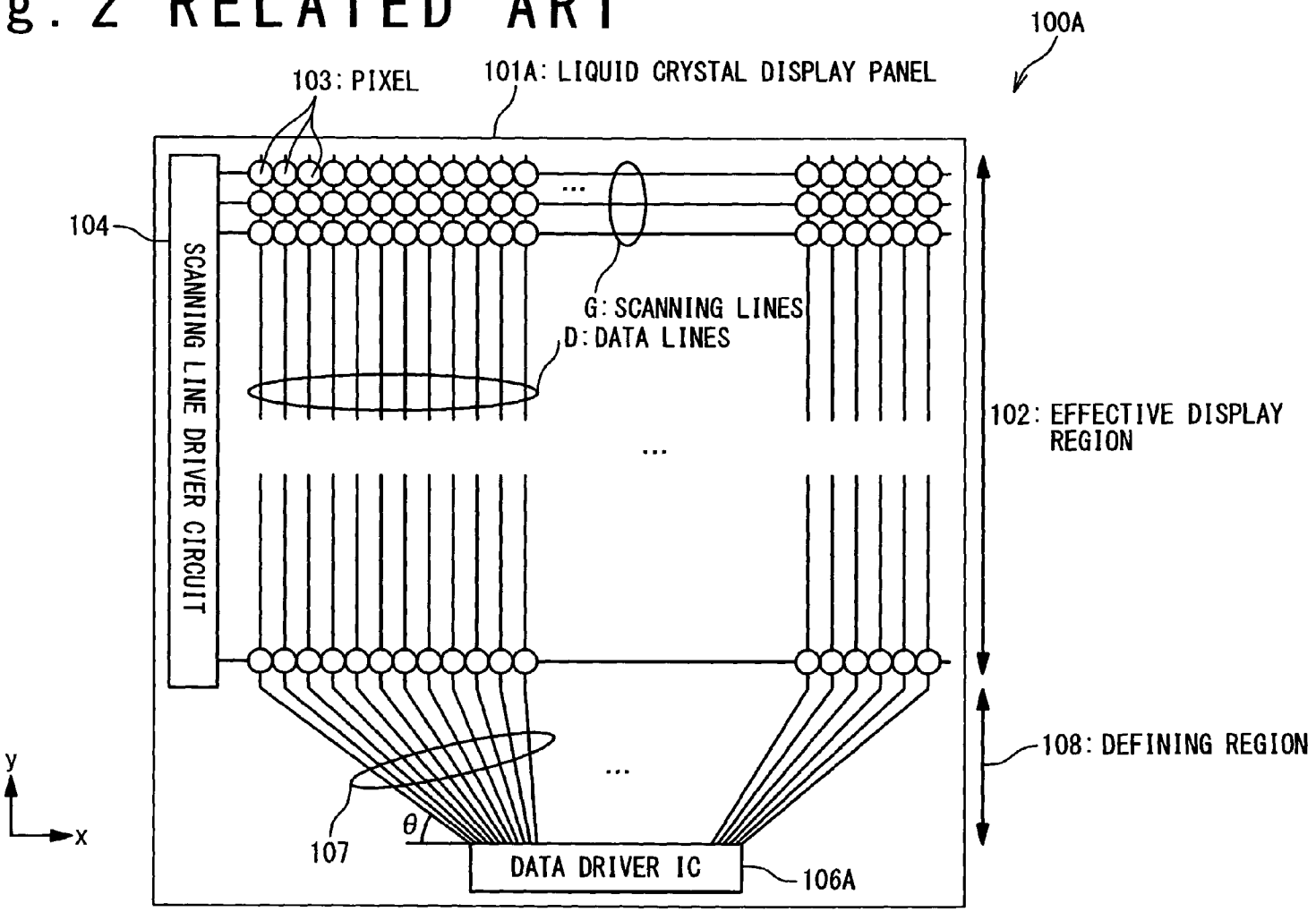
Fig. 2 RELATED ART
FIG. 2 is a diagram showing another configuration of the conventional liquid crystal display apparatus.
Figure 3:
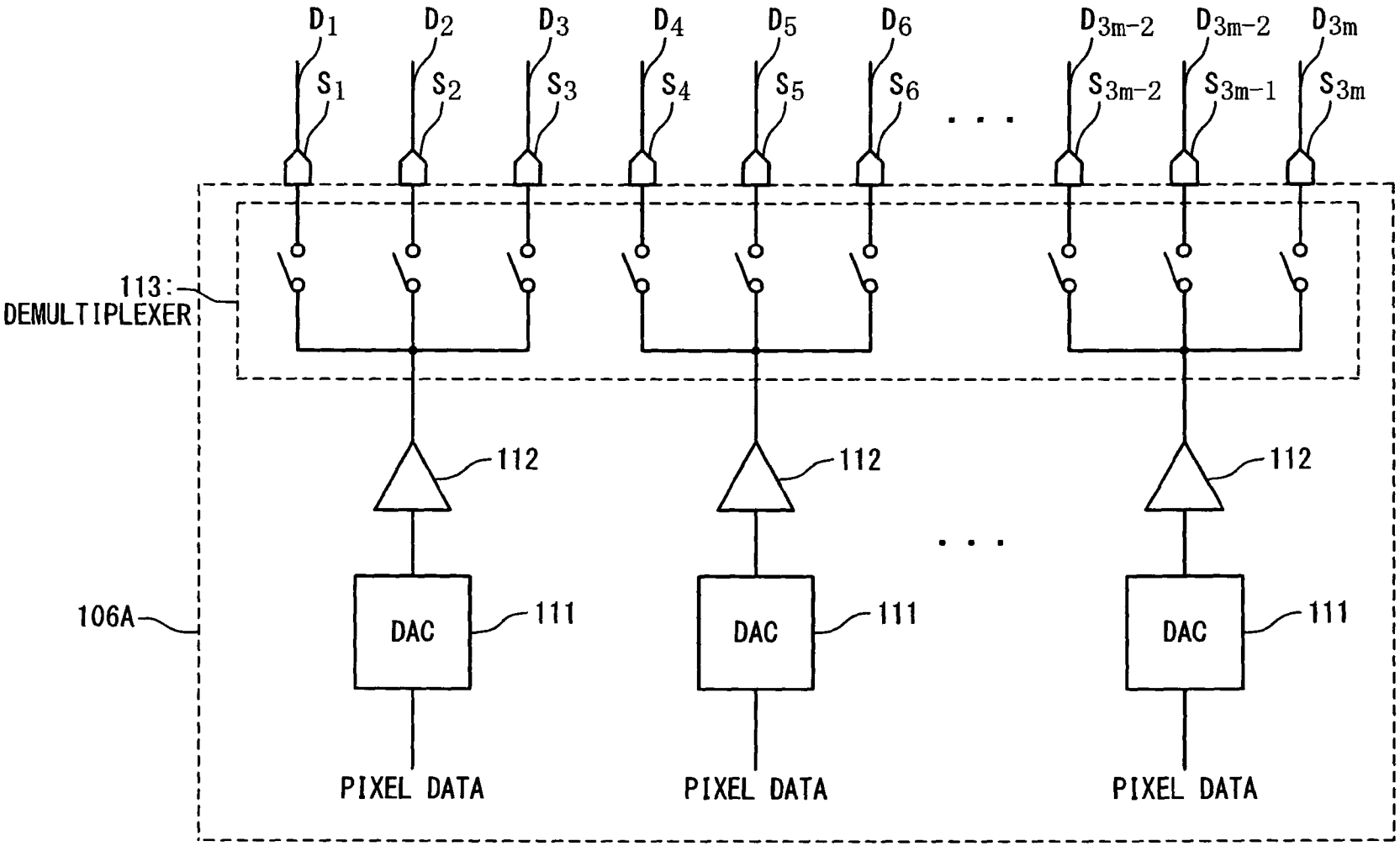
Fig. 3 RELATED ART
FIG. 3 is a block diagram showing a configuration of an output stage of a data driver in the liquid crystal display apparatus of FIG. 2.

Hereinafter, a display apparatus with a data driver of the present invention will be described in detail with reference to the attached drawings. Same components are referred by using same or similar reference numerals. Also, as necessary, the same components are identified from each other by using suffixes. However, the suffixes are omitted if the necessity of the identification is not required.

First Embodiment

Figure 4:
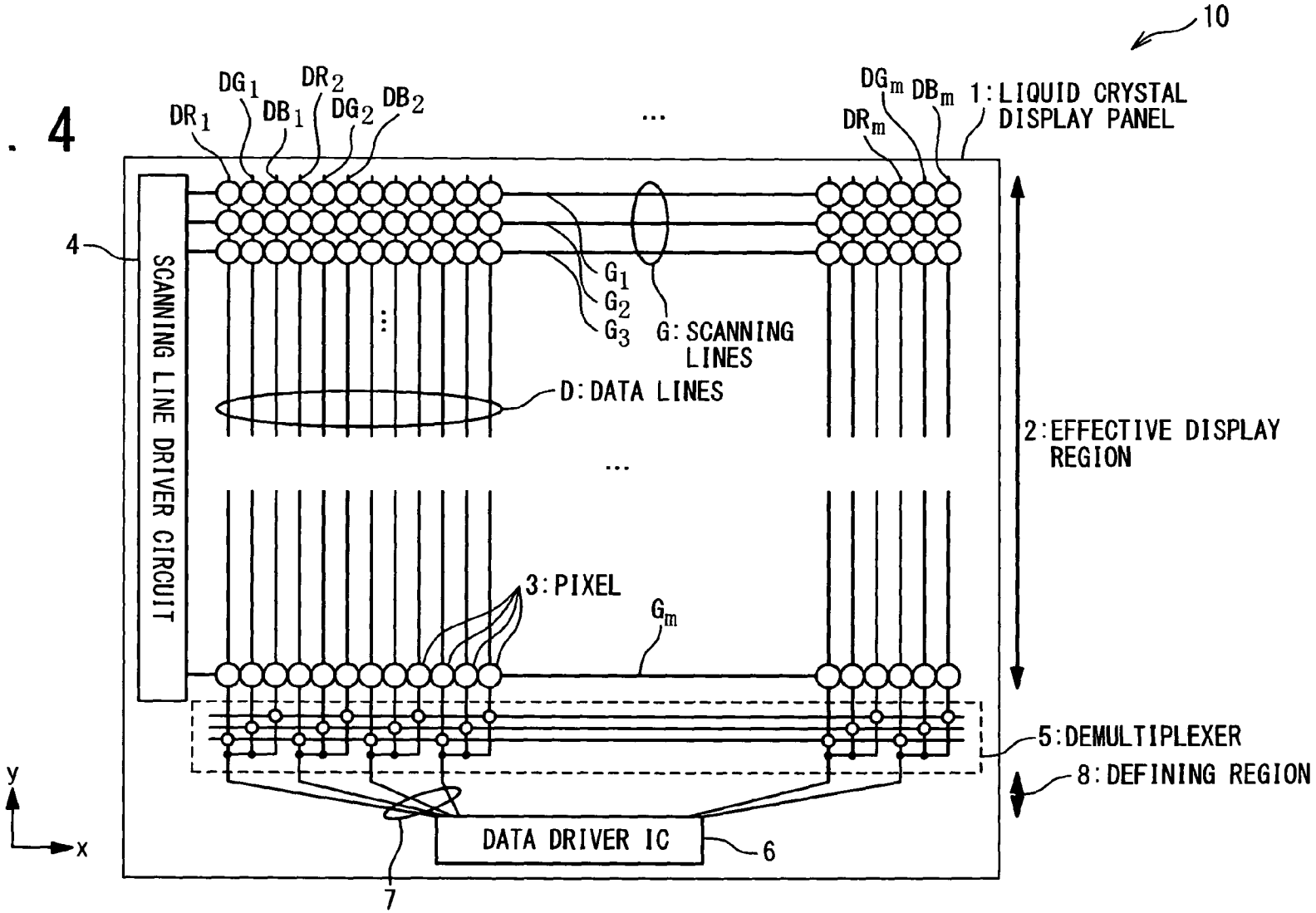
FIG. 4 is a block diagram showing a configuration of a liquid crystal display apparatus in a first embodiment of the present invention.

FIG. 4 is a diagram showing the configuration of a liquid crystal display apparatus according to a first embodiment of the present invention. A liquid crystal display apparatus 10 has a liquid crystal display panel 1. Scanning lines G, data lines D and pixels 3 are integrated in an effective display region 2 on the liquid crystal display panel 1. The pixels 3 are provided at the intersections of the scanning line G and the data line D.

Figure 5:
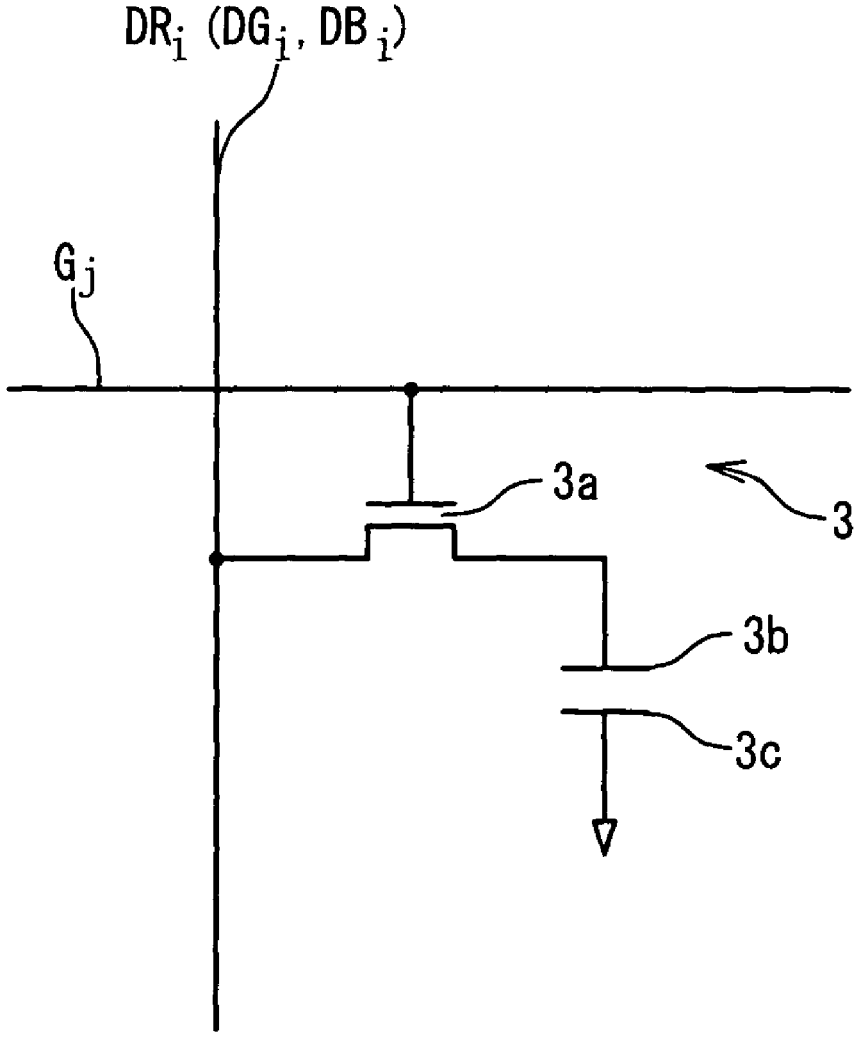
FIG. 5 is a circuit diagram showing a configuration of a pixel in the liquid crystal display apparatus of FIG. 4.

As shown in FIG. 5, each pixel 3 contains a TFT (Thin Film Transistor) 3*a* and a pixel electrode 3*b*. The drain of the TFT 3*a* is connected to any of the data lines D, the gate thereof is connected to the scanning line G, and the source thereof is connected to the pixel electrode 3*b*. The pixel electrode 3*b* is located opposite to a common electrode (opposite electrode) 3*c*, and liquid crystal is filled between the pixel electrode 3*b* and the common electrode 3*c*. When a drive voltage is applied to the pixel 3, the drive voltage is applied between the pixel electrode 3*b* and the common electrode 3*c*. Consequently, each pixel 3 indicates a desired gradation.

Referring to FIG. 4 again, the pixels 3 have the three kinds of the pixels such as a pixel to indicate a red (R), a pixel to indicate a green (G) and a pixel to indicate a blue (B). Hereinafter, there is a case that the pixel 3 to indicate the red is referred to as an R-pixel 3. Similarly, there is a case that the pixels 3 to indicate the green and the blue are referred to as a G-pixel 3 and a B-pixel 3, respectively.

The pixels 3 for displaying the same color are connected to each data line D. That is, each row of the pixels 3 is composed of the pixels that display the same color. Hereinafter, the data line D connected to the R-pixel is referred to as a data line DR. Similarly, there is a case that the data lines D connected to the G-pixel and the B-pixel are referred to as data lines DG and DB, respectively.

A scanning line driver circuit 4 and a demultiplexer 5 are integrated around the effective display region 2 on the liquid crystal display panel 1. Moreover, a data driver IC 6 is connected to the liquid crystal display panel 1 in the flip-flop manner. The scanning line driver circuit 4 is a circuit for driving scanning lines G. The demultiplexer 5 selects one data line to be driven from among the plurality of data lines D and connects the selected data line to the output node of the data driver IC 6. As described later, one of the subjects of the liquid crystal display apparatus 10 in this embodiment is to reduce the areas of the demultiplexer 5 and a throttling region 8.

Figure 6:
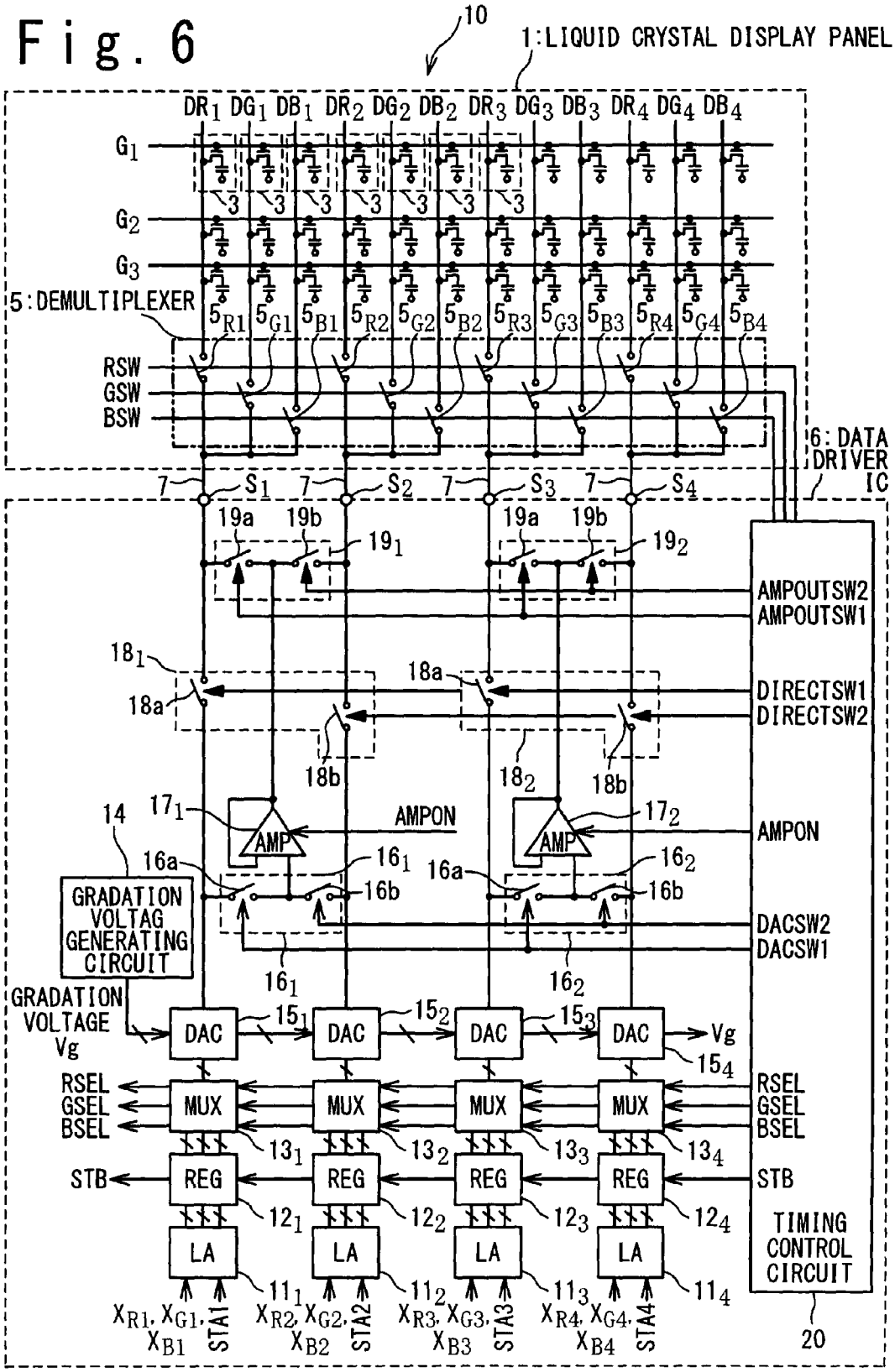
FIG. 6 is a block diagram showing the detail of the configuration of the liquid crystal display apparatus in the first embodiment.

FIG. 6 is a block diagram showing the circuit configuration of the liquid crystal display panel 1 and the data driver IC 6. FIG. 6 shows only a portion related to the output nodes $S_1$ to $S_4$ of the data driver IC 6. However, the fact that the configuration of FIG. 6 is repeatedly provided in the liquid crystal display apparatus 10 could be understood by those skilled in the art.

The demultiplexer 5 in the liquid crystal display panel 1 is composed of time divisional switches $\mathbf{5}_R$, $\mathbf{5}_G$ and $\mathbf{5}_B$ formed from the TFTs. The time divisional switch $\mathbf{5}_{Ri}$ is connected between the data line $DR_i$ and the output node $S_i$ of the data driver IC 6 and turned on or off in response to a control signal RSW sent from the data driver IC 6. Similarly, the time divisional switches $\mathbf{5}_{Gi}$ and $\mathbf{5}_{Bi}$ are connected between the data lines $DG_i$ and $DB_i$ and the output node $S_i$, respectively, and turned on or off in response to control signals GSW and BSW sent from the data driver IC 6, respectively.

The data driver IC 6 contains latches 11, registers 12, multiplexers 13, a gradation voltage generating circuit 14, D/A converters 15, multiplexers 16, output amplifiers 17, direct switches 18, demultiplexers 19 and a timing control circuit 20.

The latch $\mathbf{11}_i$ latches and stores therein pixel data $X_{Ri}$, $X_{Gi}$ and $X_{Bi}$ from an external section. Here, the pixel data $X_{Ri}$ is a data to specify the gradation of the R-pixel 3 connected to the data line $DR_i$. Similarly, the pixel data $X_{Gi}$ and $X_{Bi}$ are data to specify the gradations of the G-pixel 3 and the B-pixel 3, which are connected to the data lines $DG_i$ and $DB_i$, respectively. The latching operation of the pixel data $X_{Ri}$, $X_{Gi}$ and $X_{Bi}$ that is performed by the latch $\mathbf{11}_i$ in response to a start pulse signal $STA_i$. When the start pulse signal $STA_i$ is activated (set to a high level, in this embodiment), the latch $11_i$ latches the pixel data $X_{Ri}$, $X_{Gi}$ and $X_{Bi}$.

The register $12_i$ receives and stores therein the pixel data $X_{Ri}$, $X_{Gi}$ and $X_{Bi}$ from the latch $11_i$ in response to a common latch signal STB. The register 12 is used to hold the pixel data of the pixel 3 for one line that is driven in a current horizontal period, i.e., the pixel 3 connected to the selected scanning line G.

The multiplexer $13_i$ selects any of the pixel data $X_{Ri}$, $X_{Gi}$ and $X_{Bi}$ stored in the register $12_i$ in response to selection signals RSEL, GSEL and BSEL. In detail, when the selection signal RSEL is active, the multiplexer $13_i$ selects the pixel data $X_{Ri}$. Similarly, when the selection signals GSEL and BSEL are active, the multiplexer $13_i$ selects the pixel data $X_{Gi}$ and $X_{Bi}$, respectively. The selected pixel data is sent to the D/A converter $15_i$.

The gradation voltage generating circuit 14 supplies a gradation voltage $V_g$ corresponding to each of the gradations of the pixel 3, to each of the D/A converters 15. When each of the pixel data $X_{Ri}$, $X_{Gi}$ and $X_{Bi}$ is a k-bit data, the number of gradations that the pixel 3 can take is $2^k$. In this case, the gradation voltage $V_g$ having $2^k$ different voltage levels is supplied to the D/A converter 15.

Figure 7:
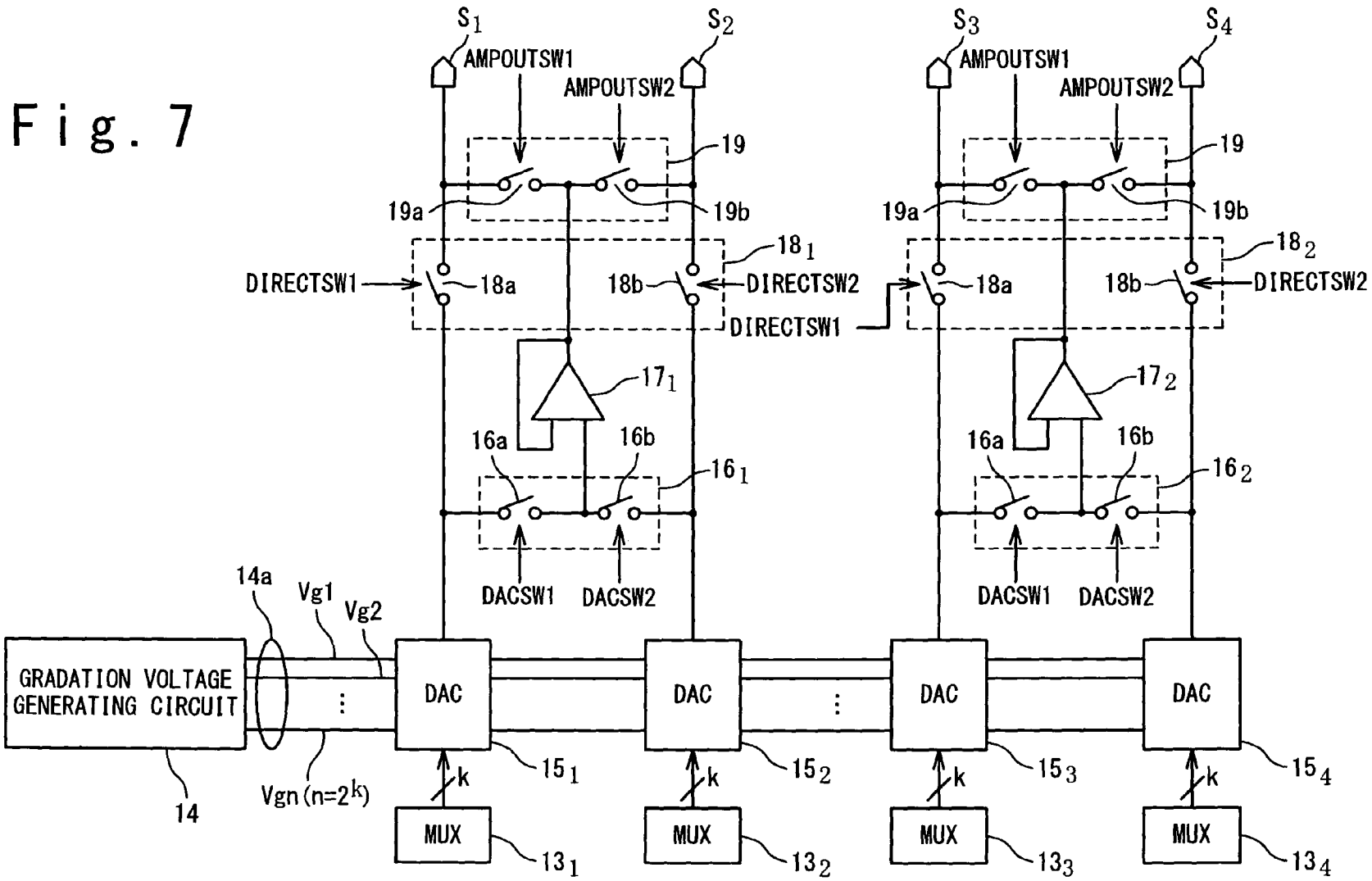
FIG. 7 is a block diagram showing the detailed configuration of a data driver in FIG. 6.

The D/A converter $15_i$ selects the gradation voltage corresponding to the pixel data sent by the multiplexer $13_i$, from the gradation voltages $V_g$ supplied by the gradation voltage generating circuit 14, and outputs the selected gradation voltage. It should be noted that the D/A converter 15 itself does not have the driving performance. With reference to FIG. 7, N gradation voltage lines 14*a*, through which the gradation voltages $V_g$1 to VgN are supplied by the gradation voltage generating circuit 14, are connected to the D/A converter 15. The D/A converter $15_i$ functions as a selector for connecting one of the N gradation voltage lines 14*a* to its output in response to the pixel data sent by the multiplexer $13_i$.

Referring to FIG. 6 again, the output amplifier 17 generates the drive voltage for driving the data line D. The voltage level of the drive voltage generated by the output amplifier 17 is the voltage level equal to the gradation voltage supplied by the D/A converter $15_i$. The drive voltage is outputted through the output node S to the liquid crystal display panel 1 and supplied to the data line D selected by the demultiplexer 5. A control signal AMPON is sent to the output amplifier 17. When the control signal AMPON is active, the output amplifier 17 operates. It should be noted that one output amplifier 17 is provided for every two output nodes S. In this embodiment, one output node S is provided for the 3 data lines D. As a result, one output amplifier 17 is used to drive the 6 data lines D. Specifically, the output amplifier $17_1$ is used to drive the data lines $DR_1$, $DG_1$ and $DB_1$ connected to the output node $S_1$ and the data lines $DR_2$, $DG_2$ and $DB_2$ connected to the output node $S_2$, and the output amplifier $17_2$ is used to drive the data lines $DR_3$, $DG_3$ and $DB_3$ connected to the output node $S_3$ and the data lines $DR_4$, $DG_4$ and $DB_4$ connected to the output node $S_4$.

The multiplexer 16 has a function for switching the connection between the D/A converter 15 and the output amplifier 17 in response to control signals DACSW1, DACSW2. In detail, the multiplexers $16_1$, $16_2$ have switches 16*a* that are turned on or off in response to the control signal DACSW1; and switches 16*b* that are turned on or off in response to the control signal DACSW2. When the control signal DACSW1 is activated (set to the high level in this embodiment), the switches 16*a* of the multiplexers $16_1$ and $16_2$ are turned on, and the outputs of the D/A converters $15_1$ and $15_3$ are electrically connected to the inputs of the output amplifiers $17_1$ and $17_2$, respectively. On the other hand, when the control signal DACSW2 is activated, the switches 16*b* of the multiplexers $16_1$ and $16_2$ are turned off, and the outputs of the D/A converters $15_2$ and $15_4$ are electrically connected to the inputs of the output amplifiers $17_1$, $17_2$, respectively.

The demultiplexer 19 has a function for switching the connection between the output amplifier 17 and the output node S in response to control signals AMPOUTSW1 and AMPOUTSW2. In detail, the demultiplexers $19_1$ and $19_2$ contain switches 19*a* that are turned on or off in response to the control signal AMPOUTSW1; and switches 19*b* that are turned on or off in response to the control signal AMPOUTSW2. When the control signal AMPOUTSW1 is activated (set to the high level in this embodiment), the switches 19*a* of the demultiplexers $19_1$ and $19_2$ are turned on, and the outputs of the output amplifiers $17_1$ and $17_2$ are electrically connected to the output nodes $S_1$, $S_3$, respectively. On the other hand, when the control signal AMPOUTSW2 is activated, the switches 19*b* of the demultiplexers $19_1$ and $19_2$ are turned on, and the outputs of the output amplifiers $17_1$ and $17_2$ are electrically connected to the output nodes $S_2$, $S_4$, respectively.

The direct switch 18 has a function for switching the connection between the D/A converter 15 and the output node S in response to control signals DIRECTSW1 and DIRECTSW2. In the liquid crystal display apparatus in this embodiment, it should be noted that the D/A converter 15 and the output node S can be directly connected through the direct switches 18 (without any intervention of the output amplifier 17). In detail, the direct switches $18_1$ and $18_2$ contain switches 18*a* that are turned on or off in response to the control signal DIRECTSW1; and switches 18*b* that are turned on or off in response to the control signal DIRECTSW2. When the control signal DIRECTSW1 is activated (set to the High level in this embodiment), the switches 18*a* of the direct switches $18_1$ and $18_2$ are turned on, and the outputs of the D/A converters $15_1$ and $15_3$ are connected to the output nodes $S_1$ and $S_3$, respectively. On the other hand, when the control signal DIRECTSW2 is activated, the switches 18*b* of the direct switches $18_1$ and $18_2$ are turned on, and the outputs of the D/A converters $15_2$ and $15_4$ are connected to the output nodes $S_2$ and $S_4$, respectively.

The timing control circuit 20 generates various control signals and controls the operation timings of the demultiplexer 5 integrated in the liquid crystal display panel 1 and the circuit group integrated in the data driver IC 6. The control signals RSW, GSW, BSW, AMPOUTSW1, AMPOUTSW2, DIRECTSW1, DIRECTSW2, AMPON, DACSW1, DACSW2, RSEL, GSEL, BSEL and STB are generated by the timing control circuit 20. Typically, the operation voltages of elements formed on the liquid crystal display panel 1 are higher than the operation voltage of the data driver IC 6. Thus, the control signals sent to the liquid crystal display panel 1 are supplied to the liquid crystal display panel 1 through a level shifter circuit (not shown) corresponding to a high voltage.

One of the features of the liquid crystal display apparatus 10 in this embodiment lies in a mechanism that the data line D to be driven is selected by the demultiplexers of the two stages, namely, the demultiplexer 5 integrated in the liquid crystal display panel 1 and the demultiplexer 19 integrated in the data driver IC 6. According to such configuration, the total height of the demultiplexer 5 and the throttling region 8 (the dimension in the y-axis direction) can be set low, and a portion of a region other than the effective display region 2 in the liquid crystal display panel 1 can be reduced.

With reference to FIG. 4 again, in the liquid crystal display apparatus 10 in this embodiment, since the demultiplexer 5 is integrated in the liquid crystal display panel 1, the number of output nodes S of the data driver IC 6 can be reduced. In the configuration in which the demultiplexer is integrated only in the data driver IC, it should be noted that the number of output nodes S of the data driver IC 6 is equal to the number of data lines D. Consequently, the number of wirings 7 to connect the output nodes S and the demultiplexer 5 can be reduced, thereby making the height of the throttling region 8 lower.

On the other hand, the liquid crystal display apparatus 10 in this embodiment uses the demultiplexer 19 integrated in the data driver IC 6, in addition to the demultiplexer 5 integrated in the liquid crystal display panel 1, in order to select the data line D. Thus, the number of control signals sent to the demultiplexer 5 can be reduced. Specifically, in the liquid crystal display apparatus 10 in this embodiment, although the 6 data lines D are driven by the single output amplifier 17, only the 3 control signals are sent to the demultiplexer 5. This is effective for reducing a region of the demultiplexer 5 provided in the liquid crystal display panel 1.

As a result, in the liquid crystal display apparatus 10 in this embodiment, a total height of the demultiplexer 5 and the throttling region 8 can be made low, as compared with the configuration in which the demultiplexer to select the data line is only on the display panel, and the configuration in which the switch to select the data line is integrated only in the data driver IC. Thus, it is possible to reduce a portion other than the effective display region 2 in the liquid crystal display panel 1.

The configuration in which the demultiplexer 19 is integrated in the data driver IC 6 is also effective for reducing the power consumed in the demultiplexer 5 in the liquid crystal display panel 1. In the configuration in which the demultiplexer for selecting the data line D is integrated only in the liquid crystal display panel 1, it is necessary to increase the number of control signal lines to send the control signal for controlling the demultiplexer. Since the control signal line extends to intersect the liquid crystal display panel 1, the capacitance is large. In addition, the control signal line is required to be driven in the high voltage in order to drive the time divisional switches $\mathbf{5}_R$, $\mathbf{5}_G$ and $\mathbf{5}_B$ formed from the TFTs of the demultiplexer 5. Thus, much power is required in order to drive the many control signal lines.

For example, there are considered the configuration in which the demultiplexer 105 for selecting the 6 data lines D is integrated in the liquid crystal display panel 1 shown in FIG. 1 and the configuration of the liquid crystal display apparatus 10 in this embodiment in FIG. 6. In the configuration of FIG. 1, the 6 control signal lines are laid, and the 6 control signal lines are activated at a time in one horizontal period. Thus, a power $P_1$ required to operate the demultiplexer 105 in the one horizontal period is represented by:

$$P_1=(6C_{line}+M\cdot C_{SW})V^2\cdot f \tag{1a}$$

Here, $C_{line}$ indicates a wiring capacitance of each of the control signal lines, $C_{SW}$ indicates the gate capacitance of each switch 10*a*, M indicates the number of switches 105*a*, namely, the number of data lines D, V indicates the voltage to drive the switches 105*a*, and f indicates the number of signal changes in the control signal line in the one horizontal period. On the other hand, in the configuration of the liquid crystal display apparatus 10 in this embodiment shown in FIG. 6, a power $P_2$ required to operate the demultiplexer 5 in the one horizontal period is represented by:

$$P_2=(3C_{line}+M\cdot C_{SW})V^2\cdot f \tag{1b}$$

This is smaller than the power $P_1$ consumed in the demultiplexer 105 in FIG. 1.

In the configuration in this embodiment in which the demultiplexer 19 is integrated in the data driver IC 6, although the power is consumed even in the demultiplexer 19, the increase in the power consumed by the demultiplexer 19 is relatively small. This first factor lies in the fact that the operation voltage of the data driver IC is lower than the operation voltage of the element in the liquid crystal display panel. The signal level of the control signal of the demultiplexer in the data driver IC is about 5 V. On the other hand, the signal level of the control signal of the demultiplexer in the liquid crystal display panel is 15 V or more. As represented by the equations (1a) and (1b), the power consumed in the demultiplexer is proportional to the square of the voltage. Thus, the power consumed in the operation of the demultiplexer in the data driver IC whose operation voltage is low is relatively smaller than the power consumed in the operation of the demultiplexer in the liquid crystal display panel. The second factor lies in the fact that with regard to the capacitances of the respective switch elements of the demultiplexer, the demultiplexer integrated in the data driver IC is smaller than the demultiplexer integrated in the liquid crystal display panel. As represented by the equations (1a) and (1b), if the capacitances of the switches of the demultiplexer are small, the consumed power can be also decreased. When the demultiplexer is provided not only in the liquid crystal display panel 1 but also in the data driver IC 6 and then the time divisional driving method is performed, the power consumed in the operation of the demultiplexer can entirely reduced.

With reference to FIG. 6, another of the features of the liquid crystal display apparatus 10 in this embodiment lies in the fact that each data line D is directly connected to the D/A converter 15 by the direct switch 18 after being driven by the output amplifier 17. According to the operation, the influence of the offset of the output amplifier 17 can be suppressed. Since the output amplifier 17 typically has the offset, the drive voltage supplied to the data line D from the output amplifier 17 has a certain difference from the gradation voltage selected in accordance with the pixel data. There is a case that the value of the offset is different for each output amplifier 17. Thus, the offset of the output amplifier 17 may cause irregularity along the direction of the data line D to be generated on a displaying screen. In the liquid crystal display apparatus 10 in this embodiment, in order to suppress the influence of the offset of the output amplifier 17, each data line D is directly connected to the D/A converter 15 by the direct switch 18, after being driven by the output amplifier 17. Therefore, the offset generated by the output amplifier 17 is removed, and the voltage level of the data line D is returned to the originally-targeted voltage level. Then, the voltage level of the data line D can be made coincident with the gradation voltage selected in accordance with the pixel data.

The operation of the liquid crystal display apparatus 10 in this embodiment will be described below in detail.

Figure 8:
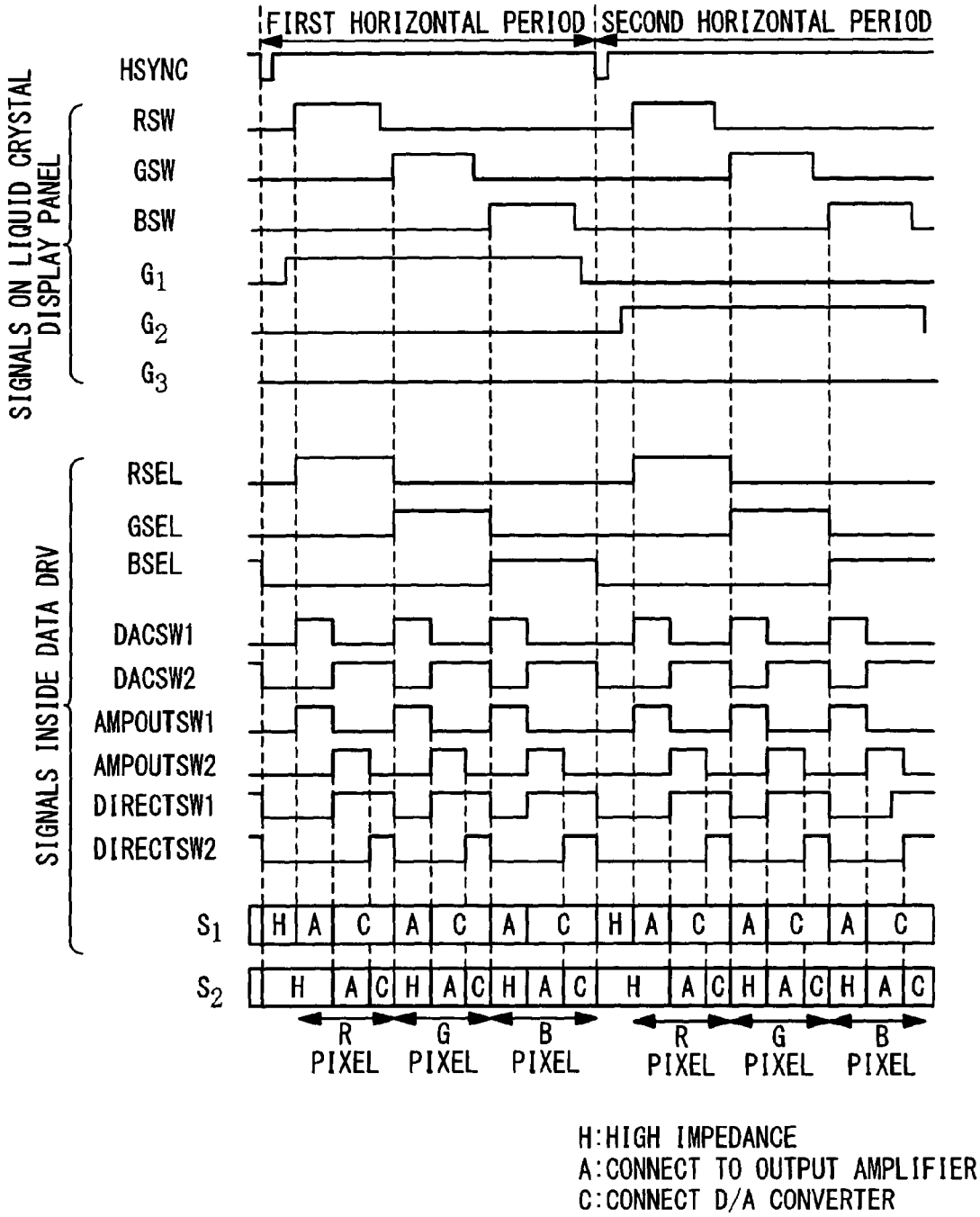
FIG. 8 is timing charts showing the operation of the liquid crystal display apparatus in the first embodiment.

FIG. 8 is timing charts showing the operation of the liquid crystal display apparatus 10 in this embodiment in the first and second horizontal periods. Here, an i-th horizontal period implies the period in which the pixels 3 connected to the scanning line $G_i$ are driven. In this embodiment, it should be noted that since a horizontal synchronization signal HSYNC is activated (in this embodiment, since the horizontal synchronization signal HSYNC is pulled down to a low level), each horizontal period is defined to be started. Hereinafter, the driving of the pixels 3 corresponding to the output nodes $S_1$ and $S_2$, namely, the pixels 3 connected to the data lines $DR_1$, $DG_1$, $DB_1$, $DR_2$, $DG_2$ and $DB_2$ will be described. However, the fact that the pixel 3 corresponding to another output node S is similarly driven could be understood by those skilled in the art.

Immediately after the first horizontal period is started, both of the output nodes $S_1$ and $S_2$ are set to a high impedance state. That is, the control signals DACSW1, DACSW2, AMPOUTSW1, AMPOUTSW2, DIRECTSW1 and DIRECTSW2 are deactivated, and the output nodes $S_1$ and $S_2$ are electrically disconnected from all of the output amplifier 17, and the D/A converters $\mathbf{15}_1$ and $\mathbf{15}_2$. In the attached drawings, it should be noted that the situation in which the output node S is set to the high impedance state is indicated by a symbol [H].

The driving of the pixels 3 connected to the scanning line $G_1$ is started together with the activation of the scanning line $G_1$. When the scanning line $G_1$ is activated, the pixel 3*b* in the pixels 3 connected to the scanning line $G_1$ is electrically connected to the corresponding data line D.

In succession, the R-pixels 3 connected to the scanning line $G_1$ and the data lines $DR_1$ and $DR_2$ are driven. Specifically, the control signal RSEL is activated. Consequently, the pixel data $X_{R1}$ and $X_{R2}$ are sent from the multiplexers $\mathbf{13}_1$ and $\mathbf{13}_2$ to the D/A converter $\mathbf{15}_1$ and $\mathbf{15}_2$, respectively. It should be noted that the pixel data $X_{R1}$ and $X_{R2}$ are related to the R-pixels 3 connected to the data lines $DR_1$ and $DR_2$, respectively. Moreover, the control signal RSW is activated, and the data lines $DR_1$ and $DR_2$ are connected to the output nodes S1 and S2, respectively.

Among the R-pixels 3, the R-pixel 3 connected to the data line $DR_1$ is firstly driven. In detail, at first, the control signals DACSW1 and AMPOUTSW1 are activated. With the activation of the control signals DACSW1 and AMPOUTSW1, the output of the D/A converter $\mathbf{15}_1$ is connected to the input of the output amplifier $\mathbf{17}_1$, and the output of the output amplifier 17, is further connected to the output node $S_1$. In the attached drawings, it should be noted that the connection of the output node S to the output amplifier 17 is represented by a symbol [A]. As a result, the data line $DR_1$ is connected to the output amplifier 17, through the time divisional switch $\mathbf{5}_{R1}$ of the demultiplexer 5 and the switch 19*a* of the demultiplexer $\mathbf{19}_1$, and the drive voltage corresponding to the pixel data $X_{R1}$ is supplied to the data line $DR_1$. The supplied drive voltage is written to the R-pixel 3 connected to the data line $DR_1$.

In succession, the R-pixel 3 connected to the data line $DR_2$ is firstly driven. In detail, the control signals DACSW1 and AMPOUTSW1 are deactivated. Instead of them, the control signals DACSW2 and AMPOUTSW2 are activated. With the activation of the control signals DACSW2 and AMPOUTSW2, the output of the D/A converter $\mathbf{15}_2$ is connected to the input of the output amplifier $\mathbf{17}_1$, and the output of the output amplifier $\mathbf{17}_1$ is further connected to the output node $S_2$. Thus, the data line $DR_2$ is connected to the output amplifier $\mathbf{17}_1$ through the time divisional switch $\mathbf{5}_{R2}$ and the switch 19*b* of the demultiplexer $\mathbf{19}_1$, and the drive voltage corresponding to the pixel data $X_{R2}$ is supplied to the data line $DR_2$. The supplied drive voltage is written to the R-pixel 3 connected to the data line $DR_2$.

While the R-pixel 3 connected to the data line $DR_2$ is driven, the data line $DR_1$ is electrically connected to the output of the D/A converter $\mathbf{15}_1$. In detail, the control signal DIRECTSW1 is activated, and the output node $S_1$ is directly connected through the switch 18*a* of the direct switch 18 to the output of the D/A converter $\mathbf{15}_1$. In the attached drawing, it should be noted that the connection of the output node S to the D/A converter 15 is indicated by a symbol [C]. Consequently, the voltage level of the data line $DR_1$ is kept at a desirable gradation voltage generated by the gradation voltage generating circuit 14. As mentioned above, a mechanism that the data line $DR_1$ is electrically connected to the output of the D/A converter $\mathbf{15}_1$ provides the effect of suppressing the influence of the offset of the output amplifier $\mathbf{17}_1$.

After the driving of the R-pixel 3 connected to the data line $DR_2$ has been completed by the output amplifier $\mathbf{17}_1$, the data line $DR_2$ is disconnected from the output of the output amplifier $\mathbf{17}_1$ and electrically connected to the output of the D/A converter $\mathbf{15}_2$. Meanwhile, the data line $DR_1$ continues to be electrically connected to the output of the D/A converter $\mathbf{15}_1$. In detail, the control signal DIRECTSW1 continues to be active. In addition, the control signal DIRECTSW2 is newly activated. Thus, the output nodes $S_1$ and $S_2$ are directly connected through the switches 18*a* and 18*b* of the direct switch 18 to the outputs of the D/A converter $\mathbf{15}_1$ and $\mathbf{15}_2$, respectively.

From the viewpoint of the driving of the R-pixel 3 connected to the data line $DR_2$, after the driving of the R-pixel 3 connected to the data line $DR_2$ has been completed by the output amplifier $\mathbf{17}_1$, the data line $DR_2$ is not required to be electrically connected to the output of the D/A converter $\mathbf{15}_2$. However, after the completion of the driving performed by the output amplifier $\mathbf{17}_1$, a mechanism for electrical connecting the data line $DR_2$ to the output of the D/A converter $\mathbf{15}_2$ is preferable in view of suppressing the influence of the offset of the output amplifier $\mathbf{17}_1$.

In succession, the G-pixels 3 connected to the scanning line $G_1$ and the data lines $DG_1$ and $DG_2$ are driven. This driving of the G-pixel 3 is performed in accordance with a procedure similar to that of the driving of the R-pixel 3. At first, the control signal GSW is activated, and the data lines $DG_1$ and $DG_2$ are connected to the output nodes $S_1$ and $S_2$, respectively. In addition, the control signal GSEL is activated. Consequently, the pixel data $X_{G1}$ and $X_{G2}$ are sent to the D/A converters $\mathbf{15}_1$ and $\mathbf{15}_2$, respectively. Moreover, the control signals DACSW1 and AMPOUTSW1 are activated, and the data line $DG_1$ is electrically connected to the output of the output amplifier $\mathbf{17}_1$. Thus, the G-pixel 3 connected to the data line $DG_1$ is driven by the output amplifier $\mathbf{17}_1$. In succession, the control signals DACSW2 and AMPOUTSW2 are activated, instead of the control signals DACSW1 and AMPOUTSW1, and the data line $DG_2$ is electrically connected to the output of the output amplifier $\mathbf{17}_2$. Thus, the G-pixel 3 connected to the data line $DG_2$ is driven by the output amplifier $\mathbf{17}_1$. While the G-pixel 3 connected to the data line $DG_2$ is driven by the output amplifier $\mathbf{17}_1$, the data line $DG_1$ is directly connected to the output of the D/A converter $\mathbf{15}_1$. Therefore, the voltage level of the data line $DG_1$ is kept at a desirable gradation voltage. Finally, the data line $DG_2$ is directly connected to the output of the D/A converter $\mathbf{15}_2$. As mentioned above, the driving of the two G-pixels 3 connected to the data lines $DG_1$ and $DG_2$ are completed.

Further in succession, the B-pixels 3 connected to the scanning line $G_1$ and the data lines $DB_1$ and $DB_2$ are driven. This driving of the B-pixel 3 is performed in accordance with a procedure similar to that of the driving of the R-pixel 3. The control signal BSW is activated, and the data lines $DB_1$ and $DB_2$ are connected to the output nodes $S_1$ and $S_2$, respectively. In addition, the control signal BSEL is activated. Consequently, the pixel data $X_{B1}$ and $X_{B2}$ are sent to the D/A converters $\mathbf{15}_1$ and $\mathbf{15}_2$, respectively. Moreover, the control signals DACSW1 and AMPOUTSW1 are activated, and the data line $DB_1$ is electrically connected to the output of the output amplifier $\mathbf{17}_1$. Thus, the B-pixel 3 connected to the data line $DB_1$ is driven by the output amplifier $\mathbf{17}_1$. In succession, the control signals DACSW2 and AMPOUTSW2 are activated, instead of the control signals DACSW1 and AMPOUTSW1, and the data line $DB_2$ is electrically connected to the output of the output amplifier $17_2$. Thus, the B-pixel 3 connected to the data line $DB_2$ is driven by the output amplifier $17_1$. While the B-pixel 3 connected to the data line $DB_2$ is driven by the output amplifier $17_1$, the data line $DB_1$ is directly connected to the output of the D/A converter $15_1$. Therefore, the voltage level of the data line $DB_1$ is kept at a desirable gradation voltage. Finally, the data line $DB_2$ is directly connected to the output of the D/A converter $15_2$. As mentioned above, the driving of the two B-pixels 3 connected to the data lines $DB_1$ and $DB_2$ are completed.

The pixel 3 is also driven in accordance with a similar procedure after the second horizontal period, except that the scanning line to be activated is switched. In the j-th horizontal period, the scanning line $G_j$ is activated, and the pixel 3 connected to the scanning line $G_j$ is driven in the time divisional manner.

Figure 9A:
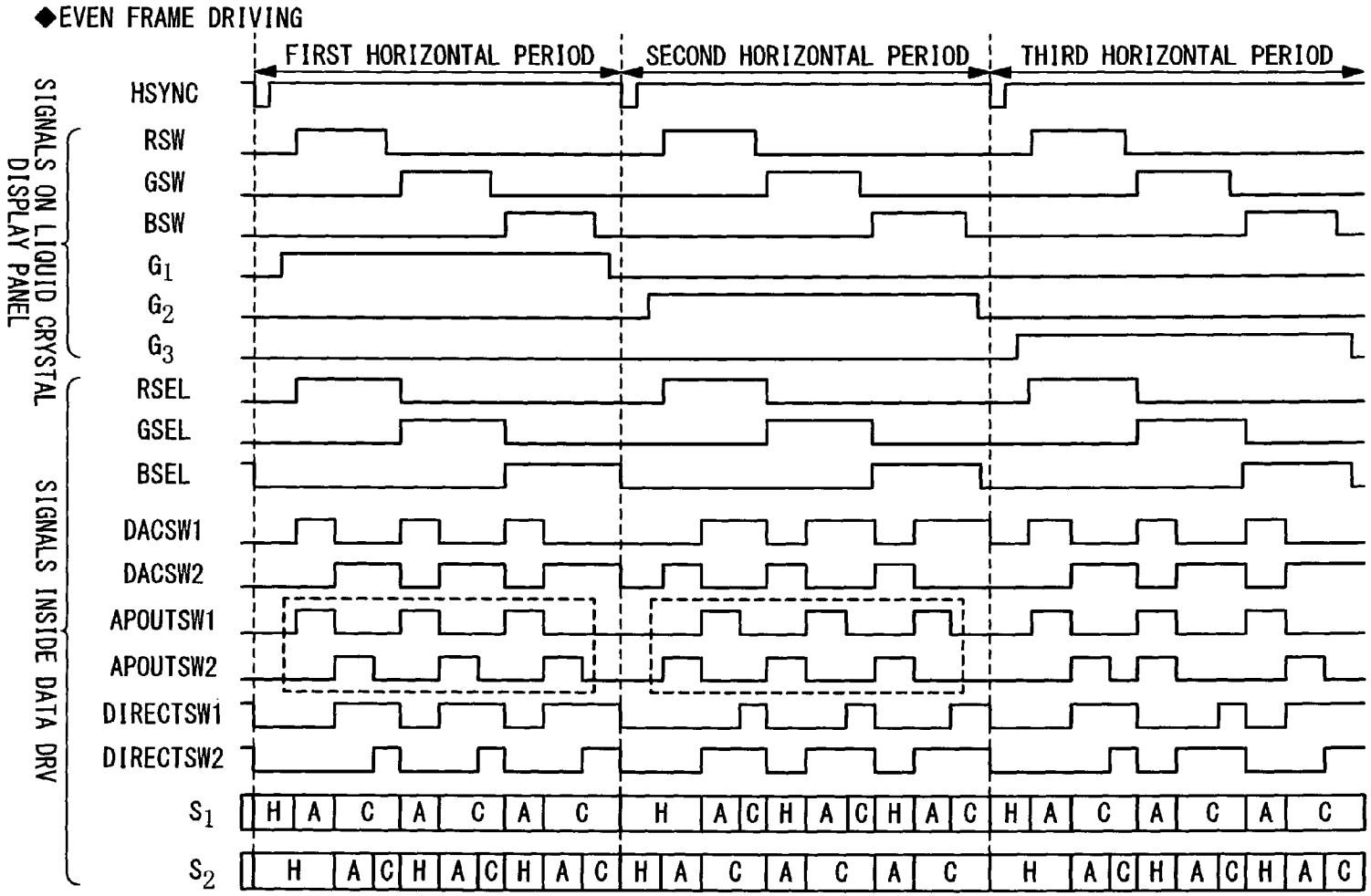
FIG. 9A is timing charts showing the preferable operation of the liquid crystal display apparatus in the first embodiment.

As shown in FIG. 9A, the order in which the output nodes $S_1$ and $S_2$ are connected to the output amplifier $17_1$ is preferred to be switched for each horizontal period. According to the foregoing operation, the time while the drive voltage is written to the pixels of the same color is uniformed to the time average, and the generation of flicker can be suppressed. This is desirable in improving the image quality.

In an example of FIG. 9A, in the driving of the R-pixel 3 in the first horizontal period, the control signal AMPOUTSW1 is firstly activated, and the control signal AMPOUTSW2 is then activated. As a result, after the output node $S_1$ is connected to the output amplifier $17_1$, instead of the output node $S_1$, the output node $S_2$ is connected to the output amplifier $17_1$. On the other hand, in the driving of the R-pixel 3 in the second horizontal period, the control signal AMPOUTSW2 is firstly activated, and the control signal AMPOUTSW1 is then activated. As a result, after the output node $S_2$ is connected to the output amplifier $17_1$, instead of the output node S2' the output node $S_1$ is connected to the output amplifier $17_1$. Similarly, in the driving of the G-pixel 3 and the B-pixel 3, the order at which the control signals AMPOUTSW1 and AMPOUTSW2 are activated is switched between the first and second horizontal periods. Similarly, in the subsequent horizontal period, the order in which the control signals AMPOUTSW1 and AMPOUTSW2 are activated is changed for each horizontal period. According to the foregoing operation, the time while the drive voltage is written to the pixels of the same color is uniformed to the time average, and the generation of the flicker can be suppressed.

Figure 9B:
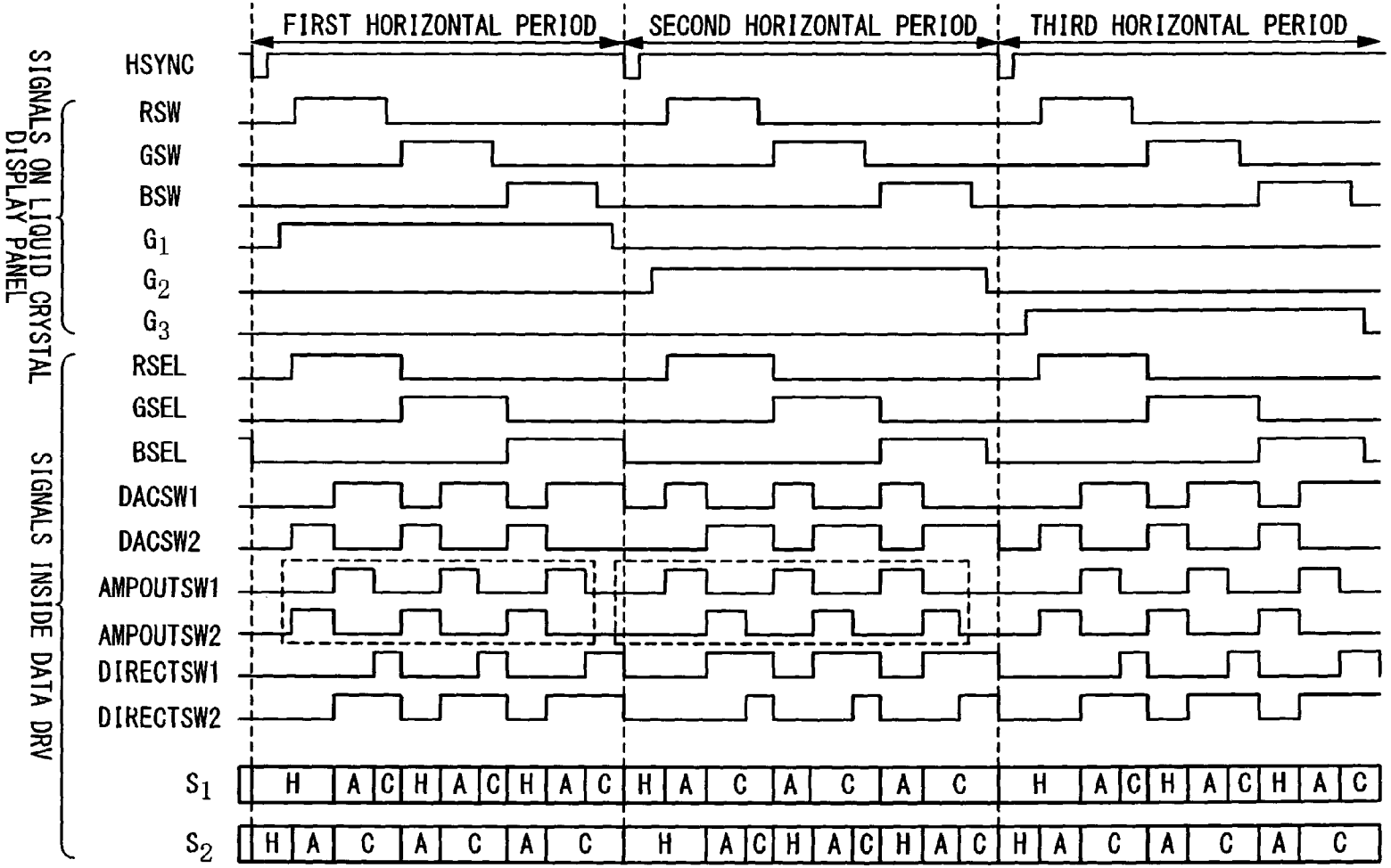
FIG. 9B is timing charts showing the preferable operation of the liquid crystal display apparatus in the first embodiment.

With the similar reason, the order in which the output nodes $S_1$ and $S_2$ are connected to the output amplifier $17_1$ is preferred to be switched for each frame period. In the first embodiment, when the liquid crystal display apparatus 10 operates in the odd-numbered frame period as shown in FIG. 9A, the liquid crystal display apparatus 10 operates as shown in FIG. 9B in the even-numbered frame period. In the example shown in FIGS. 9A and 9B, when the R-pixels 3 in the first horizontal period in the odd-numbered frame period are driven, as shown in FIG. 9A, the control signal AMPOUTSW1 is firstly activated, and the control signal AMPOUTSW2 is then activated. As this result, after the output node $S_1$ is connected to the output amplifier $17_1$, instead of the output node $S_1$, the output node $S_2$ is connected to the output amplifier $17_1$. On the other hand, when the R-pixels 3 in the first horizontal period in the even-numbered frame period are driven, the control signal AMPOUTSW2 is firstly activated, and the control signal AMPOUTSW1 is then activated. As this result, after the output node $S_2$ is connected to the output amplifier $17_1$, instead of the output node $S_2$ the output node $S_1$ is connected to the output amplifier $17_1$. Similarly in the driving of the G-pixel 3 and the B-pixel 3, the order in which the control signals AMPOUTSW1 and AMPOUTSW2 are activated is switched between the odd-numbered frame period and the even-numbered frame period. Similarly, in the other horizontal periods, the order in which the control signals AMPOUTSW1 and AMPOUTSW2 are activated is switched between the odd-numbered frame period and the even-numbered frame period. According to the foregoing operation, the time while the drive voltage is written to the pixels of the same color is uniformed to the time average, and the generation of the flicker can be suppressed. This is desirable in order to improve the image quality.

Figure 9C:
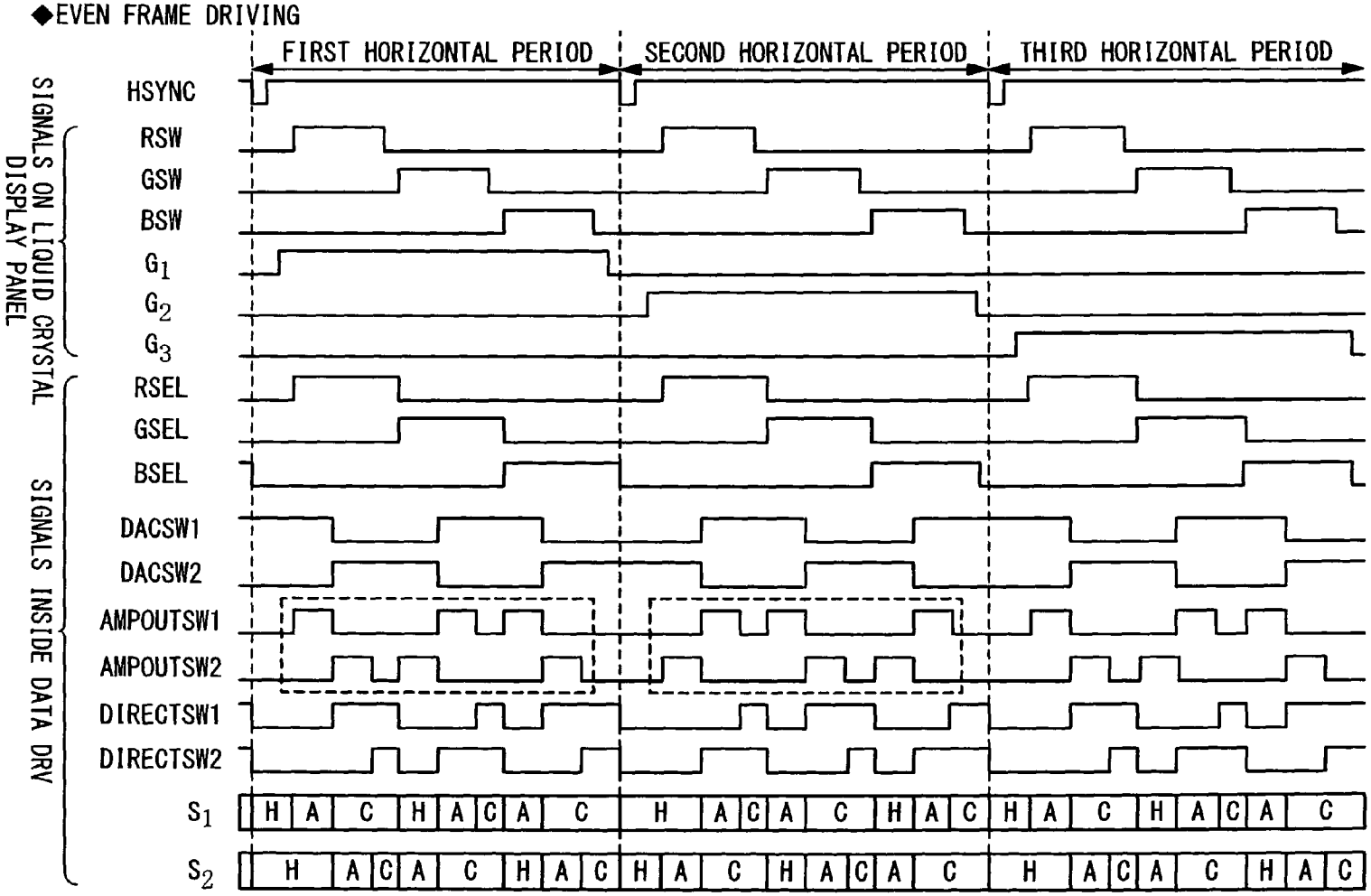
FIG. 9C is timing charts showing the preferable operation of the liquid crystal display apparatus in the first embodiment.

Also, as shown in FIG. 9C, the order in which the output nodes $S_1$ and $S_2$ are connected to the output amplifier $17_1$ is preferred to be changed for each completion of the output of the drive voltage from the output amplifier $17_1$ through the output nodes $S_1$ and $S_2$. According to the foregoing operation, it is possible to reduce the switching numbers of the control signals DACSW1 and DACSW2 for controlling the connection between the D/A converters $15_1$ and $15_2$ and the input of the output amplifier $17_1$.

In an example of FIG. 9C, when the R-pixel 3 is driven, the control signal AMPOUTSW1 is firstly activated, and the control signal AMPOUTSW2 is then activated. As this result, after the output node $S_1$ is connected to the output amplifier $17_1$, instead of the output node $S_1$, the output node $S_2$ is connected to the output amplifier $17_1$. In the foregoing operation, after the R-pixel 3 connected to the data line $DR_1$ is driven, the R-pixel 3 connected to the data line $DR_2$ is driven. In succession, when the G-pixel 3 is driven, the control signal AMPOUTSW2 is firstly driven, and the control signal AMPOUTSW1 is then activated. As this result, after the output node $S_2$ is connected to the output amplifier $17_1$, instead of the output node $S_2$, the output node $S_1$ is connected to the output amplifier $17_1$. That is, after the G-pixel 3 connected to the data line $DG_2$ is driven, the G-pixel 3 connected to the data line $DG_1$ is driven. In succession, when the B-pixel 3 is driven, similarly to the driving of the R-pixel 3, the control signal AMPOUTSW1 is firstly activated, and the control signal AMPOUTSW2 is then activated.

In the operation of FIG. 9C, when the R-pixel 3 connected to the data line $DR_2$ is driven, after the activation of the control signal DACSW2 together with the activation of the control signal AMPOUTSW2, until the deactivation of the control signal AMPOUTSW2 after the completion of the driving of the G-pixel 3 connected to the data line $DR_2$, the control signal DACSW2 is not required to be deactivated. Similarly, when the G-pixel 3 connected to the data line DG, is driven, after the activation of the control signal DACSW1 together with the activation of the control signal AMPOUTSW1, until the deactivation of the control signal AMPOUTSW1 after the completion of the driving of the B-pixel 3 connected to the data line $DB_2$, the control signal DACSW1 is not required to be deactivated. In the operation of FIG. 9A, the number of times of switching of the control signals DACSW1 and DACSW2 are totally 6. However, in the operation of FIG. 9C, the number of times of switching of the control signals DACSW1 and DACSW2 are totally 3. The reduction in the number of times of switching of the control signals DACSW1 and DACSW2 is preferable in view of decreasing in the electric power consumed to switch the control signals DACSW1 and DACSW2.

Figure 9D:
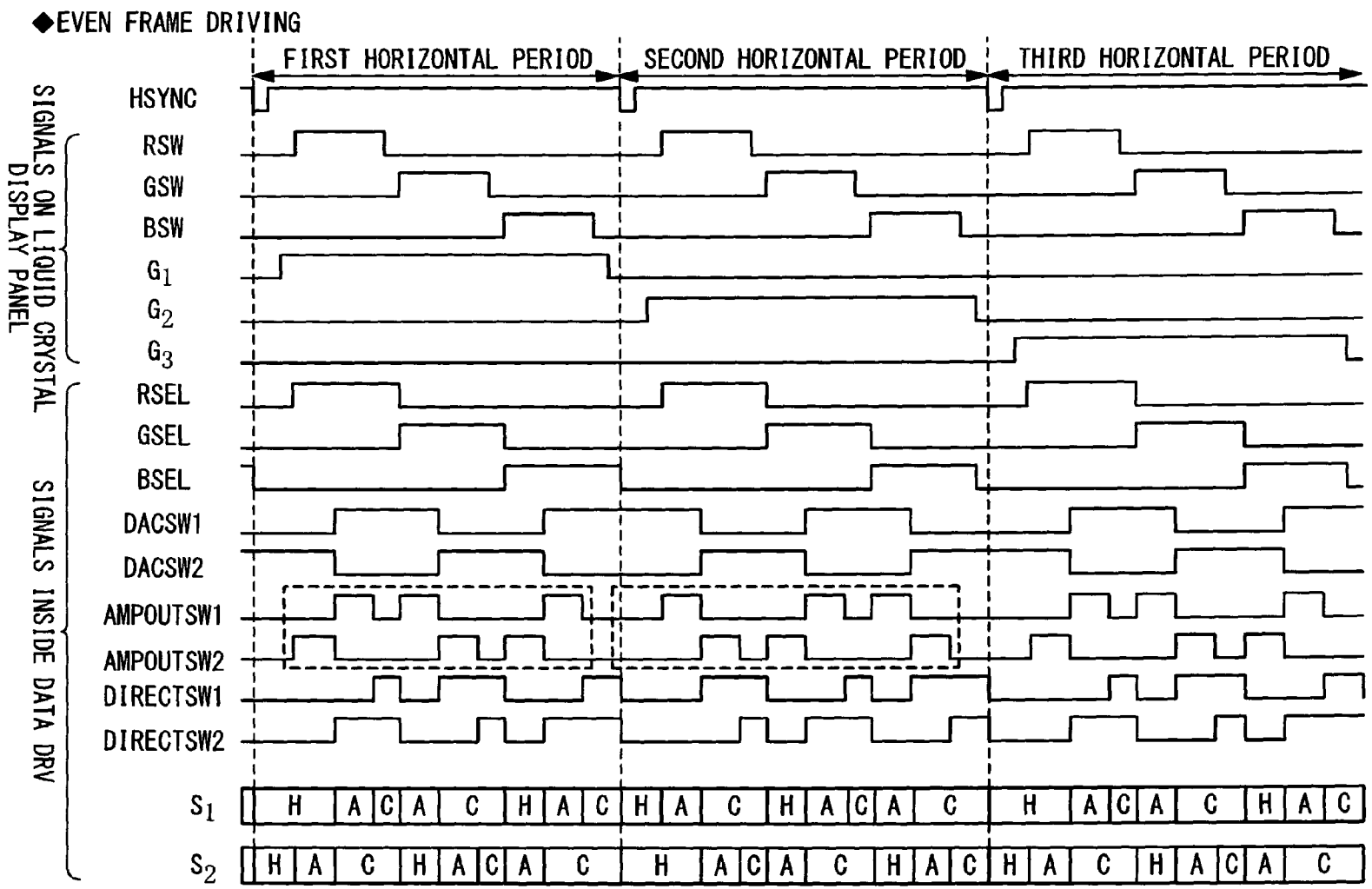
FIG. 9D is timing charts showing the preferable operation of the liquid crystal display apparatus in the first embodiment.

Also, in this case, the order in which the output nodes $S_1$ and $S_2$ are connected to the output amplifier $17_1$ is preferred to be switched for each frame period. In the embodiment, when the liquid crystal display apparatus 10 operates in the odd-numbered frame period as shown in FIG. 9C, the liquid crystal display apparatus 10 operates as shown in FIG. 9D in the even-numbered frame period. In the example shown in FIGS. 9C and 9D, in the driving of the R-pixel 3 in the first horizontal period in the odd-numbered frame period, as shown in FIG. 9C, the control signal AMPOUTSW1 is firstly activated, and the control signal AMPOUTSW2 is then activated. As this result, after the output node $S_1$ is connected to the output amplifier $\mathbf{17}_1$, instead of the output node $S_1$, the output node $S_2$ is connected to the output amplifier $\mathbf{17}_1$. On the other hand, in the driving of the R-pixel 3 in the first horizontal period in the even-numbered frame period, the control signal AMPOUTSW2 is firstly activated, and the control signal AMPOUTSW1 is then activated. As this result, after the output node $S_2$ is connected to the output amplifier $\mathbf{17}_1$, instead of the output node S2' the output node $S_1$ is connected to the output amplifier $\mathbf{17}_1$. Similarly, in the driving of the G-pixel 3 and the B-pixel 3, the order in which the control signals AMPOUTSW1 and AMPOUTSW2 are activated is switched between the odd-numbered frame period and the even-numbered frame period. Similarly, in the other horizontal periods, the order in which the control signals AMPOUTSW1 and AMPOUTSW2 are activated is switched between the odd-numbered frame period and the even-numbered frame period. According to the foregoing operation, the number of times of switching of the control signals DACSW1 and DACSW2 for controlling the connection between the D/A converters $\mathbf{15}_1$ and $\mathbf{15}_2$ and the input of the output amplifier $\mathbf{17}_1$ can be reduced, and the time while the drive voltage is written to the pixels of the same color is uniformed to the time average, and the generation of the flicker can be suppressed.

Second Embodiment

With reference to FIG. 6, one problem of the liquid crystal display apparatus 10 in the first embodiment lies in the fact that, unless a γ direct connection drive is finally performed, the capacitance coupling between the adjacent output node S and the wiring 7 connected thereto may cause the variation in the voltage level of one output node S to involve the variation in the voltage level of the other output node S. For example, when the output node $S_1$ is driven by the output amplifier $\mathbf{17}_1$ and then disconnected from the output amplifier $\mathbf{17}_1$, there is a case that the voltage level of the output node $S_1$ is greatly varied when the output node $S_2$ begins to be driven by the output amplifier $\mathbf{17}_1$. This is not preferable because this leads to the variation in the voltage level of the data line D and further leads to the variation in the drive voltage written to the pixel 3 and finally leads to the degradation in the image quality. The second embodiment provides the configuration and operation of the liquid crystal display apparatus in which each output node S is almost free from the influence of the variation in the voltage level of the adjacent output node S.

Figure 10:
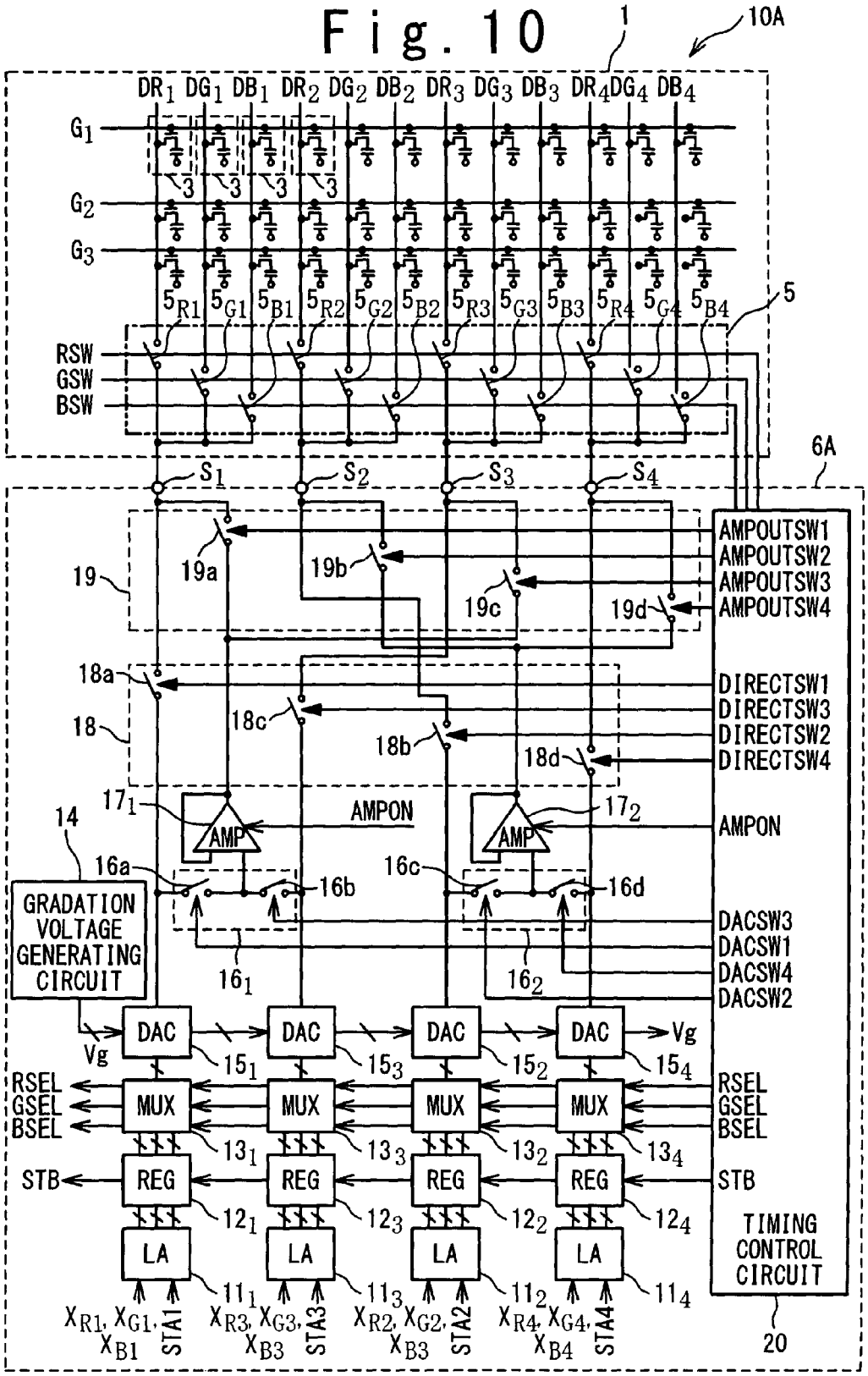
FIG. 10 is a block diagram showing the detail of the configuration of a liquid crystal display apparatus according to a second embodiment of the present invention.

FIG. 10 is a block diagram showing the configuration of the liquid crystal display apparatus 10A in a second embodiment. FIG. 10 shows the configuration of only the portions related to the output nodes $S_1$ to $S_4$. However, the fact that the configuration of FIG. 10 is actually repeatedly provided in the liquid crystal display apparatus 10A could be understood by those skilled in the art.

The liquid crystal display apparatus 10A in the second embodiment is designed such that the adjacent output node S is driven by the different output amplifier 17. This is intended such that while a certain output node S is driven by a certain output amplifier 17, the adjacent output node can be driven by the different output amplifier 17. In the configuration of the liquid crystal display apparatus 10A in this embodiment, for example, while the output node $S_1$ is driven by the output amplifier $\mathbf{17}_1$, the output node $S_2$ can be driven by the different output amplifier $\mathbf{17}_2$. According to the foregoing operation, when the output node $S_2$ is driven by the output amplifier $\mathbf{17}_2$ so that the voltage level of the output node $S_2$ is varied, the voltage level of the output node $S_1$ is immediately returned to the desirable voltage level by the output amplifier $\mathbf{17}_1$, even if the voltage level of the adjacent output node $S_1$ is varied by the influence of the crosstalk. Thus, the voltage level of the output node $S_1$ does not receive the influence of the variation in the voltage level of the adjacent output node $S_2$. The other output node S is similarly driven.

In order to attain such a function, in the second embodiment, the connection relation between the D/A converter 15 and the output amplifier 17 and the output node S is changed from the first embodiment. The liquid crystal display apparatus 10A in the second embodiment is designed such that the output nodes $S_1$ and $S_3$ located at the odd-numbered positions are driven by the output amplifier $\mathbf{17}_1$, and the output nodes $S_2$ and $S_4$ located at the even-numbered positions are driven by the output amplifier $\mathbf{17}_2$. In association with this, in the second embodiment, the positions of the latch $\mathbf{11}_3$, the register $\mathbf{12}_3$, the multiplexer $\mathbf{13}_3$ and the D/A converter $\mathbf{15}_3$, which correspond to the output node $S_3$, are replaced with the positions of the latch $\mathbf{11}_2$, the register $\mathbf{12}_2$, the multiplexer $\mathbf{13}_2$ and the D/A converter $\mathbf{15}_2$, which correspond to the output node $S_2$.

In addition, the configurations of the multiplexer 16, the direct switch 18 and the demultiplexer 19 are also changed.

The multiplexer $\mathbf{16}_1$ is configured to switch the connection relation between the output amplifier $\mathbf{17}_1$ and the D/A converters $\mathbf{15}_1$ and $\mathbf{15}_3$, in response to the control signals DACSW1 and DACSW3. In detail, the multiplexer $\mathbf{16}_1$ contains a switch 16*a* that is turned on or off in accordance with the control signal DACSW1; and a switch 16*b* that is turned on or off in accordance with the control signal DACSW3. When the control signal DACSW1 is activated, the output of the D/A converter $\mathbf{15}_1$ is connected to the input of the output amplifier $\mathbf{17}_1$. When the control signal DACSW3 is activated, the output of the D/A converter $\mathbf{15}_3$ is connected to the input of the output amplifier $\mathbf{17}_1$.

On the other hand, the multiplexer $\mathbf{16}_2$ is configured to switch the connection relation between the output amplifier $\mathbf{17}_2$ and the D/A converters $\mathbf{15}_2$ and $\mathbf{15}_4$, in response to the control signals DACSW2 and DACSW4. In detail, the multiplexer $\mathbf{16}_2$ contains a switch 16*c* that is turned on or off in accordance with the control signal DACSW2; and a switch 16*d* that is turned on or off in accordance with the control signal DACSW4. When the control signal DACSW2 is activated, the output of the D/A converter $\mathbf{15}_2$ is connected to the input of the output amplifier $\mathbf{17}_2$. When the control signal DACSW4 is activated, the output of the D/A converter $\mathbf{15}_4$ is connected to the input of the output amplifier $\mathbf{17}_2$.

The demultiplexer 19 switches the connection relation between the output amplifier $\mathbf{17}_1$ and the output nodes $S_1$ and $S_3$ and further switches the connection relation between the output amplifier $\mathbf{17}_2$ and the output nodes $S_2$ and $S_4$. In detail, switches 19*a*, 19*b*, 19*c* and 19*d*, which are respectively turned on or off in response to the control signals AMPOUTSW1, AMPOUTSW2, AMPOUTSW3 and AMPOUTSW4, are provided in a demultiplexer 19. The output of the output amplifier $\mathbf{17}_1$ is connected to the output node $S_1$ when the control signal AMPOUTSW1 is activated, and connected to the output node $S_3$ when the control signal AMPOUTSW3 is activated. On the other hand, the output of the output amplifier $\mathbf{17}_2$ is connected to the output node $S_2$ when the control signal AMPOUTSW2 is activated, and connected to the output node $S_4$ when the AMPOUTSW4 is activated.

The direct switch 18 is configured to switch the connection relation between the D/A converters $\mathbf{15}_1$ and $\mathbf{15}_3$ and the output nodes $S_1$ and $S_3$ and further switch the connection relation between the D/A converters $\mathbf{15}_2$ and $\mathbf{15}_4$ and the output nodes $S_2$ and $S_4$. In detail, switches 18*a*, 18*b*, 18*c* and 18*d*, which are respectively turned on or off in response to the control signals DIRECTSW1, DIRECTSW2, DIRECTSW3 and DIRECTSW, are provided in the direct switch 18. When the control signal DIRECTSW1 is activated, the output node $S_1$ is directly connected to the output of the D/A converter $\mathbf{15}_1$, and when the control signal DIRECTSW2 is activated, the output node $S_2$ is directly connected to the output of the D/A converter $\mathbf{15}_2$. Similarly, when the control signal DIRECTSW3 is activated, the output node $S_3$ is directly connected to the output of the D/A converter $\mathbf{15}_3$, and when the control signal DIRECTSW4 is activated, the output node $S_4$ is directly connected to the output of the D/A converter $\mathbf{15}_4$.

In succession, the operation of the liquid crystal display apparatus 10A in the second embodiment will be described.

Figure 11A:
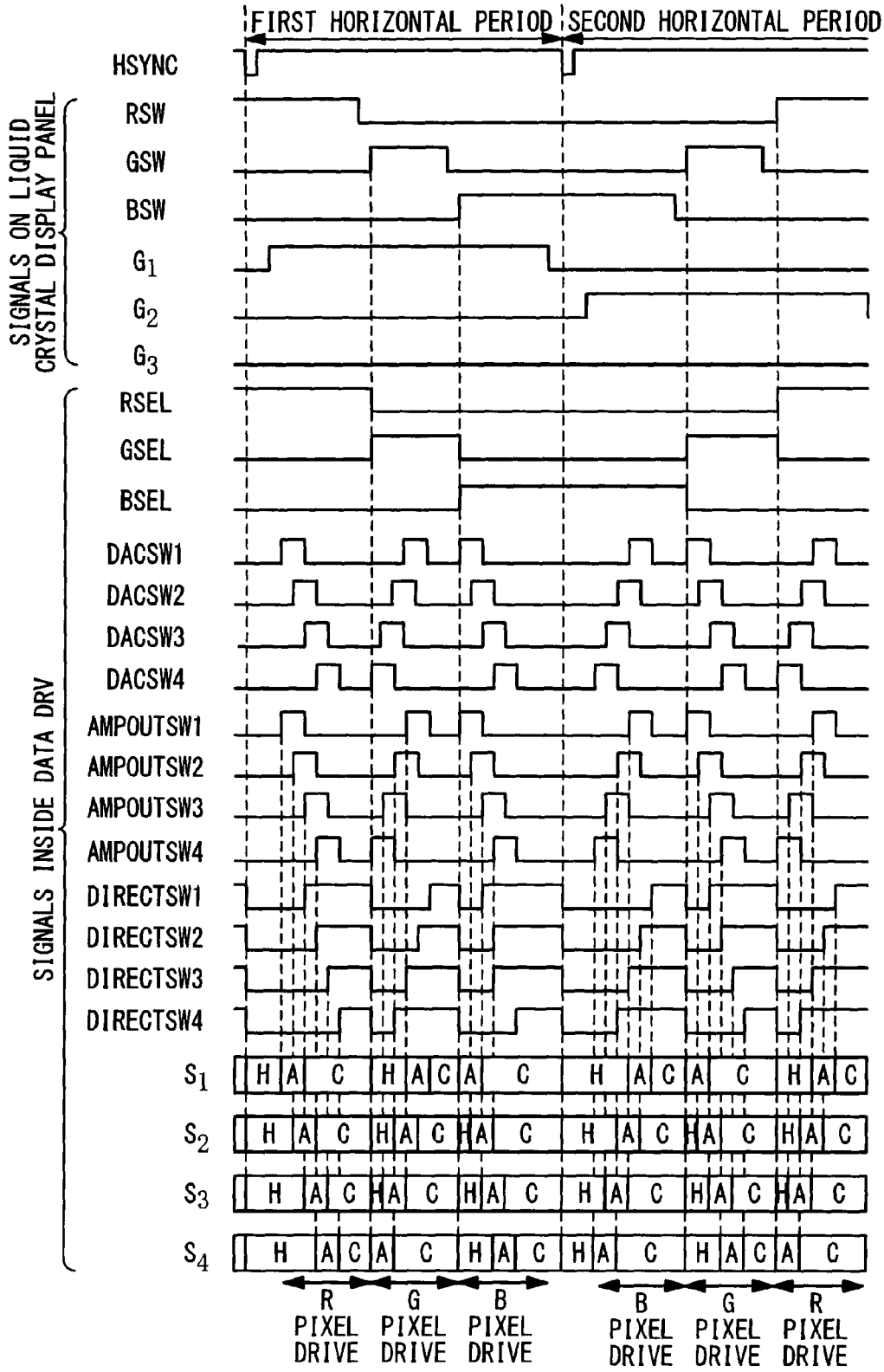
FIG. 11A is timing charts showing the operation of the liquid crystal display apparatus in the second embodiment.

FIG. 11A is timing charts showing the operation of the liquid crystal display apparatus 10A in this embodiment. Hereinafter, the driving of the pixels 3 corresponding to the output nodes $S_1$ to $S_4$, namely, the pixels 3 connected to the data lines $DR_1$ to $DR_4$, $DG_1$ to $DG_4$ and $DB_1$ to $DB_4$ will be described. However, the fact that the pixels 3 corresponding to the other output nodes S are similarly driven could be easily understood by those skilled in the art.

Immediately after the first horizontal period is started, the output nodes $S_1$ to $S_4$ are all set at the high impedance state. That is, the control signals DACSW1 to DACSW4, AMPOUTSW1 to AMPOUTSW4 and DIRECTSW1 to DIRECTSW4 are deactivated. Then, the output nodes $S_1$ to $S_4$ are electrically disconnected from all of the output amplifiers $\mathbf{17}_1$ and $\mathbf{17}_2$ and the D/A converters $\mathbf{15}_1$ to $\mathbf{15}_4$.

In this embodiment, when the first horizontal period is started, the control signal RSW is active, and the data lines $DR_1$ to $DR_4$ are connected through the time divisional switches $\mathbf{5}_{R1}$ to $\mathbf{5}_{R4}$ of the demultiplexer 5 to the output nodes $S_1$ to $S_4$, respectively. In addition, the control signal RSEL is also active. Thus, the pixel data $X_{R1}$ to $X_{R4}$ are sent to the D/A converters $\mathbf{15}_1$ to $\mathbf{15}_4$, respectively.

The driving of the pixel 3 connected to the scanning line $G_1$ is started together with the activation of the scanning line $G_1$. When the scanning line $G_1$ is activated, the pixel electrode 3*b* of the pixel 3 connected to the scanning line $G_1$ is electrically connected to the corresponding data line D.

In succession, the R-pixels 3 connected to the scanning line G and the data lines $DR_1$ to $DR_4$ are driven. The driving of the R-pixels 3 is performed as follows.

At first, the R-pixel 3 connected to the data line $DR_1$ is driven. In detail, the control signals DACSW1 and AMPOUTSW1 are activated, and the output of the D/A converter $\mathbf{15}_1$ is connected to the input of the output amplifier $\mathbf{17}_1$, and the output of the output amplifier $\mathbf{17}_1$ is further connected to the output node $S_1$. As this result, the data line $DR_1$ is connected through the time divisional switch $\mathbf{5}_{R1}$ of the demultiplexer 5 and the switch 19*a* of the demultiplexer 19 to the output amplifier $\mathbf{17}_1$, and the drive voltage corresponding to the pixel data $X_{R1}$ is supplied to the data line $DR_1$. The supplied drive voltage is written to the R-pixel 3 connected to the data line $DR_1$.

In succession, the R-pixel 3 connected to the data line $DR_2$ is driven. In detail, the control signals DACSW2 and AMPOUTSW2 are activated, and the output of the D/A converter $\mathbf{15}_2$ is connected to the input of the output amplifier $\mathbf{17}_2$, and the output of the output amplifier $\mathbf{17}_2$ is further connected to the output node $S_2$. As this result, the data line $DR_2$ is connected through the time divisional switch $\mathbf{5}_{R2}$ and the switch 19*b* of the demultiplexer 19 to the output amplifier $\mathbf{17}_2$, and the drive voltage corresponding to the pixel data $X_{R2}$ is supplied to the data line $DR_2$. The supplied drive voltage is written to the R-pixel 3 connected to the data line $DR_2$.

It should be noted that unlike the first embodiment, at the moment when the driving of the R-pixel 3 connected to the data line $DR_2$ is started, the output node S, continues to be connected to the output of the output amplifier $\mathbf{17}_1$. This is intended to prevent the drive voltage, which is written to the R-pixel 3 connected to the data line $DR_1$, from being varied by the capacitance coupling between the wirings 7 connected to the output nodes $S_1$ and $S_2$. Even if the voltage level of the output node $S_2$ is varied, the voltage level of the output node $S_1$ is kept constant by the output amplifier $\mathbf{17}_1$, and this does not receive the influence of the capacitance coupling. Thus, it is possible to prevent the variation in the voltage level of the data line $DR_1$ connected to the output node $S_1$, namely, the drive voltage written to the R-pixel 3.

In succession, the R-pixel 3 connected to the data line $DR_3$ is driven. In detail, the control signals DACSW3 and AMPOUTSW3 are activated. Consequently, the output of the D/A converter $\mathbf{15}_3$ is connected to the input of the output amplifier $\mathbf{17}_1$, and the output of the output amplifier $\mathbf{17}_1$ is connected to the output node $S_3$. As this result, the data line $DR_3$ is connected through the time divisional switch $\mathbf{5}_{R3}$ and the switch 19*c* of the demultiplexer 19 to the output amplifier $\mathbf{17}_1$, and the drive voltage corresponding to the pixel data $X_{R3}$ is supplied to the data line $DR_3$. The supplied drive voltage is written to the R-pixel 3 connected to the data line $DR_3$.

It should be noted that similarly to a case that the driving of the R-pixel 3 connected to the data line $DR_1$ is started, at the moment when the driving of the R-pixel 3 connected to the data line $DR_3$ is started, the output node $S_1$ continues to be connected to the output of the output amplifier $\mathbf{17}_2$. Thus, this prevents the drive voltage, which is written to the R-pixel 3 connected to the data line $DR_2$, from being varied by the capacitance coupling between the wirings 7 connected to the output nodes $S_2$ and $S_3$.

When the R-pixel 3 connected to the data line $DR_3$ begins to be driven by the output amplifier $\mathbf{17}_1$, the data line $DR_1$ is electrically disconnected from the output amplifier $\mathbf{17}_1$ and directly connected to the output of the D/A converter $\mathbf{15}_1$ instead of the disconnection. Consequently, the voltage level of the data line $DR_1$ is kept at a desirable gradation voltage generated by the gradation voltage generating circuit 14. In detail, together with the deactivation of the control signals DACSW1 and AMPOUTSW1, the control signal DIRECTSW1 is activated, and the output node $S_1$ is directly connected through the switch 18*a* of the direct switch 18 to the output of the D/A converter $\mathbf{15}_1$. As mentioned above, the electrical connection of the data line $DR_1$ to the output of the D/A converter $\mathbf{15}_1$ provides the effect of suppressing the influence of the offset of the output amplifier $\mathbf{17}_1$.

In succession, the R-pixel 3 connected to the data line $DR_4$ is driven. In detail, the control signals DACSW4 and AMPOUTSW4 are activated, and the output of the D/A converter $\mathbf{15}_4$ is connected to the input of the output amplifier $\mathbf{17}_2$, and the output of the output amplifier $\mathbf{17}_2$ is connected to the output node $S_4$. As this result, the data line $DR_4$ is connected through the time divisional switch $\mathbf{5}_{R4}$ and the switch 19*d* of the demultiplexer 19 to the output of the output amplifier $\mathbf{17}_2$, and the drive voltage corresponding to the pixel data $X_{R4}$ is supplied to the data line $DR_4$. The supplied drive voltage is written to the R-pixel 3 connected to the data line $DR_4$. It should be noted that at the moment when the driving of the R-pixel 3 connected to the data line $DR_4$ is started, the output node $S_3$ continues to be connected to the output of the output amplifier $\mathbf{17}_1$.

When the R-pixel 3 connected to the data line $DR_4$ begins to be driven by the output amplifier $\mathbf{17}_2$, the control signals DACSW2 and AMPOUTSW2 are deactivated, and the control signal DIRECTSW2 is deactivated. Consequently, the data line $DR_2$ is electrically disconnected from the output amplifier $\mathbf{17}_2$ and directly connected to the output of the D/A converter $\mathbf{15}_2$ instead of the disconnection. Since the data line $DR_2$ is directly connected to the output of the D/A converter $\mathbf{15}_2$, the voltage level of the data line $DR_2$ is kept at a desirable gradation voltage generated by the gradation voltage generating circuit 14.

In succession, the process in which the R-pixel 3 connected to the data line $DR_3$ is driven by the output amplifier 17, is completed. After the completion of the driving, the data line $DR_3$ is electrically disconnected from the output amplifier 17, and electrically connected to the output of the D/A converter $\mathbf{15}_3$ instead of the disconnection. In detail, together with the deactivation of the control signals DACSW3 and AMPOUTSW3, the control signal DIRECTSW3 is activated. Consequently, the voltage level of the data line $DR_3$ is kept at the desirable gradation voltage generated by the gradation voltage generating circuit 14.

Further in succession, the process in which the R-pixel 3 connected to the data line $DR_4$ is driven by the output amplifier $\mathbf{17}_1$ is completed. After the completion of the driving, the data line $DR_4$ is electrically disconnected from the output amplifier $\mathbf{17}_2$ and electrically connected to the output of the D/A converter $\mathbf{15}_4$ instead of the disconnection. In detail, together with the deactivation of the control signals DACSW4 and AMPOUTSW4, the control signal DIRECTSW4 is activated. Consequently, the voltage level of the data line $DR_4$ is kept at a desirable gradation voltage generated by the gradation voltage generating circuit 14. Thus, finally, all of the data lines $DR_1$ to $DR_4$ are directly connected to the D/A converters $\mathbf{15}_1$ to $\mathbf{15}_4$, the influence of the offsets of the output amplifiers $\mathbf{17}_1$ and $\mathbf{17}_2$ can be removed, which can improve the image quality. The driving of the R-pixels 3 has been completed through the foregoing process.

After the completion of the driving of the R-pixels 3, the G-pixels 3 connected to the scanning line $G_1$ and the data lines $DG_1$ to $DG_4$ are driven. A procedure for driving the G-pixels 3 is similar to the procedure for driving the R-pixels 3, except a point that the control signal GSW is activated instead of the activation of the control signal RSW and a point that the order when the G-pixels 3 are driven is different. The process in which the G-pixels 3 are driven by the output amplifier 17 is performed in the order of the G-pixel 3 connected to the data line $DG_3$, the G-pixel 3 connected to the data line $DG_2$, and the G-pixel 3 connected to the data line $DG_1$. That is, after the activation of the control signal GSW, the control signals DACSW4, DACSW3, DACSW2 and DACSW1 are sequentially activated in this order, and the control signals AMPOUTSW4, AMPOUTSW3, AMPOUTSW2 and AMPOUTSW1 are sequentially activated in this order. Consequently, the G-pixels 3 connected to the data lines $DG_1$ to $DG_4$ are driven by the corresponding output amplifiers 17, and the desirable drive voltage is written to each G-pixel 3. When the process in which the respective G-pixels 3 are driven by the output amplifier 17 is completed, the control signal $DIRECTSW_j$ corresponding thereto is activated (j=4, 3, 2 and 1). Thus, the data lines $DG_4$, $DG_3$, $DG_2$ and $DG_1$ are connected to the D/A converters $\mathbf{15}_4$, $\mathbf{15}_3$, $\mathbf{15}_2$ and $\mathbf{15}_1$, respectively. Then, the voltage levels of the data lines $DG_4$, $DG_3$, $DG_2$ and $DG_1$ are kept at desirable gradation voltages generated by the gradation voltage generating circuit 14.

Finally, the B-pixels 3 connected to the scanning line $G_1$ and the data lines $DB_1$ to $DB_4$ are driven. A procedure for driving the B-pixels 3 is similar to the procedure for driving the R-pixels 3, except a point that the control signal BSW is activated instead of the activation of the control signal RSW. After the activation of the control signal BSW, the control signals DACSW1, DACSW2, DACSW3 and DACSW4 are sequentially activated in this order, and the control signals AMPOUTSW1, AMPOUTSW2, AMPOUTSW3 and AMPOUTSW4 are sequentially activated in this order. Consequently, the B-pixels 3 connected to the data lines $DB_1$ to $DB_4$ are driven by the corresponding output amplifiers 17, and the desirable drive voltage is written to each B-pixel 3. When the process in which the respective B-pixels 3 are driven by the output amplifier 17 is completed, the control signal $DIRECTSW_j$ corresponding thereto is activated (j=1, 2, 3 and 4). Thus, the data lines $DB_1$, $DB_2$, $DB_3$ and $DB_4$ are connected to the D/A converters $\mathbf{15}_1$, $\mathbf{15}_2$, $\mathbf{15}_3$ and $\mathbf{15}_4$, respectively. Then, the voltage levels of the data lines $DB_1$, $DB_2$, $DB_3$ and $DB_4$ are kept at the desirable gradation voltages generated by the gradation voltage generating circuit 14.

Even in the second horizontal period, the pixels 3 connected to the scanning line $G_2$ are driven in accordance with the similar procedure. However, in the second horizontal period, the pixels 3 connected to the scanning line $G_2$ are driven in the order of the B-pixel, the G-pixel and the R-pixel. When the B-pixels 3 are driven, the control signal BSW continues to be successively active from the first horizontal period, and the time divisional switches $\mathbf{5}_{B1}$ to $\mathbf{5}_{B4}$ of the demultiplexer 5 in the liquid crystal display panel 1 are not turned off. The data lines $DB_1$ to $DB_4$ continue to be connected to the source lines $S_1$ to $S_4$ even after the completion of the first horizontal period. According to the foregoing operation, it is possible to reduce the switching numbers of the time divisional switches $\mathbf{5}_{B1}$ to $\mathbf{5}_{B4}$ of the demultiplexer 5 and also possible to decrease the electric power consumption of the liquid crystal display panel 1.

In detail, when the second horizontal period is started, at first, the B-pixels 3 connected to the scanning line $G_2$ and the data lines $DB_1$ to $DB_4$ are driven. The process in which the B-pixels 3 are driven by the output amplifier 17 is performed in the order of the B-pixel 3 connected to the data line $DB_4$, the B-pixel 3 connected to the data line $DB_3$, the B-pixel 3 connected to the data line $DB_2$, and the B-pixel 3 connected to the data line $DB_1$. That is, after the activation of the control signal BSW, the control signals DACSW4, DACSW3, DACSW2 and DACSW1 are sequentially activated in this order, and the control signals AMPOUTSW4, AMPOUTSW3, AMPOUTSW2 and AMPOUTSW1 are sequentially activated in this order. Consequently, the B-pixels 3 connected to the data lines $DB_1$ to $DB_4$ are driven by the corresponding output amplifiers 17, and a desirable drive voltage is written to each B-pixel 3. When the process in which the respective B-pixels 3 are driven by the output amplifier 17 is completed, the control signal $DIRECTSW_j$ corresponding thereto is activated (j=4, 3, 2 and 1). Thus, the data lines $DB_4$, $DB_3$, $DB_2$ and $DB_1$ are connected to the D/A converters $\mathbf{15}_4$, $\mathbf{15}_3$, $\mathbf{15}_2$ and $\mathbf{15}_1$, respectively. Then, the voltage levels of the data lines $DB_4$, $DB_3$, $DB_2$ and $DB_1$ are kept at desirable gradation voltages generated by the gradation voltage generating circuit 14.

In succession, the G-pixels 3 connected to the scanning line $G_2$ and the data lines $DG_1$ to $DG_4$ are driven. In detail, after the activation of the control signal GSW, the control signals DACSW1, DACSW2, DACSW3 and DACSW4 are sequentially activated in this order, and the control signals AMPOUTSW1, AMPOUTSW2, AMPOUTSW3 and AMPOUTSW4 are sequentially activated in this order. Consequently, the G-pixels 3 connected to the data lines $DG_1$ to $DG_4$ are driven by the corresponding output amplifiers 17, and a desirable drive voltage is written to each G-pixel 3. When the process in which the respective G-pixels 3 are driven by the output amplifier 17 is completed, the control signal $DIRECTSW_j$ corresponding thereto is activated (j=1, 2, 3 and 4). Thus, the data lines $DG_1$, $DG_2$, $DG_3$ and $D_4$ are connected to the D/A converters $\mathbf{15}_1$, $\mathbf{15}_2$, $\mathbf{15}_3$ and $\mathbf{15}_4$, respectively. Then, the voltage levels of the data lines $DG_1$, $DG_2$, $DG_3$ and $DG_4$ are kept at the desirable gradation voltages generated by the gradation voltage generating circuit 14.

Finally, the R-pixels 3 connected to the scanning line $G_2$ and the data lines $DR_1$ to $DR_4$ are driven. In detail, after the activation of the control signal RSW, the control signals DACSW4, DACSW3, DACSW2 and DACSW1 are sequentially activated in this order, and the control signals AMPOUTSW4, AMPOUTSW3, AMPOUTSW2 and AMPOUTSW1 are sequentially activated in this order. Consequently, the R-pixels 3 connected to the data lines $DR_1$ to $DR_4$ are driven by the corresponding output amplifiers 17, and the desirable drive voltage is written to each R-pixel 3. When the process in which the respective R-pixels 3 are driven by the output amplifier 17 is completed, the control signal $DIRECTSW_j$ corresponding thereto is activated (j=4, 3, 2 and 1). Thus, the data lines $DR_4$, $DR_3$, $DR_2$ and $DR_1$ are connected to the D/A converters $\mathbf{15}_4$, $\mathbf{15}_3$, $\mathbf{15}_2$ and $\mathbf{15}_1$, respectively. Then, the voltage levels of the data lines $DR_4$, $DR_3$, $DR_2$ and $DR_1$ are kept at desirable gradation voltages generated by the gradation voltage generating circuit 14.

Hereinafter, in the odd-numbered horizontal periods, the pixels 3 are driven similarly to the first horizontal period, and in the even-numbered horizontal periods, the pixels 3 are driven similarly to the second horizontal period.

As described above, in this embodiment, while the output node $S_1$ is driven by the output amplifier $\mathbf{17}_1$, the output node $S_2$ is driven by another output amplifier $\mathbf{17}_2$. Similarly, while the output node $S_2$ is driven by the output amplifier $\mathbf{17}_2$, the output node $S_3$ is driven by the output amplifier $\mathbf{17}_1$. While the output node $S_3$ is driven by the output amplifier $\mathbf{17}_1$, the output node $S_4$ is driven by the output amplifier $\mathbf{17}_2$. According to the foregoing operation, even if the voltage level of each output node S is varied by the influence of the cross talk when the voltage level of the adjacent output node $S_2$ is varied, the voltage level of each output node S is immediately returned to a desirable voltage level by the output amplifier 17. Thus, the voltage level of each output node S does not receive the influence of the variation in the voltage level of the adjacent output node S.

In addition, in the operation in this embodiment, finally, all of the data lines D are directly connected to the D/A converter 15. Thus, the influence of the offset of the output amplifier 17 can be removed, which can improve the image quality.

By the way, in this embodiment, the waveforms of the control signals DACSW1 to DACSW4 can be changed in a range that satisfies the following conditions:

(1) The control signals DACSW1, DACSW3 are not activated at the same time;

(2) The control signals DACSW2, DACSW4 are not activated at the same time; and (3) Each control signal $DACSW_j$ (j=1, 2, 3 and 4) is active, at least while the control signal $AMPOUTSW_j$ is active.

Figure 11B:
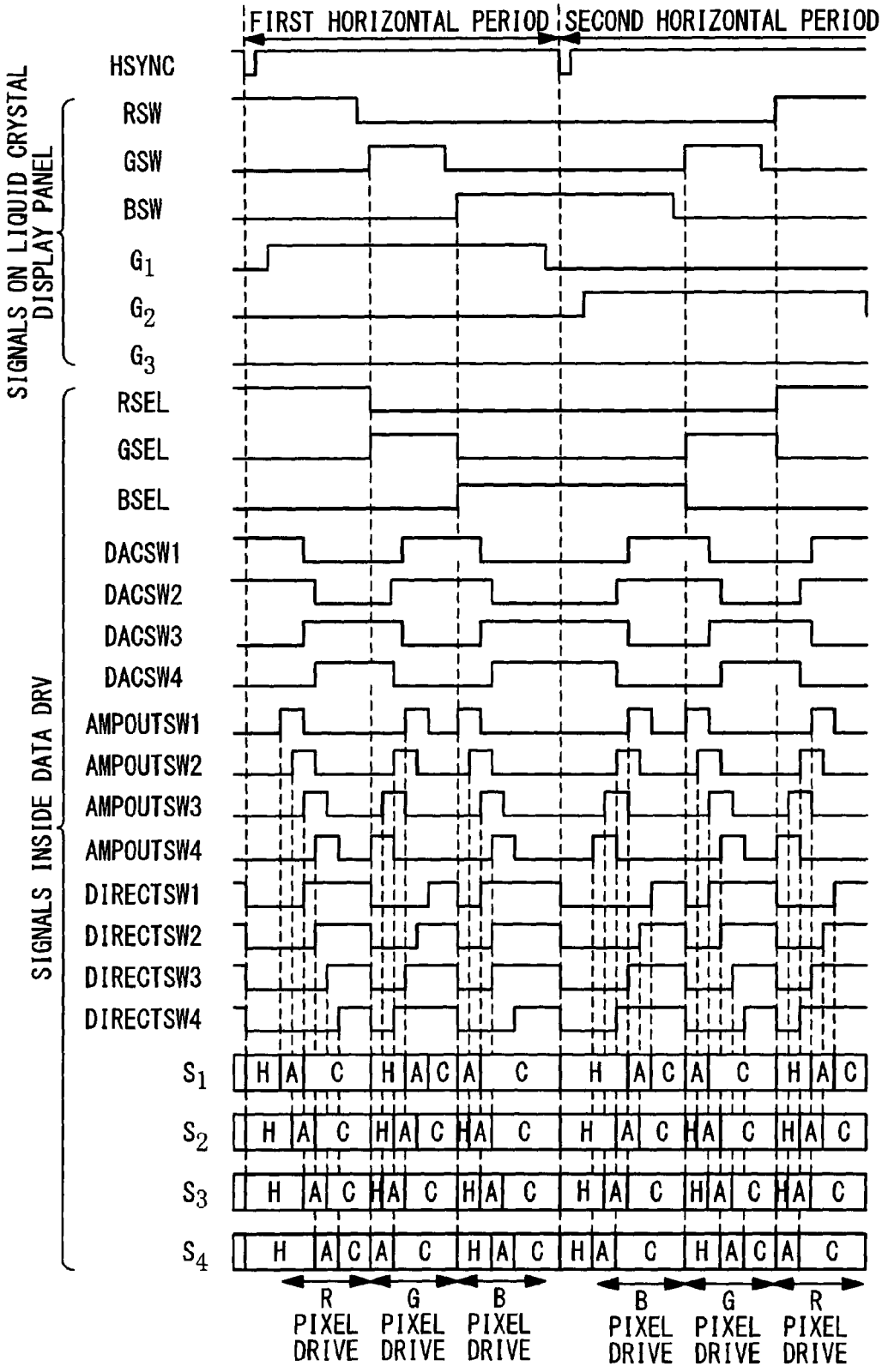
FIG. 11B is timing charts showing the operation of the liquid crystal display apparatus in the second embodiment.

FIG. 11B is timing charts showing the different waveforms of the control signals DACSW1 to DACSW4 that satisfy the foregoing conditions. In the operation of FIG. 11B, when the first horizontal period is started, the control signals DACSW1, DACSW2 are active, and the control signals DACSW3, DACSW4 and AMPOUTSW 1 to 4 are inactive.

At first, the R-pixels 3 are driven. Specifically, at first, in order to drive the R-pixels 3 connected to the data lines $DR_1$ and $DR_2$, the control signals AMPOUTSW1 and AMPOUTSW2 are sequentially activated. When the driving of the R-pixels 3 connected to the data lines $DR_1$ and $DR_2$ has been completed, the control signals AMPOUTSW1, AMPOUTSW2 are deactivated. The control signals DACSW1 and DACSW2 are deactivated together with the deactivation of the control signals AMPOUTSW1 and AMPOUTSW2.

Moreover, in order to drive the R-pixels 3 connected to the data lines $DR_3$ and $DR_4$, the control signal AMPOUTSW3 is activated together with the deactivation of the control signal AMPOUTSW1, and the control signal AMPOUTSW4 is activated together with the deactivation of the control signal AMPOUTSW2. The control signals DACSW3 and DACSW4 are activated together with the activation of the control signals AMPOUTSW3 and AMPOUTSW4. After that, when the driving of the R-pixels 3 connected to the data lines $DR_3$ and $DR_4$ is completed, even if the control signals AMPOUTSW3 and AMPOUTSW4 are deactivated, the control signals DACSW3 and DACSW4 continue to be active.

In succession, the G-pixels 3 are driven. Specifically, in order to drive the G-pixels 3 connected to the data lines $DG_4$ and $DG_{G3}$, the control signals AMPOUTSW4 and AMPOUTSW3 are sequentially activated. It should be noted that, since the control signals DACSW3 and DACSW4 continue to be successively active after the completion of the driving of the R-pixels 3, the control signals DACSW3 and DACSW4 are not required to be switched. When the driving of the G-pixels 3 connected to the data lines $DG_4$ and $DG_{G3}$ has been completed, the control signals AMPOUTSW4 and AMPOUTSW3 are deactivated. The control signals DACSW4 and DACSW3 are deactivated together with the deactivation of the control signals AMPOUTSW4 and AMPOUTSW3.

Moreover, in order to drive the G-pixels 3 connected to the data lines $DG_2$ and $DG_{G1}$, the control signal AMPOUTSW2 is activated together with the deactivation of the control signal AMPOUTSW4, and the control signal AMPOUTSW1 is activated together with the deactivation of the control signal 3. The control signals DACSW2 and DACSW1 are activated together with the activation of the control signals AMPOUTSW2 and AMPOUTSW1. After that, when the driving of the G-pixels 3 connected to the data lines $DG_2$ and $DG_1$ are completed, even if the control signals AMPOUTSW2 and AMPOUTSW1 are deactivated, the control signals DACSW2 and DACSW1 continue to be active.

Further, in succession, the B-pixels 3 are driven. Specifically, at first, in order to drive the B-pixels 3 connected to the data lines $DB_1$ and $DB_2$, the control signals AMPOUTSW1 and AMPOUTSW2 are sequentially activated. When the driving of the B-pixels 3 connected to the data lines $DB_1$ and $DB_2$ has been completed, the control signals AMPOUTSW1 and AMPOUTSW2 are deactivated. The control signals DACSW1 and DACSW2 are deactivated together with the deactivation of the control signals AMPOUTSW1 and AMPOUTSW2.

Moreover, in order to drive the B-pixels 3 connected to the data lines $DB_3$ and $DB_4$, the control signal AMPOUTSW3 is activated together with the deactivation of the control signal AMPOUTSW1, and the control signal AMPOUTSW4 is activated together with the deactivation of the control signal AMPOUTSW2. The control signals DACSW3 and DACSW4 are activated together with the activation of the control signals AMPOUTSW3 and AMPOUTSW4. After that, when the driving of the B-pixels 3 connected to the data lines $DB_3$ and $DB_4$ are completed, even if the control signals AMPOUTSW3 and AMPOUTSW4 are deactivated, the control signals DACSW3 and DACSW4 continue to be active.

Even in the second horizontal period, the pixels 3 are similarly driven except the change of the order of driving the pixels 3.

The merit of the operation shown in FIG. 11B lies in the reduction in the number of times of switching of the control signals DACSW1 to DACSW4. In the operation of FIG. 11A, the control signals DACSW1 to DACSW4 are required to be pulled up a total of 12 times in one horizontal period and pulled down a total of 12 times. On the other hand, in the operation of FIG. 11B, the control signals DACSW1 to DACSW4 are only required to be pulled up a total of 6 times and pulled down a total of 6 times. The reduction in the number of times of switching of the control signals DACSW1 to DACSW4 is preferred to decrease the electric power consumption.

Third Embodiment

Figure 12:
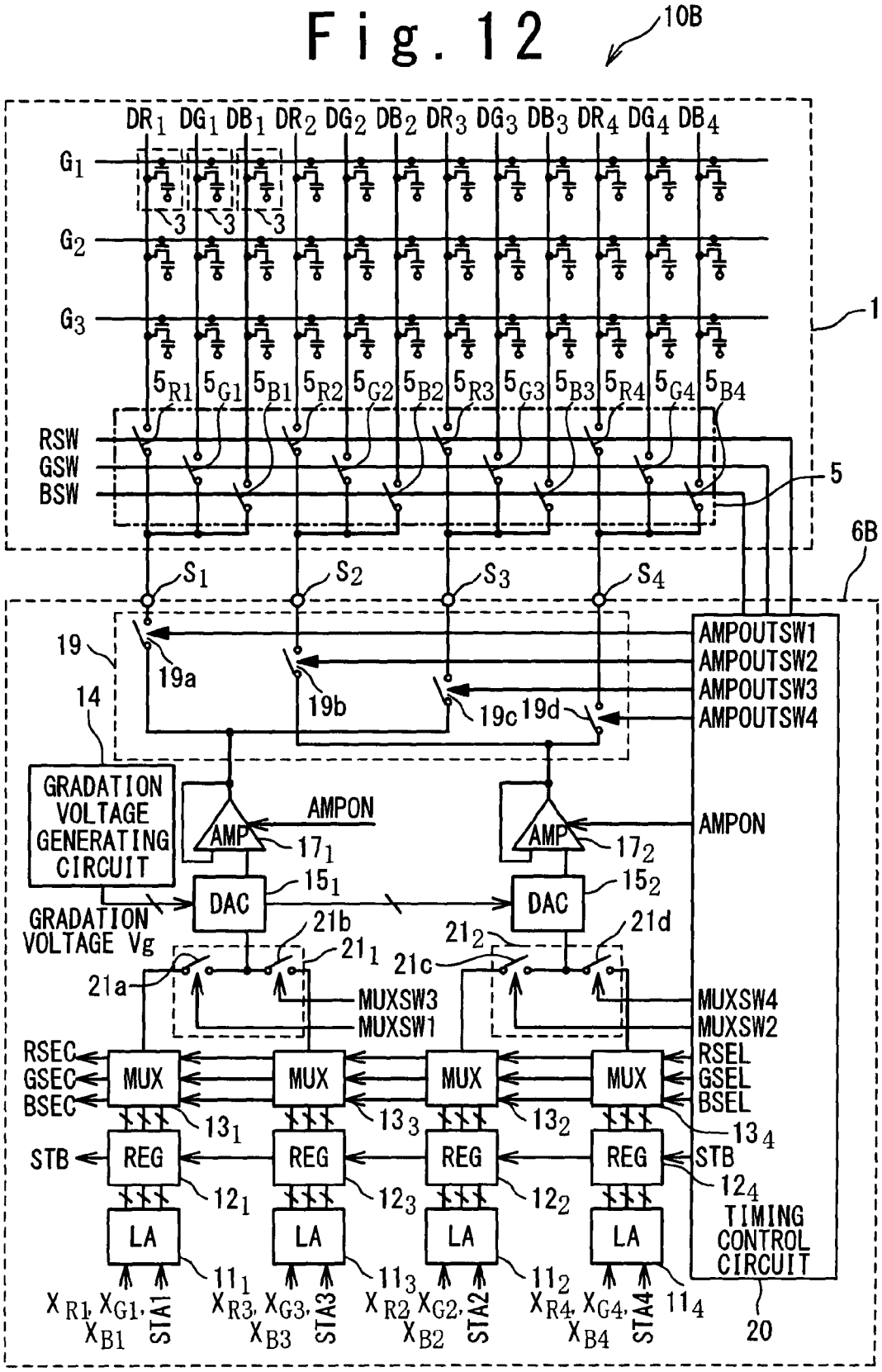
FIG. 12 is a block diagram showing the detail of the configuration of a liquid crystal display apparatus according to a third embodiment of the present invention.

FIG. 12 is a block diagram showing the configuration of a liquid crystal display apparatus 10B in a third embodiment of the present invention. FIG. 12 shows the configuration of only the portions related to the output nodes $S_1$ to $S_4$. However, the fact that the configuration of FIG. 12 is repeatedly provided in the liquid crystal display apparatus 10B could be understood.

The configuration of the liquid crystal display apparatus 10B in the third embodiment is similar to the configuration of the liquid crystal display apparatus 10A in the second embodiment. Similarly to the liquid crystal display apparatus 10A in the second embodiment, the liquid crystal display apparatus 10B in the third embodiment is designed in such a manner that the adjacent output node S is driven by the different output amplifier 17. Such design is important in order to reduce the influence of the variation in the voltage level of the adjacent output node S.

In addition, in the third embodiment, the number of D/A converters 15 is halved in order to reduce the scale of the circuit provided in a data driver IC 6B. That is, in the third embodiment, one D/A converter 15 is connected through the output amplifier 17 to two output nodes S and used to drive the data lines D connected to the two output nodes. Specifically, the D/A converter $15_1$ is used to drive the data lines D connected to the output nodes $S_1$ and $S_3$, and the D/A converter $15_2$ is used to drive the data lines D connected to the output nodes $S_2$ and $S_4$. In association with this, the connection relation between the multiplexer 13, the D/A converter 15, the output amplifier 17, the demultiplexer 19 and the output node S is changed.

In detail, in the third embodiment, a multiplexer $21_1$, which operates in response to control signals MUXSW1 and MUXSW3, is connected to the outputs of the multiplexers $13_1$ and $13_3$, and a multiplexer $21_2$ is connected to the outputs of the multiplexers $13_2$ and $13_4$ which operate in response to control signals MUXSW2 and MUXSW4. The multiplexer $21_1$ connects the output of the multiplexer $13_1$ to the input of the D/A converter $15_1$ when the control signal MUXSW1 is activated, and connects the output of the multiplexer $13_2$ to the input of the D/A converter $15_1$ when the control signal MUXSW3 is activated. On the other hand, the multiplexer $21_2$ connects the output of the multiplexer $13_2$ to the input of the D/A converter $15_2$ when the control signal MUXSW2 is activated, and connects the output of the multiplexer $13_4$ to the input of the D/A converter $15_2$ when the control signal MUXSW4 is activated.

It should be noted that the multiplexers $13_1$ and $13_3$ and the multiplexer $21_1$ entirely function as the multiplexer for selectively sending the pixel data $X_{R1}$, $X_{G1}$, $X_{B1}$, $X_{R3}$, $X_{G3}$ and $X_{B3}$ to the D/A converter $15_1$. That is, in case that the control signal MUXSW1 is active, when the control signals RSEL, GSEL and BSEL are activated, the pixel data $X_{R1}$, $X_{G1}$ and $X_{B1}$ are selected, respectively, and sent to the D/A converter $15_1$. On the other hand, in case that the control signal MUXSW3 is active, when the control signals RSEL, GSEL and BSEL are activated, the pixel data $X_{R3}$, $X_{G3}$ and $X_{B3}$ are selected, respectively, and sent to the D/A converter $15_1$.

Similarly, the multiplexers $13_2$ and $13_4$ and the multiplexer $21_2$ entirely function as the multiplexer for selectively sending the pixel data $X_{R2}$, $X_{G2}$, $X_{B2}$, $X_{B4}$, $X_{G4}$ and $X_{B4}$ to the D/A converter $15_2$. In case that the control signal MUXSW2 is active, when the control signals RSEL, GSEL and BSEL are activated, the pixel data $X_{R2}$, $X_{G2}$ and $X_{B2}$ are selected, respectively, and sent to the D/A converter $15_2$. On the other hand, in case that the control signal MUXSW4 is active, when the control signals RSEL, GSEL and BSEL are activated, the pixel data $X_{R4}$, $X_{G4}$ and $X_{B4}$ are selected, respectively, and sent to the D/A converter $15_2$.

Similarly to the second embodiment, the demultiplexer 19 is provided at the output amplifiers $17_1$ and $17_2$ so that the connection relation between the output amplifier $17_1$ and the output nodes $S_1$ and $S_3$ is switched and the connection relation between the output amplifier $17_2$ and the output nodes $S_2$ and $S_4$ is further switched. The demultiplexer 19 includes the switches 19*a*, 19*b*, 19*c* and 19*d* which are turned on or off in response to the control signals AMPOUTSW1, AMPOUTSW2, AMPOUTSW3 and AMPOUTSW4, respectively. The output of the output amplifier $17_1$ is connected to the output node $S_1$ when the control signal AMPOUTSW1 is activated, and connected to the output node $S_3$ when the control signal AMPOUTSW3 is activated. On the other hand, the output of the output amplifier $17_2$ is connected to the output node $S_2$ when the control signal AMPOUTSW2 is activated, and connected to the output node $S_4$ when the control signal AMPOUTSW4 is activated.

It should be noted that the data driver IC 6B in this embodiment includes a route through which the D/A converter 15 is directly connected to the output node S without any intervention of the output amplifier 17, unlike the first and second embodiments.

Figure 13:
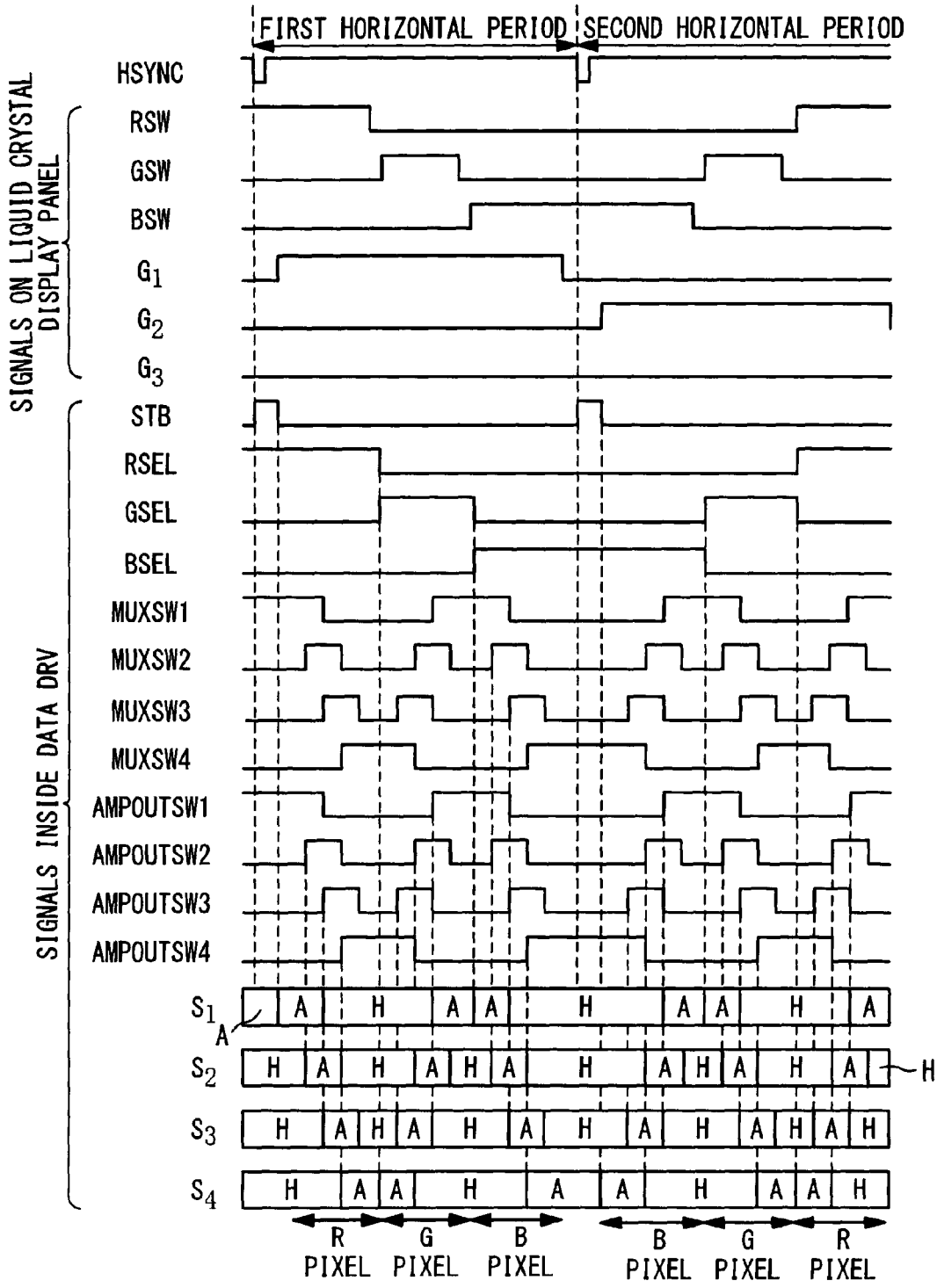
FIG. 13 is timing charts showing the operation of the liquid crystal display apparatus in the third embodiment.

FIG. 13 is timing charts showing the operation of the liquid crystal display apparatus 10B in the third embodiment. Hereinafter, the driving of the pixels 3 corresponding to the output nodes $S_1$ to $S_4$, namely, the pixels 3 connected to the data lines $DR_1$ to $DR_4$, $DG_1$ to $DG_4$ and $DB_1$ to $DB_4$ will be described. However, the fact that the pixels 3 corresponding to the other output nodes S are similarly driven could be understood by those skilled in the art.

When the first horizontal period is started, the control signals RSW, RSEL, MUXSW1 and AMPOUTSW1 are active. That is, the output node $S_1$ is in the state that it is connected to the output amplifier $17_1$. On the other hand, all of the scanning lines G are inactive, and the pixel electrode 3*b* of the pixel 3 is disconnected from the data line D. Thus, although the output node $S_1$ is connected to the output amplifier $17_1$, any of the pixels 3 is not driven.

When the first horizontal period is started, at first, the R-pixels 3 connected to the scanning line $G_1$ and the data lines $DR_1$ to $DR_4$ are driven. The driving of the R-pixels 3 is performed as follows. In synchronization to the deactivation (pull-up) of the horizontal synchronization signal HSYNC, the latch signal STB is activated. It should be noted that the timing when the latch signal STB is activated is properly selected on the basis of the specification of the data driver IC 6B. With the activation of the latch signal STB, the pixel data for specifying the gradation of the pixel 3 connected to the scanning line $G_1$ is latched by the register 12. At this time, since the control signals RSEL, MUXSW1 and AMPOUTSW1 are active, the pixel data $X_{R1}$ corresponding to the R-pixel 3 connected to the data line $DR_1$ is sent to the D/A converter $\mathbf{15}_1$. Moreover, the same drive voltage as the gradation voltage corresponding to the pixel data $X_{R1}$ is supplied from the output of the output amplifier $\mathbf{17}_1$ through the output node $S_1$ to the data line $DR_1$.

In succession, the scanning line $G_1$ is activated. Consequently, the drive voltage corresponding to the pixel data $X_{R1}$ is written to the R-pixel 3 connected to the data line $DR_1$.

In succession, the R-pixel 3 connected to the data line $DR_2$ is driven. In detail, the control signals MUXSW2 and AMPOUTSW2 are activated, and the output of the output amplifier $\mathbf{17}_2$ is connected to the output node $S_2$. Consequently, the data line $D_{D2}$ is connected through the time divisional switch $\mathbf{5}_{R2}$ of the demultiplexer 5 and the switch 19*b* of the demultiplexer 19 to the output of the output amplifier $\mathbf{17}_2$. The drive voltage corresponding to the pixel data $X_{R2}$ is supplied to the data line $DR_2$. The supplied drive voltage is written to the R-pixel 3 connected to the data line $DR_2$.

Similarly to the second embodiment, it should be noted that at the moment when the driving of the R-pixel 3 connected to the data line $DR_2$ is started, the output node $S_1$ continues to be connected to the output of the output amplifier $\mathbf{17}_1$. Thus, even if the voltage level of the output node $S_2$ is varied, the voltage level of the output node $S_1$ is kept constant by the output amplifier $\mathbf{17}_1$, and this does not receive the influence of the capacitance coupling of the wiring 7. Therefore, it is possible to prevent the variation in the voltage level of the data line $DR_1$ connected to the output node $S_1$, namely, the drive voltage written to the R-pixel 3.

In succession, the R-pixel 3 connected to the data line $DR_3$ is driven. In detail, the control signals MUXSW3 and AMPOUTSW3 are activated together with the deactivation of the control signals MUXSW1 and AMPOUTSW1. With the activation of the control signals MUXSW3 and AMPOUTSW3, the output of the output amplifier $\mathbf{17}_1$ is connected to the output node $S_3$. Thus, the data line $DR_3$ is connected through the time divisional switch $\mathbf{5}_{R3}$ of the demultiplexer 5 and the switch 19*c* of the demultiplexer 19 to the output of the output amplifier $\mathbf{17}_1$, and the drive voltage corresponding to the pixel data $X_{R3}$ is supplied to the data line $DR_3$. The supplied drive voltage is written to the R-pixel 3 connected to the data line $DR_3$. Similarly to the moment when the driving of the R-pixel 3 connected to the data line $DR_2$ is started, it should be noted that the output node $S_2$ continues to be connected to the output of the output amplifier $\mathbf{17}_2$.

Further in succession, the R-pixel 3 connected to the data line $DR_4$ is driven. In detail, the control signals MUXSW4 and AMPOUTSW4 are activated together with the deactivation of the control signals MUXSW2 and AMPOUTSW2. With the activation of the control signals MUXSW4 and AMPOUTSW4, the output of the output amplifier $\mathbf{17}_2$ is connected to the output node $S_4$. Thus, the data line $DR_4$ is connected through the time divisional switch $\mathbf{5}_{R4}$ of the demultiplexer 5 and the switch 19*d* of the demultiplexer 19 to the output of the output amplifier $\mathbf{17}_2$. Then, the drive voltage corresponding to the pixel data $X_{R4}$ is supplied to the data line $DR_4$. The supplied drive voltage is written to the R-pixel 3 connected to the data line $DR_4$. Similarly to the moment when the driving of the R-pixel 3 connected to the data line $DR_3$ is started, it should be noted that at the moment when the driving of the R-pixel 3 connected to the data line $DR_4$ is started, the output node $S_3$ continues to be connected to the output of the output amplifier $\mathbf{17}_1$.

Following the completion of the driving of the R-pixels 3, the G-pixels 3 connected to the scanning line $G_1$ and the data lines $DG_1$ to $DG_4$ are driven. In detail, after the activation of the control signal GSW, the control signals MUXSW4, MUXSW3, MUXSW2 and MUXSW1 are sequentially activated in this order. Also, the control signals AMPOUTSW4, AMPOUTSW3, AMPOUTSW2 and AMPOUTSW1 are sequentially activated in this order. Thus, the G-pixels 3 connected to the data lines $DG_1$ to $DG_4$ are driven by the corresponding output amplifiers 17. Then, a desirable drive voltage is written to each G-pixel 3. Similarly to the driving of the R-pixel 3, it should be noted that at the moment when the driving of the G-pixel 3 connected to the data line $DG_3$ is started, the output node $S_4$ is connected to the output of the output amplifier $\mathbf{17}_2$, and at the moment when the driving of the G-pixel 3 connected to the data line $DG_2$ is started, the output node $S_3$ is connected to the output of the output amplifier $\mathbf{17}_1$, and at the moment when the driving of the G-pixel 3 connected to the data line $DG_1$ is started, the output node $S_2$ is connected to the output of the output amplifier $\mathbf{17}_2$.

Finally, the B-pixels 3 connected to the scanning line $G_1$ and the data lines $DB_1$ to $DB_4$ are driven. In detail, after the activation of the control signal BSW, the control signals MUXSW1, MUXSW2, MUXSW3 and MUXSW4 are sequentially activated in this order. Also, the control signals AMPOUTSW1, AMPOUTSW2, AMPOUTSW3 and AMPOUTSW4 are sequentially activated in this order. Thus, the B-pixels 3 connected to the data lines $DB_1$ to $DB_4$ are driven by the corresponding output amplifiers 17. Then, the desirable drive voltage is written to each B-pixel 3. Similarly to the driving of the R-pixels 3, it should be noted that at the moment when the driving of the B-pixel 3 connected to the data line $DB_2$ is started, the output node $S_1$ is connected to the output of the output amplifier $\mathbf{17}_1$, and at the moment when the driving of the B-pixel 3 connected to the data line $DB_3$ is started, the output node S2 is connected to the output of the output amplifier $\mathbf{17}_2$, and at the moment when the driving of the B-pixel 3 connected to the data line $DB_4$ is started, the output node $S_3$ is connected to the output of the output amplifier $\mathbf{17}_1$.

Even in the second horizontal period, the pixels 3 connected to the scanning line $G_2$ are driven in accordance with the similar procedure. However, in the second horizontal period, the pixels 3 connected to the scanning line $G_2$ are driven in the order of the B-pixel, the G-pixel and the R-pixel. When the B-pixel 3 is driven, the control signal BSW continues to be successively active from the first horizontal period. The time divisional switches $\mathbf{5}_{B1}$ to $\mathbf{5}_{B4}$ of the demultiplexer 5 in the liquid crystal display panel 1 are not turned off. The data lines $DB_1$ to $DB_4$ continue to be connected to the source lines $S_1$ to $S_4$ even after the first horizontal period. According to the foregoing operation, it is possible to reduce the switching numbers of the $\mathbf{5}B_1$ to $\mathbf{5}B_4$ of the demultiplexer 5 and also possible to decrease the electric power consumption of the liquid crystal display panel 1.

In detail, when the second horizontal period is started, the control signals BSW, BSEL, MUXSW4 and AMPOUTSW4 are active. At first, in synchronization with the deactivation (pull-up) of the horizontal synchronization signal HSYNC, the latch signal STB is activated. Consequently, the pixel data for specifying the gradation of the pixel 3 connected to the scanning line $G_2$ is latched by the register 12. At this time, the control signals BSEL, MUXSW4 and AMPOUTSW4 are active. Thus, the pixel data $X_{B4}$ corresponding to the B-pixel 3 connected to the data line $DB_4$ is sent to the D/A converter $\mathbf{15}_2$. Moreover, the same drive voltage as the gradation voltage corresponding to the pixel data $X_{B4}$ is supplied from the output of the output amplifier $\mathbf{17}_2$ through the output node $S_4$ to the data line $DB_4$.

In succession, the scanning line $G_2$ is activated. Consequently, the drive voltage corresponding to the pixel data $X_{B4}$ is written to the B-pixel 3 connected to the data line $DB_4$.

In succession, the control signals MUXSW3, MUXSW2 and MUXSW1 are sequentially activated in this order. Also, the control signals AMPOUTSW3, AMPOUTSW2 and AMPOUTSW1 are sequentially activated in this order. Thus, the B-pixels 3 connected to the data lines $DB_3$, $DB_2$ and $DB_1$ are driven by the corresponding output amplifiers 17, and the desirable drive voltage is written to each B-pixel 3. It should be noted that at the moment when the driving of the B-pixel 3 connected to the data line $DB_3$ is started, the output node $S_4$ is connected to the output of the output amplifier $\mathbf{17}_2$, and at the moment when the driving of the B-pixel 3 connected to the data line $DB_2$ is started, the output node $S_3$ is connected to the output of the output amplifier $\mathbf{17}_1$, and at the moment when the driving of the B-pixel 3 connected to the data line $DB_1$ is started, the output node $S_2$ is connected to the output of the output amplifier $\mathbf{17}_2$.

After the completion of the driving of the B-pixels 3, the G-pixels 3 connected to the data lines $DG_1$ to $DG_4$ are driven. In detail, the control signals MUXSW1, MUXSW2, MUXSW3 and MUXSW4 are sequentially activated in this order. Also, the control signals AMPOUTSW1, AMPOUTSW2, AMPOUTSW3 and AMPOUTSW4 are sequentially activated in this order. Thus, the G-pixels 3 connected to the data lines $DG_1$ to $DG_4$ are driven by the corresponding output amplifiers 17, and the desirable drive voltage is written to each G-pixel 3. It should be noted that at the moment when the driving of the G-pixel 3 connected to the data line $DG_2$ is started, the output node $S_1$ is connected to the output of the output amplifier $\mathbf{17}_1$, and at the moment when the driving of the G-pixel 3 connected to the data line $DG_3$ is started, the output node $S_2$ is connected to the output of the output amplifier $\mathbf{17}_2$, and at the moment when the driving of the G-pixel 3 connected to the data line $DG_4$ is started, the output node $S_3$ is connected to the output of the output amplifier $\mathbf{17}_1$.

After the completion of the driving of the G-pixels 3, the R-pixels 3 connected to the data lines $DR_1$ to $DR_4$ are driven. In detail, the control signals MUXSW4, MUXSW3, MUXSW2 and MUXSW1 are sequentially activated in this order. Also, the control signals AMPOUTSW4, AMPOUTSW3, AMPOUTSW2 and AMPOUTSW1 are sequentially activated in this order. Thus, the R-pixels 3 connected to the data lines $DR_1$ to $DR_4$ are driven by the corresponding output amplifiers 17, and the desirable drive voltage is written to each R-pixel 3. It should be noted that at the moment when the driving of the R-pixel 3 connected to the data line $DR_3$ is started, the output node $S_4$ is connected to the output of the output amplifier $\mathbf{17}_2$, and at the moment when the driving of the R-pixel 3 connected to the data line $DR_2$ is started, the output node $S_3$ is connected to the output of the output amplifier $\mathbf{17}_1$, and at the moment when the driving of the R-pixel 3 connected to the data line $DR_1$ is started, the output node S2 is connected to the output of the output amplifier $\mathbf{17}_2$.

Hereinafter, in the odd-numbered horizontal periods, the pixels 3 are driven similarly to the first horizontal period, and in the even-numbered horizontal periods, the pixels 3 are driven similarly to the second horizontal period.

One problem of the operation in FIG. 13 lies in the point that since the output nodes $S_1$ to $S_4$ are simply repeatedly arranged, and the earliest-driven output node S (for example, the output node $S_1$) and the latest-driven output node S (for example, the output node $S_4$) are adjacent to each other, the capacitance coupling between them causes the variation in the voltage level of the latest-driven output node S to involve the variation in the voltage level of the earliest-driven output node S. For example, in the operation in FIG. 13, when the R-pixels 3 are driven in the first horizontal period, the output nodes $S_1$, $S_2$, $S_3$ and $S_4$ are sequentially driven in this order. FIG. 12 shows only the four output nodes $S_1$ to $S_4$. However, in the actual liquid crystal display apparatus, the output node $S_1$ is provided adjacent to the output node $S_4$. Thus, the variation in the voltage level when the output node $S_4$ is driven involves the variation in the voltage level of the output node $S_1$.

Figure 14:
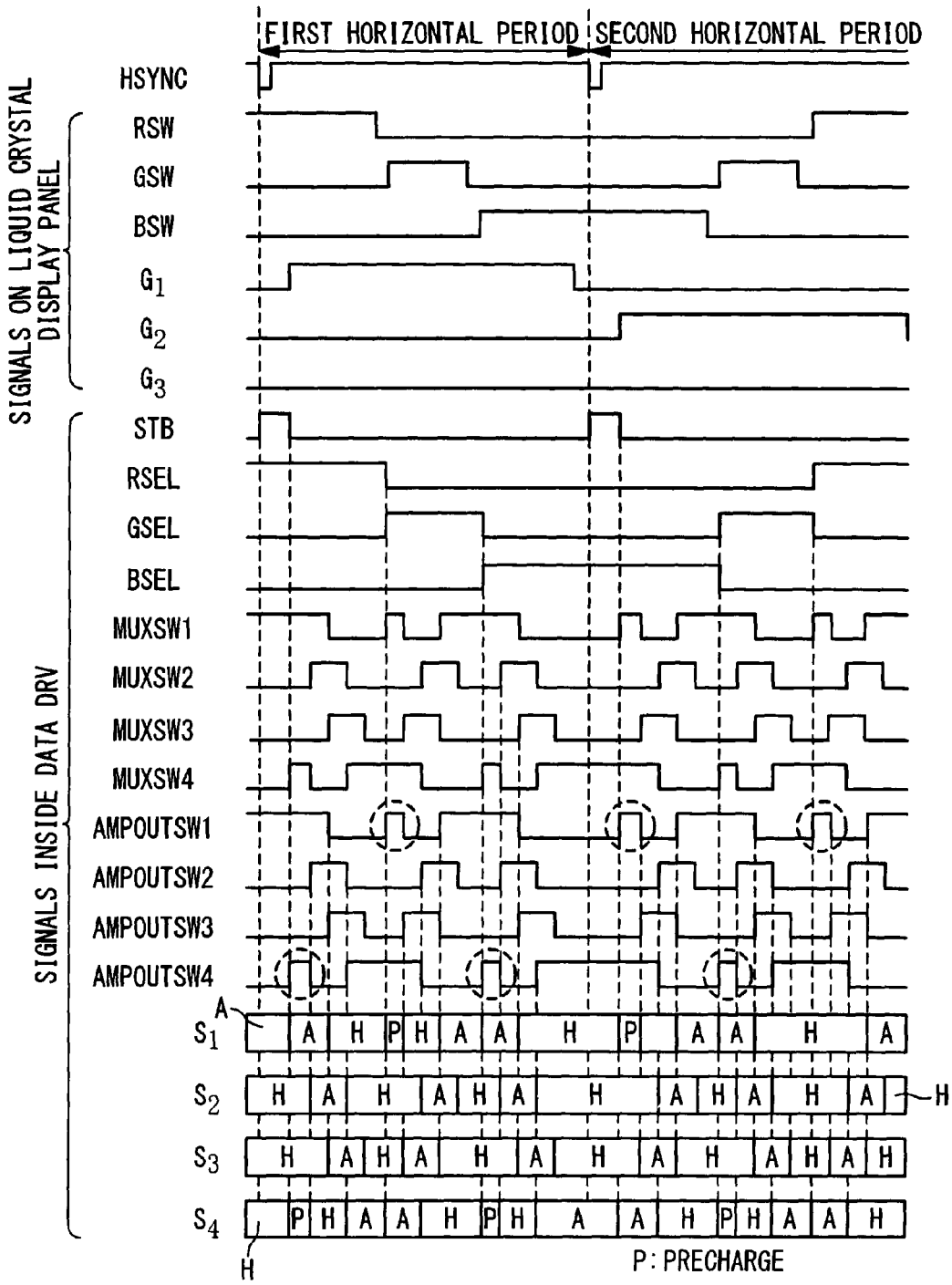
FIG. 14 is timing charts showing the preferable operation of the liquid crystal display apparatus in the third embodiment.

FIG. 14 shows the operation of the liquid crystal display apparatus 10B that is preferable for suppressing the variation in the voltage level of the output node s as mentioned above. In the operation of FIG. 14, when the output nodes $S_1$, $S_2$, $S_3$ and $S_4$ are sequentially driven in this order, the output node $S_4$ is pre-charged at the time of the driving of the output node $S_1$. A symbol "P" in the timing chart of FIG. 14 indicates that the output nodes $S_1$, $S_4$ are pre-charged. The pre-charged voltage (the pre-charge voltage) is equal to the drive voltage when the pixel 3 is driven after that. Since the output node $S_4$ is pre-charged, the variation in the voltage level when the output node $S_4$ is driven becomes small, which suppresses the variation in the voltage level of the adjacent output node $S_1$. Similarly, when the output nodes $S_4$, $S_3$, $S_2$ and $S_1$ are sequentially driven in this order, the output node $S_1$ is pre-charged at the time of the driving of the output node $S_4$. Since the output node $S_1$ is pre-charged, the variation in the voltage level when the output node $S_1$ is driven becomes small, which suppresses the variation in the voltage level of the adjacent output node $S_4$. The operation of the liquid crystal display apparatus 10B in FIG. 4 will be described below in detail.

When the first horizontal period is started, the control signals RSW, RSEL, MUXSW1 and AMPOUTSW1 are active. That is, the output node $S_1$ is in the situation that it is driven by the output amplifier $\mathbf{17}_1$. On the other hand, all of the scanning lines G are inactive, and the pixel electrode 3*b* of the pixel 3 is disconnected from the data line D. Thus, although the output node $S_1$ is driven by the output amplifier $\mathbf{17}_1$, any of the pixels 3 is not driven.

At first, the R-pixels 3 connected to the scanning line $G_1$ and the data lines $DR_1$ to $DR_4$ are driven. The driving of the R-pixels 3 is performed as follows. In synchronization with the deactivation (pull-up) of the horizontal synchronization signal HSYNC, the latch signal STB is activated. With this, the pixel data for specifying the gradation of the pixel 3 connected to the scanning line $G_1$ is latched by the register 12. At this time, since the control signals RSEL, MUXSW1 and AMPOUTSW1 are active, the pixel data $X_{R1}$ corresponding to the R-pixel 3 connected to the data line $DR_1$ is sent to the D/A converter $\mathbf{15}_1$. Moreover, the output of the output node $S_1$ is driven to the same drive voltage as the gradation voltage corresponding to the pixel data $X_{R1}$ by the output amplifier $\mathbf{17}_1$.

When the output node $S_1$ is driven by the output amplifier $\mathbf{17}_1$, the output node $S_4$ is pre-charged at the same time. In FIG. 14, it should be noted that the situation in which the output node S is pre-charged is indicated by a symbol [P]. In detail, the control signals MUXSW4 and AMPOUTSW4 are activated. Consequently, the pixel data $X_{R4}$ corresponding to the R-pixel 3 connected to the data line $DR_4$ is sent to the D/A converter $\mathbf{15}_2$, and the output node $S_4$ is pre-charged to the same pre-charge voltage as the gradation voltage corresponding to the pixel data $X_{R4}$ by the output amplifier $\mathbf{17}_2$. When the pre-charge has been completed, the control signals MUXSW4 and AMPOUTSW4 are deactivated.

In succession, the scanning line $G_1$ is activated. Consequently, the drive voltage corresponding to the pixel data $X_{R1}$ is written to the R-pixel 3 connected to the data line $DR_1$. Then, the driving of the R-pixel 3 connected to the data line $DR_1$ has been completed. Simultaneously with this, the output node $S_4$ is pre-charged to the voltage level corresponding to the pixel data $X_{R4}$, and the drive voltage corresponding to the pixel data $X_{R4}$ is written to the R-pixel 3 connected to the data line $DR_4$.

In succession, the control signals MUXSW2, MUXSW3 and MUXSW4 are sequentially activated in this order. Also, the control signals AMPOUTSW2, AMPOUTSW3 and AMPOUTSW4 are sequentially activated in this order. Thus, the R-pixels 3 connected to the data lines $DR_2$, $DR_3$ and $DR_4$ are driven by the corresponding output amplifiers 17, and the desirable drive voltage is written to each R-pixel 3. When the driving of the R-pixels 3 has been completed, the control signal RSW is deactivated. It should be noted that, even if the driving of the R-pixels 3 has been completed, the activation of the control signals MUXSW4 and AMPOUTSW4 are continued.

The output node $S_4$ is pre-charged in advance. Thus, the variation in the voltage level of the output node $S_4$ is small when the R-pixel 3 connected to the data line $DR_4$ is driven. Therefore, the variation in the voltage level of the output node $S_1$ adjacent to the output node $S_4$ is also small.

After the completion of the driving of the R-pixels 3, the G-pixels 3 connected to the scanning line $G_1$ and the data lines $DG_1$ to $DG_4$ are driven. Specifically, at first, the control signal GSEL is activated together with the deactivation of the control signal RSEL. The control signals MUXSW4 and AMPOUTSW4 continue to be active. Thus, with the activation of the control signal GSEL, the output node $S_4$ is driven to the same drive voltage as the gradation voltage corresponding to the pixel data $X_{R4}$ by the output amplifier $\mathbf{17}_2$.

When the output node $S_4$ is driven by the output amplifier $\mathbf{17}_2$, the output node $S_1$ is pre-charged at the same time. In detail, the control signals MUXSW1 and AMPOUTSW1 are activated. Consequently, the pixel data $X_{G1}$ corresponding to the G-pixel 3 connected to the data line $DG_1$ is sent to the D/A converter $\mathbf{15}_1$. Then, the output node $S_1$ is pre-charged to the same pre-charge voltage as the gradation voltage corresponding to the pixel data $X_{G1}$ by the output amplifier $\mathbf{17}_1$. When the pre-charge has been completed, the control signals MUXSW1 and AMPOUTSW1 are deactivated.

In succession, the control signal GSW is activated. The data lines $DG_1$ to $DG_4$ are electrically connected to the output nodes $S_1$ to $S_4$, respectively. Thus, the drive voltage corresponding to the pixel data $X_{G4}$ is written to the G-pixel 3 connected to the data line $DG_4$. Simultaneously, the output node $S_1$ is pre-charged to the voltage level corresponding to the pixel data $X_{G1}$. Then, the drive voltage corresponding to the pixel data $X_{G1}$ is written to the G-pixel 3 connected to the data line $DG_1$.

In succession, the control signals MUXSW3, MUXSW2 and MUXSW1 are sequentially activated in this order. Also, the control signals AMPOUTSW3, AMPOUTSW2 and AMPOUTSW1 are sequentially activated in this order. Thus, the G-pixels 3 connected to the data lines $DG_3$, $DG_2$ and $DG_1$ are driven by the corresponding output amplifiers 17, and a desirable drive voltage is written to each G-pixel 3. When the driving of the G-pixels 3 has been completed, the control signal GSW is deactivated. It should be noted that, even if the driving of the G-pixels 3 is completed, the active states of the control signals MUXSW1 and AMPOUTSW1 are continued.

Since the output node $S_1$ is pre-charged in advance, the variation in the voltage level of the output node $S_1$ is small when the G-pixel 3 connected to the data line $DG_1$ is driven. Thus, the variation in the voltage level of the output node $S_4$ adjacent to the output node $S_1$ is small.

After the completion of the driving of the G-pixels 3, the B-pixels 3 connected to the scanning line $G_1$ and the data lines $DB_1$ to $DB_4$ are driven. Specifically, at first, the control signal GSEL is deactivated, and the control signal BSEL is activated. The control signals MUXSW1 and AMPOUTSW1 continue to be active. Thus, with the activation of the control signal BSEL, the output node $S_1$ is driven to the same drive voltage as the gradation voltage corresponding to the pixel data $X_{B1}$ by the output amplifier $\mathbf{17}_1$.

When the output node $S_1$ is driven by the output amplifier $\mathbf{17}_1$, the output node $S_4$ is pre-charged at the same time. In detail, the control signals MUXSW4 and AMPOUTSW4 are activated. Thus, the pixel data $X_{B4}$ corresponding to the B-pixel 3 connected to the data line $DB_4$ is sent to the D/A converter $\mathbf{15}_2$. Then, the output node $S_4$ is pre-charged to the same pre-charge voltage as the gradation voltage corresponding to the pixel data $X_{B4}$ by the output amplifier $\mathbf{17}_2$. When the pre-charge has been completed, the control signals MUXSW4 and AMPOUTSW4 are deactivated.

In succession, the control signal BSW is activated. The data lines $DB_1$ to $DB_4$ are electrically connected to the output nodes $S_1$ to $S_4$, respectively. Thus, the drive voltage corresponding to the pixel data $X_{B1}$ is written to the B-pixel 3 connected to the data line $DB_1$. Simultaneously, the output node $S_4$ is pre-charged to the voltage level corresponding to the pixel data $X_{B4}$. Then, the drive voltage corresponding to the pixel data $X_{B4}$ is written to the B-pixel 3 connected to the data line $DB_4$.

In succession, the control signals MUXSW2, MUXSW3 and MUXSW4 are sequentially activated in this order. Also, the control signals AMPOUTSW2, AMPOUTSW3 and AMPOUTSW4 are sequentially activated in this order. Thus, the B-pixels 3 connected to the data lines $DB_2$, $DB_3$ and $DB_4$ are driven by the corresponding output amplifiers 17, and a desirable drive voltage is written to each B-pixel 3.

In the second horizontal period, the pixels 3 connected to the scanning line $G_2$ are driven. The pixels 3 connected to the scanning line $G_2$ are driven in accordance with the same procedure by which the pixels 3 connected to the scanning line $G_1$ are driven, except a point that they are driven in the order of the B-pixel 3, the G-pixel 3 and the R-pixel 3. Hereinafter, in the odd-numbered horizontal periods, the pixels 3 are driven in accordance with the procedure similar to that of the first horizontal period, and in the even-numbered horizontal periods, the pixels 3 are driven in accordance with the procedure similar to that of the second horizontal period.

Similarly to the first embodiment, even in the third embodiment, the order when the output nodes S are driven is desired to be switched for each frame period. In this embodiment, when the R-pixels 3 are driven in the first horizontal period in the odd-numbered frame period, as shown in FIG. 14, the control signals AMPOUTSW1, AMPOUTSW2, AMPOUTSW3 and AMPOUTSW4 are activated in this order. As this result, the output nodes $S_1$ to $S_4$ are driven in the order of the output nodes $S_1$, $S_2$, $S_3$ and $S_4$. On the other hand, when the R-pixels 3 are driven in the first horizontal period in the even-numbered frame period, the control signals AMPOUTSW 1 to 4 are activated in the order of the control signals AMPOUTSW4, AMPOUTSW3, AMPOUTSW2 and AMPOUTSW1. As this result, the output nodes $S_1$ to $S_4$ are driven in the order of the output nodes $S_4$, $S_3$, $S_2$ and $S_1$. When the G-pixels 3 and the B-pixels 3 are driven, similarly, the order when the control signals AMPOUTSW 1 to 4 are activated is switched between the odd-numbered frame period and the even-numbered frame period. Even in the other horizontal periods, similarly, the order when the control signals AMPOUTSW 1 to 4 are activated is switched between the odd-numbered frame period and the even-numbered frame period. According to the foregoing operation, the times while the drive voltages are written to the pixels of the same color are averaged to be uniform, and thereby the generation of the flicker can be suppressed.

According to the operation shown in FIG. 14, when the driving of the output node $S_1$ is started, the output node $S_4$ is pre-charged. Or, when the driving of the output node $S_4$ is started, the output node $S_1$ is pre-charged. Consequently, the variation in the voltage level of the earliest-driven output node S among the output nodes $S_1$ to $S_4$ can be suppressed, thereby preventing the degradation in the image quality.

Figure 15A:
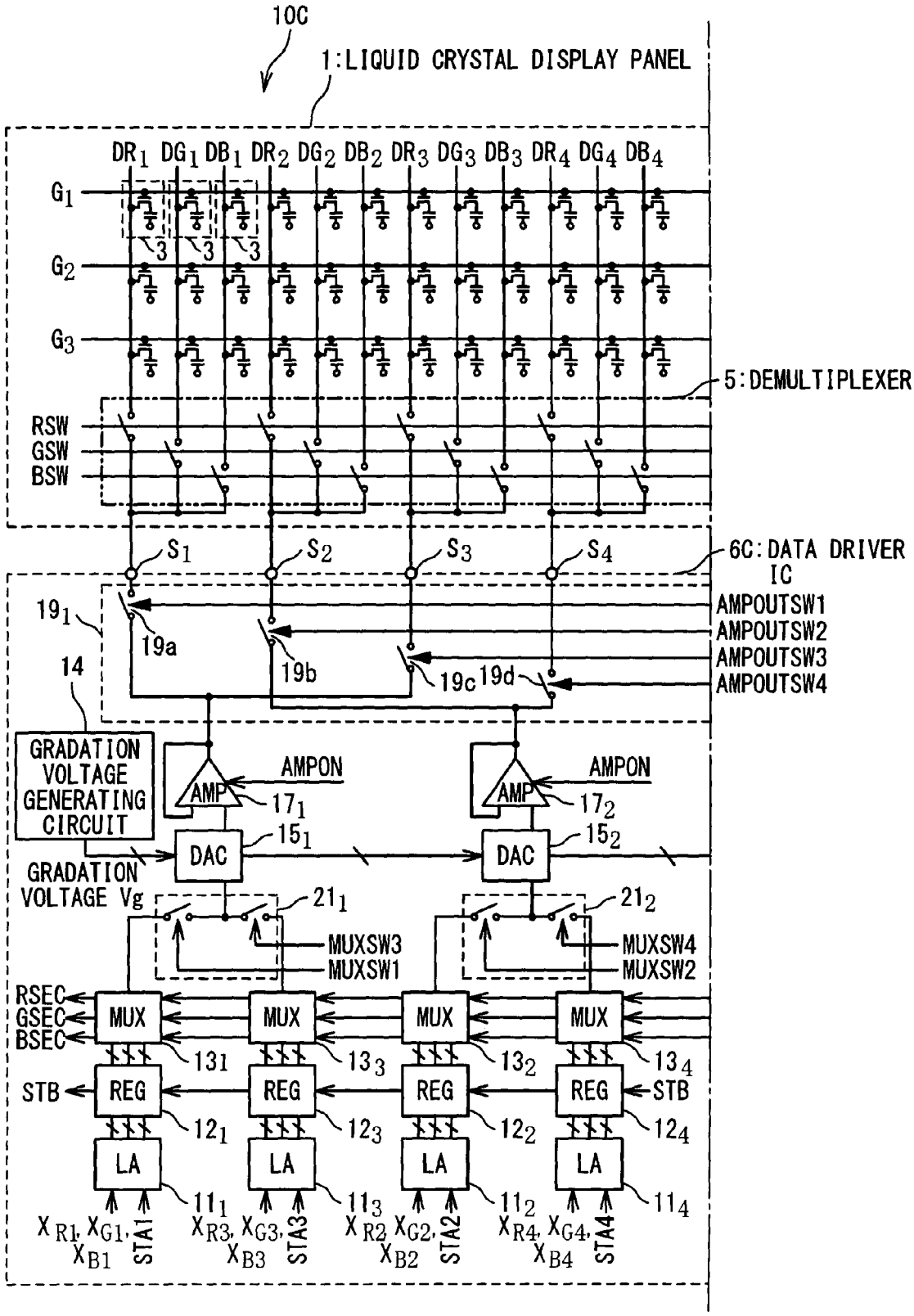
FIG. 15A is a block diagram showing a configuration of a modification of the liquid crystal display apparatus in the third embodiment.
Figure 15B:
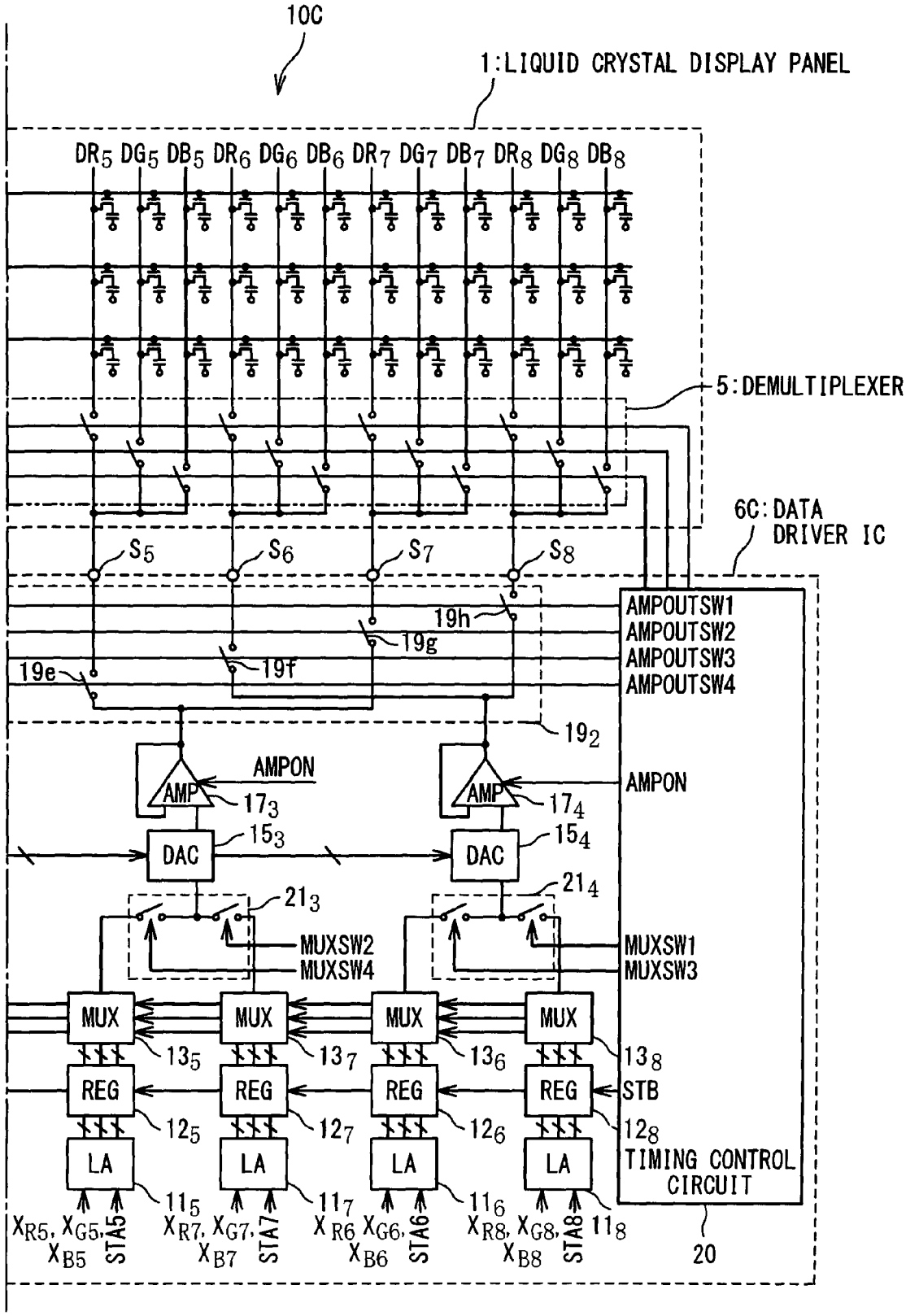
FIG. 15B is a block diagram showing a configuration of another modification of the liquid crystal display apparatus in the third embodiment.

Another method that suppresses the variation in the voltage level of the earliest-driven output node S among the output nodes S is to prevent the earliest-driven output node S from being located adjacent to the latest-driven output node S. FIGS. 15A and 15B are block diagrams showing the configuration of a liquid crystal display apparatus 10C based on the foregoing method. It should be noted that in FIGS. 15A and 15B, the two drawings are used to indicate one liquid crystal display apparatus.

Figure 16:
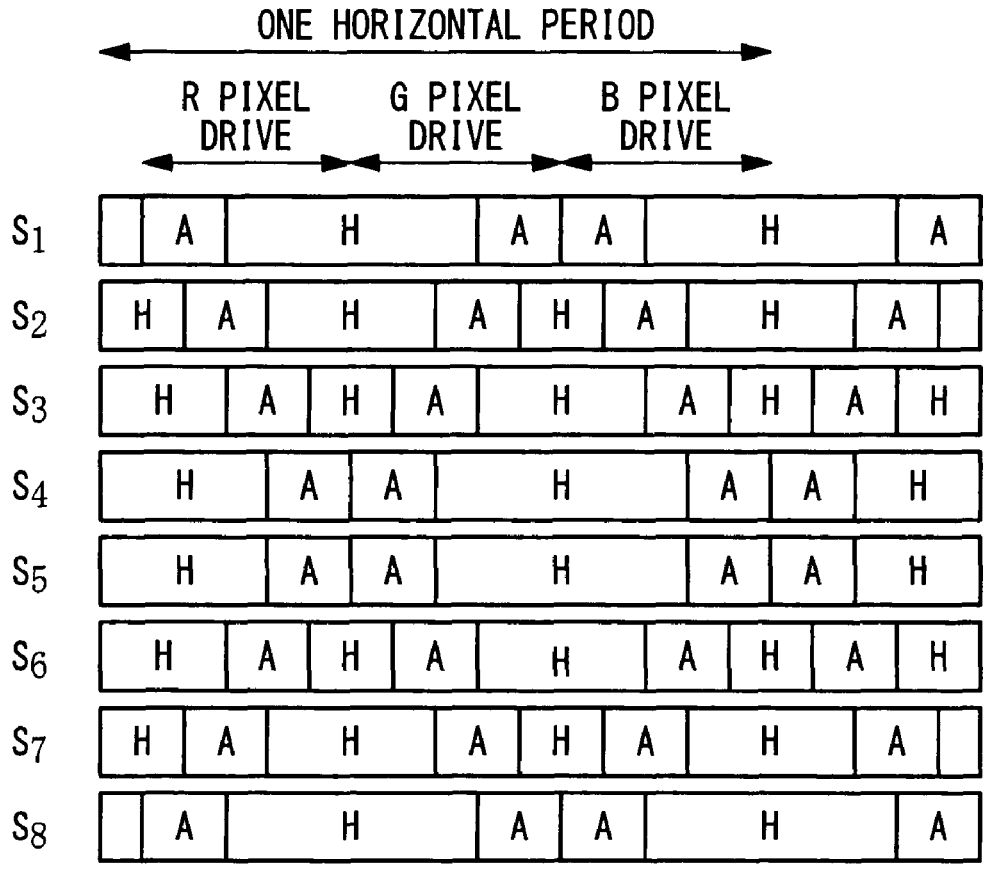
FIG. 16 is a diagram showing the operation procedure of the liquid crystal display apparatus shown in FIGS. 15A, 15B.

FIG. 16 is a diagram showing the procedure for driving the output nodes $S_1$ to $S_8$ of the liquid crystal display apparatus 10C in FIGS. 15A and 15B in a certain horizontal period. In the liquid crystal display apparatus 10C in FIGS. 15A and 15B, when the output nodes $S_1$ to $S_4$ are driven in the order of the output nodes $S_1$, $S_2$, $S_3$ and $S_4$ (for example, when the R-pixel is driven in FIG. 16), the output nodes $S_5$ to $S_8$ are driven in the order of the output nodes $S_8$, $S_7$, $S_6$ and $S_5$. That is, the earliest-driven output nodes $S_1$ and $S_8$ are located adjacent to each other and separated from the latest-driven output nodes $S_4$ and $S_5$. On the other hand, the liquid crystal display apparatus 10C is designed in such a manner that, when the output nodes $S_1$ to $S_4$ are driven in the order of the output nodes $S_4$, $S_3$, $S_2$ and $S_1$ (for example, when the G-pixel is driven in FIG. 16), the output nodes $S_5$ to $S_8$ are driven in the order of the output nodes $S_5$, $S_6$, $S_7$ and $S_8$. According to such a procedure, without making the earliest-driven output node S adjacent to the latest-driven output node S, it is possible to drive the output node S. The configuration and operation of the liquid crystal display apparatus 10C shown in FIGS. 15A and 15B will be described below in detail.

In the configuration of the liquid crystal display apparatus 10C in FIGS. 15A and 15B, although the circuit group for driving the output nodes $S_1$ to $S_4$ is configured similarly to FIG. 12, the circuit group for driving the output nodes $S_5$ to $S_8$ has the configuration symmetrical with the circuit group for driving the output nodes $S_1$ to $S_4$, with respect to a mirror plane. Specifically, a multiplexer $\mathbf{21}_3$, which operates in response to the control signals MUXSW2 and MUXSW4, is connected to the outputs of the multiplexers $\mathbf{13}_5$ and $\mathbf{13}_{37}$, and a multiplexer $\mathbf{21}_4$, which operates in response to the control signals MUXSW1 and MUXSW3, is connected to the outputs of the multiplexers $\mathbf{13}_2$ and $\mathbf{13}_4$. The multiplexer $\mathbf{21}_3$ connects the output of the multiplexer $\mathbf{13}_5$ to the input of the D/A converter $\mathbf{15}_3$ when the control signal MUXSW4 is activated, and connects the output of the multiplexer $\mathbf{13}_7$ to the input of the D/A converter $\mathbf{15}_3$ when the control signal MUXSW2 is activated. On the other hand, the multiplexer $\mathbf{21}_4$ connects the output of the multiplexer $\mathbf{13}_6$ to the input of the D/A converter $\mathbf{15}_4$ when the control signal MUXSW3 is activated, and connects the output of the multiplexer $\mathbf{13}_8$ to the input of the D/A converter $\mathbf{15}_4$ when the control signal MUXSW1 is activated.

A demultiplexer $\mathbf{19}_2$ for switching the connection relation between the output amplifier $\mathbf{17}_3$ and the output nodes $S_5$ and $S_7$ and further switching the connection relation between the output amplifier $\mathbf{17}_4$ and the output nodes $S_6$ and $S_8$ is provided for the outputs of the output amplifiers $\mathbf{17}_3$ and $\mathbf{17}_4$. The demultiplexer $\mathbf{19}_2$ includes switches 19*e*, 19*f*, 19*g* and 19*h*, which are turned on or off in response to the control signals AMPOUTSW4, AMPOUTSW3, AMPOUTSW2 and AMPOUTSW1, respectively. The output of the output amplifier $\mathbf{17}_3$ is connected to the output node $S_5$ when the control signal AMPOUTSW4 is activated, and connected to the output node $S_7$ when the control signal AMPOUTSW2 is activated. On the other hand, the output of the output amplifier $\mathbf{17}_4$ is connected to the output node $S_6$ when the control signal AMPOUTSW3 is activated, and connected to the output node $S_1$ when the control signal AMPOUTSW1 is activated.

In the configuration of FIGS. 15A and 15B, it should be noted that, when the control signals MUXSW4 and AMPOUTSW4 are activated, the output nodes $S_4$ and $S_5$ provided adjacent to each other are driven at the same time. When the control signal MUXSW4 is activated, the output of the multiplexer $\mathbf{13}_4$ is connected to the input of the D/A converter $\mathbf{15}_2$, and the output of the multiplexer $\mathbf{13}_5$ is connected to the input of the D/A converter $\mathbf{15}_3$. In addition, when the control signal AMPOUTSW4 is activated, the output of the output amplifier $\mathbf{17}_2$ is connected to the output node $S_4$ and driven, and the output of the output amplifier $\mathbf{17}_3$ is connected to the output node $S_5$ and driven.

Similarly, it should be noted that, when the control signals MUXSW1 and AMPOUTSW1 are activated, the output nodes $S_1$ and $S_8$ are driven at the same time, and when the control signals MUXSW2 and AMPOUTSW2 are activated, the output nodes $S_2$ and $S_7$ are driven at the same time, and when the control signals MUXSW3 and AMPOUTSW3 are activated, the output nodes $S_3$ and $S_6$ are driven at the same time.

Figure 17A:
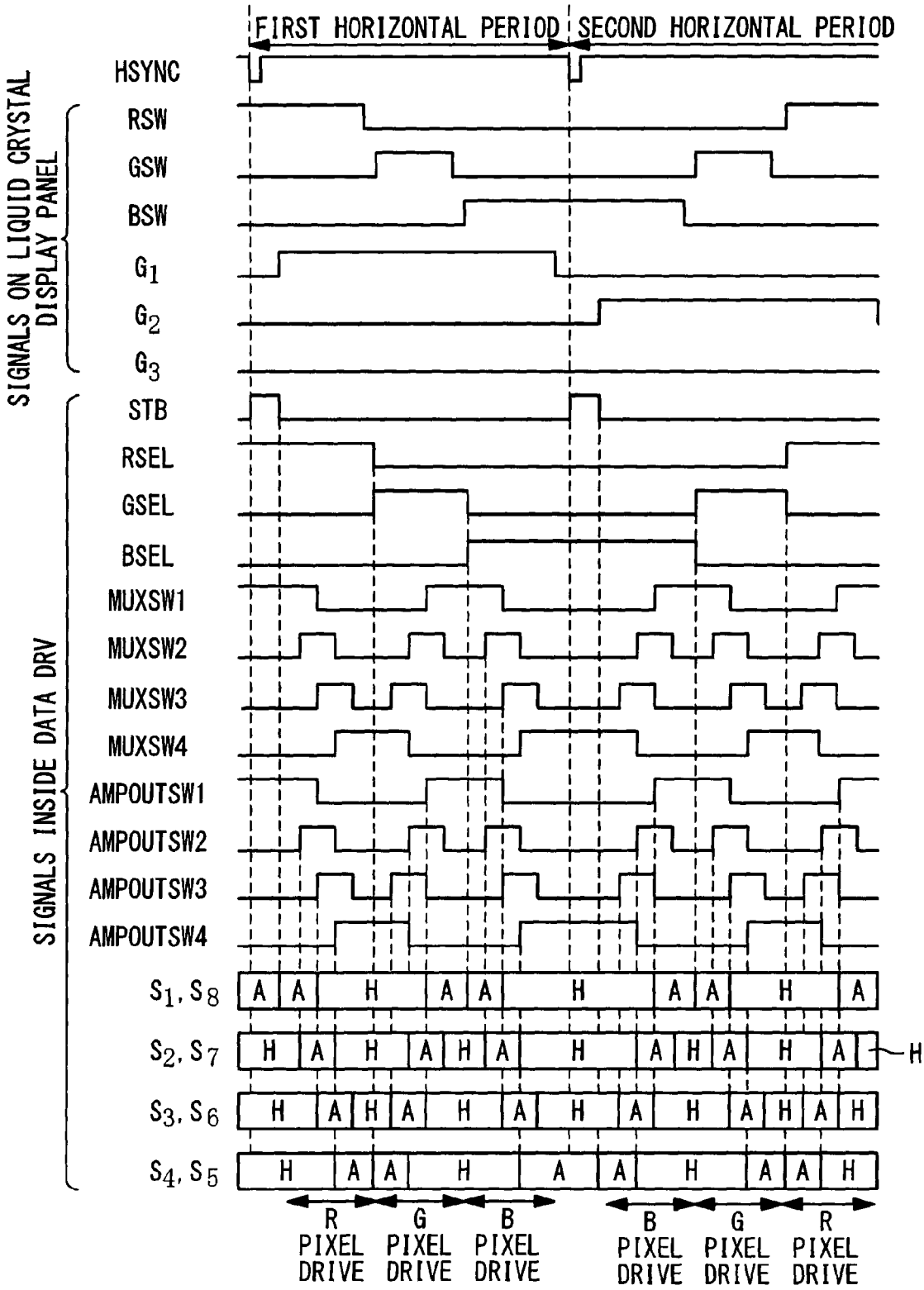
FIG. 17A is timing charts showing the operation of the liquid crystal display apparatus shown in FIGS. 15A, 15B.

FIG. 17A is timing charts showing the operation of the liquid crystal display apparatus 10C in FIGS. 15A and 15B. In the operation in FIG. 17A, although the operation of the circuit group corresponding to the output nodes $S_1$ to $S_4$ is similar to FIG. 12, the circuit group corresponding to the output nodes $S_5$, $S_6$, $S_7$ and $S_8$ operates similarly to the circuit group corresponding to the output nodes $S_4$, $S_3$, $S_2$ and $S_1$. The operation of the liquid crystal display apparatus 10C in FIG. 15B will be specifically described below.

When the first horizontal period is started, the control signals RSW, RSEL, MUXSW1 and AMPOUTSW1 are active. That is, the output nodes $S_1$ and $S_8$ are in the situation that they are driven by the output amplifiers $\mathbf{17}_1$ and $\mathbf{17}_4$, respectively. On the other hand, all of the scanning lines G are inactive, and the pixel electrode 3*b* of the pixel 3 is disconnected from the data line D. Thus, although the output nodes $S_1$ and $S_8$ are connected to the output amplifiers $\mathbf{17}_1$ and $\mathbf{17}_4$ and further the data lines $DR_1$ to $DR_8$ are electrically connected to the output nodes $S_1$ to $S_8$, respectively, any of the pixels 3 is not driven.

When the first horizontal period is started, at first, the R-pixels 3 connected to the scanning line $G_1$ and the data lines $DR_1$ to $DR_8$ are driven. The driving of the R-pixels 3 is performed as follows. In synchronization with the deactivation (pull-up) of the horizontal synchronization signal HSYNC, the latch signal STB is activated. At this time, since the control signals RSEL, MUXSW1 and AMPOUTSW1 are active, the pixel data $X_{R1}$ corresponding to the R-pixel 3 connected to the data line $DR_1$ is sent to the D/A converter $\mathbf{15}_1$, and the pixel data $X_{R8}$ corresponding to the R-pixel 3 connected to the data line $DR_8$ is sent to the D/A converter $\mathbf{15}_4$. Thus, the output node $S_1$ is driven to the same drive voltage as the gradation voltage corresponding to the pixel data $X_{R1}$, and the output node $S_8$ is driven to the same drive voltage of the gradation voltage corresponding to the pixel data $X_{RB}$.

In succession, the scanning line $G_1$ is activated. Consequently, the drive voltages corresponding to the pixel data $X_{R1}$ and $X_{R8}$ are written to the R-pixels 3 connected to the data lines $DR_1$ and $DR_8$.

In succession, the R-pixels 3 connected to the data lines $DR_2$ and $DR_7$ are driven. In detail, the control signals MUXSW2 and AMPOUTSW2 are activated, and the output of the output amplifier $\mathbf{17}_2$ is connected to the output node $S_2$, and the output of the output amplifier $\mathbf{17}_3$ is connected to the output node $S_7$. Consequently, the data line $DR_2$ is connected through the time divisional switch $\mathbf{5}_{R2}$ of the demultiplexer 5 and the switch 19*b* of the demultiplexer $\mathbf{19}_1$ to the output of the output amplifier $\mathbf{17}_2$, and the data line $DR_7$ is connected through the time divisional switch $\mathbf{5}_{R7}$ of the demultiplexer 5 and the switch 19*g* of the demultiplexer $\mathbf{19}_2$ to the output of the output amplifier $\mathbf{17}_3$. Thus, the drive voltage corresponding to the pixel data $X_{R2}$ is supplied to the data line $DR_2$, and the drive voltage corresponding to the pixel data $X_{R7}$ is supplied to the data line $DR_7$. The supplied drive voltages are written to the R-pixels 3 connected to the data lines $DR_2$ and $DR_7$, respectively. It should be noted that at the moment when the driving of the R-pixels 3 connected to the data lines $DR_2$ and $DR_7$ are started, the output nodes $S_1$ and $S_8$ are connected to the outputs of the output amplifiers $\mathbf{17}_1$ and $\mathbf{17}_4$, respectively. According to the foregoing operation, when the output nodes $S_2$ and $S_7$ are driven by the output amplifiers $\mathbf{17}_2$ and $\mathbf{17}_3$ and then the voltage levels of the output nodes $S_2$ and $S_7$ are varied, the voltage levels of the output nodes $S_1$ and $S_8$ are immediately returned to the desirable voltage levels by the output amplifiers $\mathbf{17}_1$ and $\mathbf{17}_4$ even if the voltage levels of the adjacent output nodes $S_1$ and $S_1$ are varied by the influence of the crosstalk. Therefore, the voltage levels of the output nodes $S_1$ and $S_8$ do not receive the influence of the variation in the voltage levels of the adjacent output nodes $S_2$ and $S_7$.

In succession, the R-pixels 3 connected to the data lines $DR_3$ and $DR_6$ are driven. In detail, together with the deactivation of the control signals MUXSW1 and AMPOUTSW1, the control signals MUXSW3 and AMPOUTSW3 are activated. With the activation of the control signals MUXSW3 and AMPOUTSW3, the output of the output amplifier $\mathbf{17}_1$ is connected to the output node $S_3$, and the output of the output amplifier $\mathbf{17}_4$ is connected to the output node $S_6$. Thus, the data line $DR_3$ is connected through the time divisional switch $\mathbf{5}_{R3}$ of the demultiplexer 5 and the switch 19*c* of the demultiplexer $\mathbf{19}_1$ to the output of the output amplifier $\mathbf{17}_1$, and the data line $DR_6$ is connected through the time divisional switch $\mathbf{5}_{R6}$ of the demultiplexer 5 and the switch 19*f* of the demultiplexer $\mathbf{19}_2$ to the out of the output amplifier $\mathbf{17}_4$. Therefore, the drive voltage corresponding to the pixel data $X_{R3}$ is supplied to the data line $DR_3$, and the drive voltage corresponding to the pixel data $X_{R6}$ is supplied to the data line $DR_6$. The supplied drive voltages are written to the R-pixels 3 connected to the data lines $DR_3$ and $DR_6$, respectively.

Finally, the R-pixels 3 connected to the data lines $DR_4$ and $DR_5$ are driven. In detail, together with the deactivation of the control signals MUXSW2 and AMPOUTSW2, the control signals MUXSW4 and AMPOUTSW4 are activated. With the activation of the control signals MUXSW4 and AMPOUTSW4, the output of the output amplifier $\mathbf{17}_2$ is connected to the output node $S_4$, and the output of the output amplifier $\mathbf{17}_3$ is connected to the output node $S_5$. Thus, the data line $DR_4$ is connected through the time divisional switch $\mathbf{5}_{R4}$ of the demultiplexer 5 and the switch 19*d* of the demultiplexer 19 to the output of the output amplifier $\mathbf{17}_2$, and the data line $DR_5$ is connected through the time divisional switch $\mathbf{5}_{R5}$ of the demultiplexer 5 and the switch 19*e* of the demultiplexer 19 to the output of the output amplifier $\mathbf{17}_3$. Therefore, the drive voltage corresponding to the pixel data $X_{R4}$ is supplied to the data line $DR_4$, and the drive voltage corresponding to the pixel data $X_{R5}$ is supplied to the data line $DR_5$. The supplied drive voltages are written to the R-pixels 3 connected to the data lines $DR_4$ and $DR_5$, respectively.

When the R-pixels 3 connected to the data lines $DR_4$ and $DR_5$ are driven, the voltage levels of the output nodes $S_4$ and $S_5$ are varied. However, the variation in the voltage levels of the output nodes $S_4$ and $S_5$ has no influence on the voltage levels of the other output nodes S. The output nodes $S_4$ and $S_5$ are driven by the output amplifiers $\mathbf{17}_2$ and $\mathbf{17}_3$ at the same time. Thus, even if they receive the influence of the crosstalk caused by the capacitance coupling, they are immediately returned to desirable voltage levels by the output amplifiers $\mathbf{17}_2$ and $\mathbf{17}_3$. Thus, the output nodes $S_4$ and $S_5$ do not mutually receive the influences of the voltage levels. As for the adjacent output nodes $S_3$ and $S_6$, when the R-pixels 3 connected to the data lines $DR_4$ and $DR_5$ begin to be driven, the output nodes $S_3$ and $S_6$ are driven by the output amplifiers $\mathbf{17}_1$ and $\mathbf{17}_4$. Thus, they do not receive the influence of the variation in the voltage levels of the output nodes $S_4$ and $S_5$. Also, the other output nodes $S_1$, $S_2$, $S_7$ and $S_8$, do not receive the influence caused by the capacitance coupling, since being located away from the output nodes $S_4$ and $S_5$. In this way, the variation in the voltage levels of the output nodes $S_4$ and $S_5$ has no influence on the voltage levels of the other output nodes S.

When the driving of the R-pixels 3 has been completed, the G-pixels 3 connected to the scanning line $G_1$ and the data lines $DG_1$ to $DG_8$ are driven. In detail, after the activation of the control signal GSW, the control signals MUXSW4, MUXSW3, MUXSW2 and MUXSW1 are sequentially activated in this order. Also, the control signals AMPOUTSW4, AMPOUTSW3, AMPOUTSW2 and AMPOUTSW1 are sequentially activated in this order. Thus, the G-pixels 3 are driven in the order of the G-pixels 3 connected to the data lines $DG_4$ and $DG_5$; the G-pixels 3 connected to the data lines $DG_3$ and $DG_6$; the G-pixels 3 connected to the data lines $DG_2$ and $DG_7$; and the G-pixels 3 connected to the data lines $DG_1$ and $DG_8$. Similarly to the driving of the R-pixels 3, the output nodes $S_4$ and $S_5$ that are firstly driven are located away from the output nodes $S_1$ and $S_8$ that are finally driven. Thus, the output nodes $S_4$ and $S_5$ do not receive the influence of the variation in the voltage levels of the output nodes $S_1$ and $S_8$.

Finally, the B-pixels 3 connected to the scanning line $G_1$ and the data lines $DB_1$ to $DB_8$ are driven. In detail, after the activation of the control signal BSW, the control signals MUXSW1, MUXSW2, MUXSW3 and MUXSW4 are sequentially activated in this order. Also, the control signals AMPOUTSW1, AMPOUTSW2, AMPOUTSW3 and AMPOUTSW4 are sequentially activated in this order. Thus, the B-pixels 3 are driven in the order of the B-pixels 3 connected to the data lines $DB_1$ and $DB_8$; the B-pixels 3 connected to the data lines $DB_2$ and $DB_7$; the B-pixels 3 connected to the data lines $DB_3$ and $DB_6$; and the B-pixels 3 connected to the data lines $DB_4$ and $DB_5$. Similarly to the driving of the R-pixels 3, the output nodes $S_1$ and $S_8$ that are firstly driven are located away from the output nodes $S_4$ and $S_5$ that are finally driven. Thus, the output nodes $S_1$ and $S_8$ do not receive the influence of the variation in the voltage levels of the output nodes $S_4$ and $S_5$.

In the second horizontal period, the pixels 3 connected to the scanning line $G_2$ are driven. The pixels 3 connected to the scanning line $G_2$ are driven in accordance with the procedure similar to that of the driving of the pixels 3 connected to the scanning line $G_1$, except that they are driven in the order of the B-pixel 3, the G-pixel 3 and the R-pixel 3. Hereinafter, in the odd-numbered horizontal period, the pixels 3 are driven in accordance with the procedure similar to that of the first horizontal period, and in the even-numbered horizontal period, the pixels 3 are driven in accordance with the procedure similar to that of the second horizontal period.

Also, in the operation of FIG. 17A, the order when the output nodes S are driven is desired to be switched for each frame period. In the embodiment, when the R-pixels 3 are driven in the first horizontal period in the odd-numbered frame period, as shown in FIG. 17A, the control signals AMPOUTSW1, AMPOUTSW2, AMPOUTSW3 and AMPOUTSW4 are activated in this order. As this result, the output nodes $S_1$ to $S_4$ are driven in the order of the output nodes $S_1$, $S_2$, $S_3$ and $S_4$, and the output nodes $S_5$ to $S_8$ are driven in the order of the output nodes $S_8$, $S_7$, $S_6$ and $S_5$. On the other hand, when the R-pixels 3 are driven in the first horizontal period in the even-numbered frame period, the control signals AMPOUTSW 1 to 4 are activated in the order of the control signals AMPOUTSW4, AMPOUTSW3, AMPOUTSW2 and AMPOUTSW1. As this result, the output nodes $S_1$ to $S_4$ are driven in the order of the output nodes $S_4$, $S_3$, $S_2$ and $S_1$, and the output nodes $S_5$ to $S_8$ are driven in the order of the output nodes $S_5$, $S_6$, $S_7$ and $S_8$. When the G-pixels 3 and the B-pixels 3 are driven, the order when the control signals AMPOUTSW1 to AMPOUTSW4 are activated is switched between the odd-numbered frame period and the even-numbered frame period. Even in the other horizontal periods, similarly, the order when the control signals AMPOUTSW1 to AMPOUTSW4 are activated is switched between the odd-numbered frame period and the even-numbered frame period. According to the foregoing operation, the times while the drive voltages are written to the pixels of the same color are averaged to be uniform, and the generation of the flicker can be suppressed.

In this way, in the operation of FIG. 17A, the earliest-driven output node S is not located adjacent to the latest-driven output node S. Thus, it is possible to suppress the variation in the voltage level of the earliest-driven output node S.

In the operation of FIG. 17A, the waveforms of the control signals MUXSW1 to MUXSW4 can be changed in the range that satisfies the following conditions:

(1) The control signals MUXSW1 and MUXSW3 are not activated at a same time;

(2) The control signals MUXSW2 and MUXSW4 are not activated at a same time; and (3) Each control signal $MUXSW_j$ (j=1, 2, 3 and 4) is active, while the control signal $AMPOUTSW_j$ is active at least.

Figure 17B:
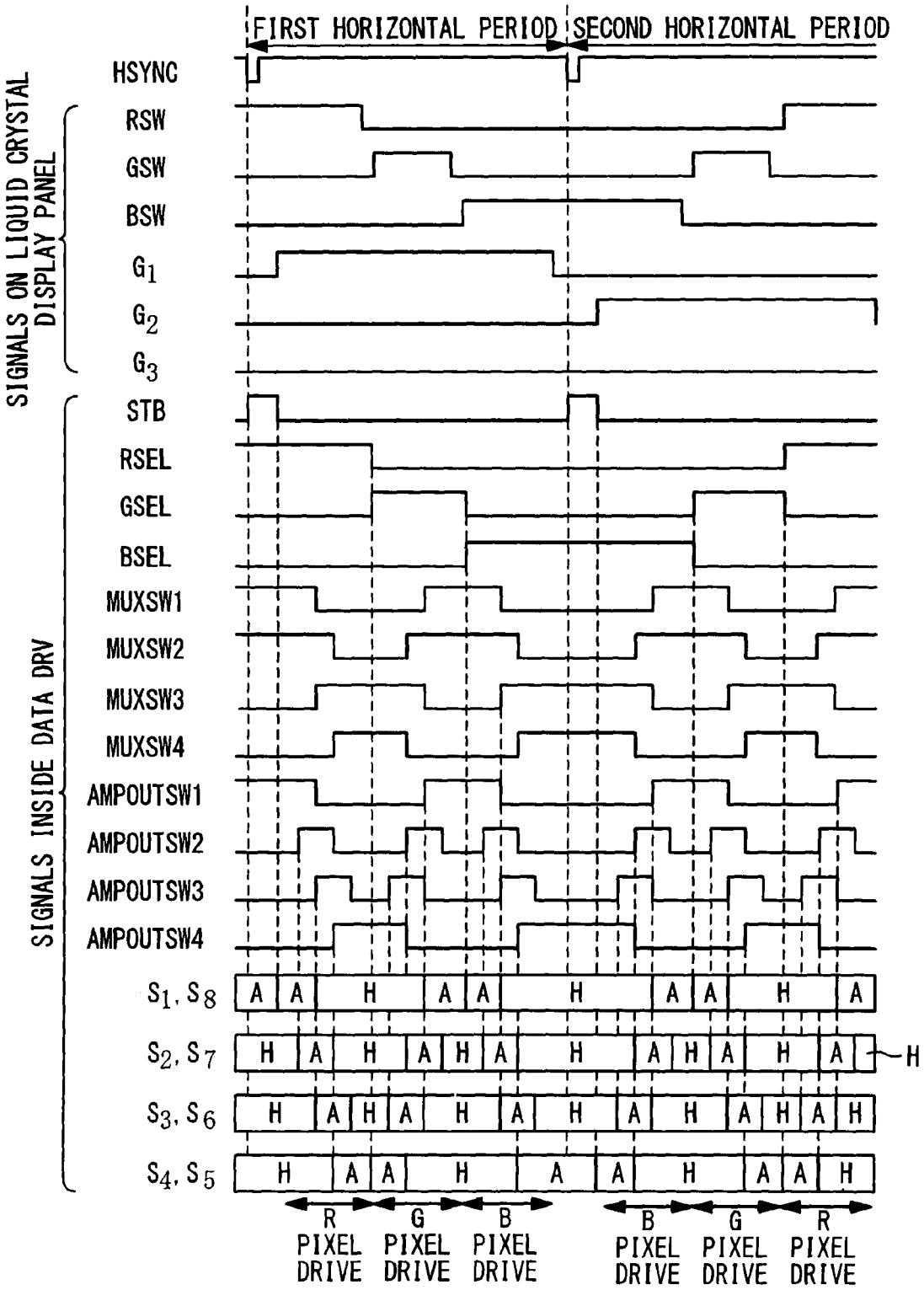
FIG. 17B is timing charts showing the preferable operation of the liquid crystal display apparatus shown in FIGS. 15A and 15B.

FIG. 17B is timing charts showing the different waveforms of the control signals MUXSW1 to MUXSW4 that satisfy the foregoing conditions. In the operation of FIG. 17B, when the first horizontal period is started, the control signals MUXSW1, MUXSW2 and AMPOUTSW1 are active, and the control signals MUXSW3, MUXSW4 and AMPOUTSW 2 to 4 are inactive.

At first, the R-pixels 3 are driven. Specifically, at first, in the situation that the control signals RSW, AMPOUTSW1 are active, the latch signal STB is activated, and the drive voltage corresponding to the pixel data $X_{R1}$ is outputted to the data line $DR_1$. Thus, the R-pixels 3 connected to the data line $DR_1$ is driven.

Next, in order to drive the R-pixels 3 connected to the data line $DR_2$, the control signal AMPOUTSW2 is activated. When the driving of the R-pixels 3 connected to the data lines $DR_1$ and $DR_2$ have been completed, the control signals AMPOUTSW1, AMPOUTSW2 are sequentially deactivated. The control signals MUXSW1 and MUXSW2 are deactivated together with the deactivation of the control signals AMPOUTSW1 and AMPOUTSW2.

In order to drive the R-pixel 3 connected to the data line $DR_3$, the control signal AMPOUTSW3 is activated together with the deactivation of the control signal AMPOUTSW1. The control signal MUXSW3 is activated together with the activation of the control signal AMPOUTSW3. When the driving of the R-pixel 3 connected to the data line $DR_3$ has been completed, the control signal AMPOUTSW3 is deactivated. Even if the AMPOUTSW3 is deactivated, the control signal MUXSW3 continues to be active.

Moreover, in order to drive the R-pixel 3 connected to the data line $DR_4$, the control signal AMPOUTSW4 is activated together with the deactivation of the control signal AMPOUTSW2. The control signal MUXSW4 is activated together with the activation of the control signal AMPOUTSW4. After that, even if the driving of the R-pixel 3 connected to the data line $DR_4$ has been completed, the control signals AMPOUTSW4 and MUXSW4 continue to be active.

In succession, the G-pixels 3 are driven. Specifically, at first, in the situation that the control signal AMPOUTSW4 is successively active, the control signal RSEL is deactivated, and the control signal GSEL is activated. Thus, the G-pixel 3 connected to the data line $DG_4$ is driven. In succession, in order to drive the G-pixel 3 connected to the data line $DG_3$, the control signal AMPOUTSW3 is activated. It should be noted that, since the control signals MUXSW3 and MUXSW4 continue to be successively active after the completion of the driving of the R-pixels 3, the control signals MUXSW3 and MUXSW4 are not required to be switched. When the driving of the G-pixels 3 connected to the data lines $DG_4$ and $DG_3$ has been completed, the control signals AMPOUTSW4 and AMPOUTSW3 are deactivated. The control signals MUXSW4 and MUXSW3 are deactivated together with the deactivation of the control signals AMPOUTSW4 and AMPOUTSW3.

In succession, in order to drive the G-pixel 3 connected to the data line $DG_2$, the control signal AMPOUTSW2 is activated. The control signal MUXSW2 is activated together with the activation of the control signal AMPOUTSW2. After that, when the driving of the G-pixel 3 connected to the data line $DG_2$ has been completed, the control signal MUXSW2 continues to be active, even if the control signal AMPOUTSW2 is deactivated.

Moreover, in order to drive the G-pixel 3 connected to the data line $DG_1$, the control signal AMPOUTSW1 is activated. The control signal MUXSW1 is activated together with the activation of the control signal AMPOUTSW1. After that, even if the driving of the G-pixel 3 connected to the data line $DG_1$ has been completed, the control signals AMPOUTSW1 and MUXSW1 continue to be active.

Further in succession, the B-pixels 3 are driven. Specifically, in the situation that the control signal AMPOUTSW1 is successively active, the control signal GSEL is deactivated, and the control signal BSEL is activated. Thus, the B-pixel 3 connected to the data line $DB_1$ is driven. In succession, in order to drive the B-pixel 3 connected to the data line $DB_2$, the control signal AMPOUTSW2 is activated. When the driving of the B-pixels 3 connected to the data lines $DB_1$ and $DB_2$ has been completed, the control signals AMPOUTSW1 and AMPOUTSW2 are deactivated. The control signals MUXSW1 and MUXSW2 are deactivated together with the deactivation of the control signals AMPOUTSW1 and AMPOUTSW2.

In succession, in order to drive the B-pixel 3 connected to the data line $DB_3$, the control signal AMPOUTSW3 is activated. The control signal MUXSW3 is activated together with the activation of the control signal AMPOUTSW3. After that, when the driving of the B-pixel 3 connected to the data line $DB_3$ has been completed, the control signal MUXSW3 continues to be active, even if the control signal AMPOUTSW3 is deactivated.

In succession, in order to drive the B-pixel 3 connected to the data line $DB_4$, the control signal AMPOUTSW4 is activated. The control signal MUXSW4 is activated together with the activation of the control signal AMPOUTSW4. After that, even if the driving of the B-pixel 3 connected to the data line $DB_4$ is completed and the control signal AMPOUTSW4 is deactivated, the control signal MUXSW4 continues to be active.

Also in the second horizontal period, the pixels 3 are similarly driven, except for the change in the order when the pixels 3 are driven.

The merit of the operation shown in FIG. 17B lies in the reduction in the number of times of switching of the control signals MUXSW1 to MUXSW4. In the operation in FIG. 11A, the control signals MUXSW1 to MUXSW4 are required to be pulled up a total of 12 times and pulled down a total 12 times in one horizontal period. On the other hand, in the operation of FIG. 11B, the control signals MUXSW1 to MUXSW4 are required to be pulled up a total of only 6 times and pulled down a total of only 6 times. The reduction in the switching numbers of the control signals MUXSW1 to MUXSW4 is preferred to reduce the electric consumed power.

As described above, in any of the first, second and third embodiments, since the data lines and the demultiplexers are provided for both of the liquid crystal display panel and the data driver IC, the height of the throttling region 8 can be made lower. Also, in any of the first, second and third embodiments, the influence of the capacitance coupling of the wiring 7 is suppressed, which can make the wiring interval narrower and make the height of the throttling region 8 shorter.

Although the various embodiments have been described, the scope of the present invention should not be construed under the limitation to the above-mentioned embodiments. It would be understood by those skilled in the art that the present invention can be applied to the display apparatuses other than the liquid crystal display apparatus. Also, in the above-mentioned embodiments, by the demultiplexer provided in the data driver IC, each output amplifier is related to the two output nodes S, and by the demultiplexer provided on the liquid crystal display panel, each output node S is correlated to the 3 data lines D. However, it should be noted that the number of output nodes S to which each output amplifier is related and the number of data lines D to which each output node S is related can be properly changed.

Moreover, it should be noted that as the method of driving the liquid crystal display panel, various driving methods can be employed, and the present invention can be applied to, for example, any of a line inversion drive and a dot inversion drive.

Also, the operation for switching the driving order of the output nodes for each line or frame is intended to suppress the flicker generation by averaging the write times into the pixels of the same color. However, in the foregoing description, the switching between the writing orders is described to carry out for each one line and one frame. However, the polarity inversion must be considered for the switching operation for the actual driving order. Thus, the optimal switching method for the driving order is required to be selected by considering the polarity inversion operation. With regard to the switching operation for the driving order, the four driving methods are considered not only for each one line and one frame, but also for each two lines and one frame, for each one line and two frames and for each two lines and two frames.

According to the present invention, while the number of data lines that are driven in the time divisional manner by one output amplifier is increased, the increase in the portion except the effective display region on the display panel can be suppressed.

Although the present invention has been described above in connection with several embodiments thereof, it will be appreciated by those skilled in the art that those embodiments are provided solely for illustrating the present invention, and should not be relied upon to construe the appended claims in a limiting sense.

What is claimed is:

1. A display apparatus comprising:

a display panel; and a data driver configured to output drive voltages from a plurality of output nodes to drive said display panel, wherein said data driver comprises:

a plurality of output amplifiers, each of which is configured to receive a gradation voltage corresponding to a pixel data and to output said drive voltage in response to said gradation voltage; and a driver-side demultiplexer configured to connect said plurality of output amplifiers selection output nodes selected from among said plurality of output nodes, wherein said display panel comprises:

a plurality of data lines; and a panel-side demultiplexer configured to connect selection data lines selected from among said plurality of data lines with said plurality of output nodes, wherein said data driver further comprises:

a plurality of digital-to-analog (D/A) converters configured to receive a plurality of gradation voltages and to output gradation voltages, corresponding to said pixel data, of said plurality of gradation voltages;

a multiplexer configured to connect outputs of selection D/A converters selected from among said plurality of D/A converters, with said plurality of output amplifiers; and a direct switch configured to connect the outputs of said plurality of D/A converters with said plurality of output nodes, wherein said plurality of output nodes comprises first and second output nodes, wherein said of output amplifiers comprises a first output amplifier, wherein said plurality of D/A converters comprises a first D/A converter and a second D/A converter, wherein said multiplexer connects an output of one of said first and second D/A converters with an input of said first output amplifier, wherein said driver-side demultiplexer connects an output of said first output amplifier with one of said first and second output nodes, wherein said direct switch connects said first and second D/A converters with said first and second output nodes, respectively, wherein said driver-side demultiplexer connects the output of said first output amplifier with said first output node in a first period in a horizontal period, wherein said driver-side demultiplexer connects the output of said first output amplifier with said second output node in a second period subsequent to said first period in said horizontal period, and wherein said direct switch connects the output of said first D/A converter with said first output node.

2. The display apparatus according to claim 1, wherein said driver-side demultiplexer disconnects the output of said first output amplifier from said second output node in a third period subsequent to said second period in said horizontal period, and said direct switch connects the output of said second D/A converter with said second output node.

3. A display apparatus comprising:

a display panel; and a data driver configured to output drive voltages from a plurality of output nodes to drive said display panel, wherein said data driver comprises:

a plurality of output amplifiers, each of which is configured to receive a gradation voltage corresponding to a pixel data and to output said drive voltage in response to said gradation voltage; and a driver-side demultiplexer configured to connect said plurality of output amplifiers to selection output nodes selected from among said plurality of output nodes, wherein said display panel comprises:

a plurality of data lines, and a panel-side demultiplexer configured to connect selection data lines selected from among said plurality of data lines with said plurality of output nodes, wherein said data driver further comprises:

a plurality of di converters configured to receive a plurality of gradation voltages and to output gradation voltages, corresponding to said pixel data, of said plurality of gradation voltages;

a multiplexer configured to connect outputs of selection D/A converters selected from among said plurality of D/A converters, with said plurality of output amplifiers; and a direct switch configured to connect the outputs of said plurality of D/A converters with said plurality of output nodes, wherein said plurality of output nodes comprises first and second output nodes, wherein said plurality of output amplifiers comprises a first output amplifier, wherein said plurality of D/A converters comprises a first D/A converter and a second D/A converter, wherein said multiplexer connects an output of one of said first and second D/A converters with an input of said first output amplifier, wherein said driver-side demultiplexer connects an output of said first output amplifier with one of said first and second output nodes, wherein said direct switch connects said first and second D/A converters with said first and second output nodes, respectively, wherein said driver-side demultiplexer connects the output of said first output amplifier with said first output node in a first period in a horizontal period, wherein said driver-side demultiplexer connects the output of said first output amplifier with said second output node in a second period subsequent to said first period in said horizontal period, wherein said driver-side demultiplexer connects the output of said first output amplifier with said second output node in a third period in a next horizontal period to said horizontal period, and wherein said driver-side demultiplexer connects the output of said first output amplifier with said first output node in a fourth period subsequent to said third period in said next horizontal period.

4. A display apparatus comprising:

a display panel; and a data driver configured to output drive voltages from a plurality of output nodes to drive said display panel, wherein said data driver comprises:

a plurality of output amplifiers, each of which is configured to receive a gradation voltage corresponding to a pixel data and to output said drive voltage in response to said gradation voltage; and a driver-side demultiplexer configured to connect said plurality of output amplifiers to selection output nodes selected from among said plurality of output nodes, wherein said display panel comprises:

a plurality of data lines; and a panel-side demulitplexer configured to connect selection data lines selected from among said plurality of data lines with said plurality of output nodes, wherein said data driver further comprises:

a plurality of digital-to-analog (D/A) converts configured to receive a plurality of gradation voltages and to output gradation voltages, corresponding to said pixel data, of said plurality of gradation voltages;

a multiplexer configured to connected outputs of selection D/A converters selected from among said plurality of D/A converts, with said plurality of output amplifiers; and a direct switch configured to connect the outputs of said plurality of D/A converters with said plurality of output nodes, wherein said plurality of output nodes comprises first and second output nodes, wherein said plurality of output amplifiers comprises a first output amplifiers, wherein said plurality of D/A converters comprises a first D/A converter and a second D/A converter, wherein said multiplexer connects an output of one of said first and second D/A converts with an input of said first output amplifier, wherein said driver-side demultiplexer connects an output of said first output amplifier with one of said first and second output nodes, wherein said direct switch connects said first and second D/A converters with said first and second output nodes, respectively, wherein said driver-side demultiplexer connects the output of said first amplifier with said first output node in a first period in a m-th horizontal period a frame period, where m is an integer greater than or equal to 1, wherein said driver-side demulitplexer connects the output of said first output amplifier with said second output node in a second period subsequent to said first period in said m-th horizontal period of said frame period, wherein said driver-side demultiplexer connects the output of said first output amplifier with said second output node in a third period in said m-th horizontal period of a next frame period to said frame period, and wherein said driver-side demultiplexer connects the output of said first output amplifier with said first output node in a fourth period subsequent to said third period in said m-th horizontal period of said next frame period.

5. A display apparatus comprising:

a display panel; and a data driver configured to output drive voltages from a plurality of output nodes to drive said display panel, wherein said data driver comprises:

a plurality of output amplifiers, each of which is configured to receive a gradation voltage corresponding to a pixel data and to output said drive voltage in response to said gradation voltage; and a driver-side demultiplexer configured to connect said plurality of output amplifiers to selection output nodes selected from among said plurality of output nodes wherein said display panel comprises:

a plurality of data lines; and a panel-side demultiplexer configured to connect selection data lines selected from among said plurality of data lines with said plurality of output nodes, wherein said data driver further comprises:

a plurality of digital-to-analog (D/A) converters configured to receive a plurality of gradation voltages and to output gradation voltages, corresponding to said pixel data, of said plurality of gradation voltages;

a multiplexer configured to connect outputs of selection D/A converters selected from among said plurality of D/A converters, with said plurality of output amplifiers; and a direct switch configured to connect the outputs of said plurality of D/A converters with said plurality of output nodes, wherein:

said plurality of output nodes comprises first to fourth output nodes, which are arranged in an order of first to fourth output nodes, said plurality of output amplifiers comprises first and second output amplifiers, said plurality of D/A converters comprises first to fourth D/A converters, said multiplexer connects an output of one of said first and third D/A converters with an input of said first output amplifier, and connects an output of one of said second and fourth D/A converters with an input of said second output amplifier, said driver-side demultiplexer connects the output of said first output amplifier with one of said first and third output nodes, and connects the output of said second output amplifier with one of said second and fourth output nodes, said direct switch connects said first to fourth D/A converters with said first to fourth output nodes, respectively, wherein:

said driver-side demultiplexer connects the output of said first output amplifier with said first output node at the first time connects the output of said second output amplifier with said second output node while connecting the output of said first output amplifier with said first output node at the second time after said first time, and disconnects the output of said first output amplifier from said first output node at a third time after the second time, and said direct switch connects the output of said first D/A converter with said first output node at the third time.

6. A display apparatus comprising:

a display panel; and a data driver configured to output drive voltages from a plurality of output nodes to drive said display panel, wherein said data driver comprises:

a plurality of output amplifiers, each of which is configured to receive a gradation voltage corresponding to a pixel data and to output said drive voltage in response to said gradation voltage; and a driver-side demultiplexer configured to connect said plurality of output amplifiers to selection output nodes selected from among said plurality of output nodes, wherein said display panel comprises:

a plurality of data lines; and a panel-side demultiplexer configured to connect selection data lines selected from among said plurality of data lines with said plurality of output nodes, wherein said data driver further comprises:

a first D/A converter configured to receive a plurality of gradation voltages and to output a first gradation voltage corresponding to a first pixel data from among said plurality of gradation voltages; and a second D/A converter configured a second gradation voltage corresponding to a second pixel data from among said plurality of gradation voltages, wherein said plurality of output nodes comprises first to fourth output nodes, which are arranged in this order, wherein said plurality of output amplifiers comprises:

a first output amplifier configured to receive first gradation voltage from said first D/A converter and to output a first drive voltage in response to said first gradation voltage; and a second output amplifier configured to receive said second gradation voltage from said second D/A converter and to output a second drive voltage in response to said second gradation voltage, wherein said driver-side demultiplexer connects the output of said first output amplifier with one of said first and third output nodes, and connects the output of said second output amplifier with one of said second and fourth output nodes, wherein said driver-side demultiplexer connects the output of said first output amplifier with said first output node at a first time, and connects the output of said second output amplifier with said second output node while connecting the output of said first output amplifier with said first output node at a second time after said first time, wherein said driver-side demultiplexer connects the output of said first output amplifier with said third output node while connecting the output of said second output amplifier with said second output node at a third time after said second time, and connects the output of said second output amplifier with said fourth output node while connecting the output of said first output amplifier with said third output node at a fourth time after said third time, and wherein said driver-side demultiplexer connects the output of said second output amplifier with said fourth output node at said first time.

* * * * *